US008166335B2

(12) United States Patent
Kawamura et al.

(10) Patent No.: US 8,166,335 B2
(45) Date of Patent: Apr. 24, 2012

(54) SPECIFIC-EQUIPMENT MANAGEMENT SYSTEM, SPECIFIC-EQUIPMENT MANAGEMENT PROGRAM, AND SPECIFIC-EQUIPMENT MANAGEMENT METHOD IN WHICH QUESTION INFORMATION REGARDING A QUESTION ESTIMATING A SPECIFIC-ERROR CAUSE IS GENERATED, THE ERROR REGARDING THE SPECIFIC-EQUIPMENT AND INCLUDING HUMAN ERROR REGARDING THE HUMAN OPERATION

(75) Inventors: Shuhei Kawamura, Shiga (JP); Masaya Nishimura, Shiga (JP); Ryozo Inada, Shiga (JP)

(73) Assignee: Daikin Industries, Ltd., Osaka (JP)

( * ) Notice: Subject to any disclaimer, the term of this patent is extended or adjusted under 35 U.S.C. 154(b) by 975 days.

(21) Appl. No.: 12/158,879

(22) PCT Filed: Dec. 19, 2006

(86) PCT No.: PCT/JP2006/325253
§ 371 (c)(1),
(2), (4) Date: Jun. 23, 2008

(87) PCT Pub. No.: WO2007/074676
PCT Pub. Date: Jul. 5, 2007

(65) Prior Publication Data

US 2009/0049344 A1 Feb. 19, 2009

(30) Foreign Application Priority Data

Dec. 29, 2005 (JP) ..... 2005-380567

(51) Int. Cl.
*G06F 11/00* (2006.01)

(52) U.S. Cl. ..... 714/1; 700/17; 700/83; 714/25; 714/46; 714/57; 715/709

(58) Field of Classification Search ..... 714/1, 25–27, 714/46, 48, 57; 340/286.01; 700/17, 83, 700/90, 109, 110, 177; 715/709
See application file for complete search history.

(56) References Cited

U.S. PATENT DOCUMENTS 6,681,344 B1 * 1/2004 Andrew ..... 714/38.14
2002/0064259 A1 * 5/2002 Tsai ..... 379/106.01
(Continued)

FOREIGN PATENT DOCUMENTS

JP 08-137540 A 5/1996
(Continued)

*Primary Examiner* — Philip Guyton
*Assistant Examiner* — Joseph Kudirka
(74) *Attorney, Agent, or Firm* — Global IP Counselors

(57) ABSTRACT

A specific-equipment management system is equipped with a question generator, a display unit and an input unit and manages a water heater. The water heater is equipment that requires human operation in the vicinity when used. The question generator generates question information. The question information is information regarding a question for specifying a specific-error. The "specific-error" is an error regarding the water heater and includes an error regarding the human operation. The display unit displays the question information. Response information is then inputted to the input unit by the user based on the question information displayed at the display unit. The response information is information regarding the state of the water heater or the state of the human operation. The question generator generates next question information based on the response information. The display unit then displays the next question information.

22 Claims, 33 Drawing Sheets

U.S. PATENT DOCUMENTS

| | | | | |
|---|---|---|---|---|
| 2003/0009710 | A1 * | 1/2003 | Grant | 714/37 |
| 2005/0097405 | A1 * | 5/2005 | Sesek et al. | 714/48 |

FOREIGN PATENT DOCUMENTS

| | | | |
|---|---|---|---|
| JP | 10-196949 | A | 7/1998 |
| JP | 11-261714 | A | 9/1999 |
| JP | 2002-44750 | A | 2/2002 |
| JP | 2002-132995 | A | 5/2002 |
| JP | 2003-90618 | A | 3/2003 |
| JP | 2003-173207 | A | 6/2003 |
| JP | 2004-353981 | A | 12/2004 |

* cited by examiner

SPECIFIC-EQUIPMENT MANAGEMENT SYSTEM, SPECIFIC-EQUIPMENT MANAGEMENT PROGRAM, AND SPECIFIC-EQUIPMENT MANAGEMENT METHOD IN WHICH QUESTION INFORMATION REGARDING A QUESTION ESTIMATING A SPECIFIC-ERROR CAUSE IS GENERATED, THE ERROR REGARDING THE SPECIFIC-EQUIPMENT AND INCLUDING HUMAN ERROR REGARDING THE HUMAN OPERATION

CROSS-REFERENCE TO RELATED APPLICATIONS

This U.S. National stage application claims priority under 35 U.S.C. §119(a) to Japanese Patent Application No. 2005-380567, filed in Japan on Dec. 29, 2005, the entire contents of which are hereby incorporated herein by reference.

TECHNICAL FIELD

The present invention relates to a specific-equipment management system, a specific-equipment management program, and a specific-equipment management method.

BACKGROUND ART

Systems have been proposed that manage equipment errors via a network (for example, refer to Japanese Patent Publication Laid-open No. 2002-44750 (pages 1 to 7, FIG. 1 to FIG. 5)). For example, with a system of Japanese Patent Publication Laid-open No. 2002-44750 (pages 1 to 7, FIG. 1 to FIG. 5), information for equipment errors is sent from equipment to an observation center via a network. The errors of the equipment are then analyzed at the observation center. Equipment errors are then managed via the network.

SUMMARY OF THE INVENTION

Technical Problem

However, in the case of the management of specific-equipment that is equipment requiring operation by a person in the vicinity when used, conventional systems diagnose equipment errors at an observation center. There is therefore a tendency for it to be difficult to comprehend the causes of specific-errors that are errors regarding the specific-equipment, the specific-errors including human error that is an error regarding human operation. For example, when a bath tub is filled with hot water by a hot water heater, the bath tub may not fill up as a result of the plughole of the bath tub not being properly covered. In such cases, it is difficult to understand at the management center that the plughole of the bath tub has not been completely covered.

The object of the present invention is to provide a specific-equipment management system, a specific-equipment management program, and a specific-equipment management method capable of comprehending the cause of an error even when the error is a specific-error caused by human operation.

Technical Solution

A specific-equipment management system of a first aspect of the present invention is a specific-equipment management system that manages specific-equipment and includes a question generator, a display unit, and an input unit. The specific-equipment is equipment that requires a human operation in the vicinity when used. The question generator generates question information. The question information is information relating to a question for estimating a specific-error cause. The "specific-error cause" refers to a cause of a specific-error. The "specific-error" is an error regarding the specific-equipment and includes an error resulting from the human operation. The display unit displays the question information. Response information is then inputted to the input unit by the user based on the question information displayed at the display unit. The response information is information regarding at least one of the state of the specific-equipment and the state of the human operation. The question generator generates next question information based on the response information. The display unit then displays the next question information.

The specific-equipment management system generates and displays question information and prompts an input of response information to the question information by the user of the specific-equipment. When the response information is inputted by the user of the specific-equipment, next question information is generated and displayed based on the inputted response information. In this way, question information is repeatedly generated and displayed and response information is repeatedly inputted at the specific-equipment management system. It is therefore possible for the specific-equipment management system to understand the cause of an error even when the error is a specific-error caused by a human operation.

A specific-equipment management system of a second aspect of the invention is the specific management system of the first aspect of the invention, an instruction to start up a diagnostic program that is a program for diagnosing the specific-error is inputted at the input unit.

With this specific-equipment management system, the diagnostic program that is the program diagnosing a specific-error is started up manually by the user of the specific-equipment. It is therefore possible for the specific-equipment management system to understand the cause of a specific-error when the user of the specific-equipment has become aware of the specific-error.

A specific-equipment management system of a third aspect of the present invention is the specific-equipment management system of the first aspect of the present invention, further including a detection unit and an instruction generator. The detection unit detects the specific-error. The instruction generator generates an instruction to start up a diagnostic program that is a program for diagnosing the specific-error based on information for the specific-error.

With this specific-equipment management system, when a specific-error is detected, a diagnostic program that is a program for diagnosing the specific-error is automatically started up. It is therefore possible for the specific-equipment management system to understand the cause of a specific-error when the specific-error is detected.

A specific-equipment management system of a fourth aspect of the present invention is the specific-equipment management system of any one of the first to third aspects, the specific-equipment is equipment utilizing a water supply.

The specific-equipment management system manages equipment utilizing the water supply. It is therefore possible for the specific-equipment management system to understand the cause of a specific-error occurring at equipment utilizing the water supply.

A specific-equipment management system of a fifth aspect of the present invention is the specific-equipment management system of the fourth aspect of the present invention, where the specific-equipment is a hot water heater.

The specific-equipment management system manages the hot water heater. It is therefore possible for the specific-equipment management system to understand the cause of a specific-error occurring at the hot water heater.

A specific-equipment management system of a sixth aspect of the present invention is the specific-equipment management system of any of the first to fifth aspects of the present invention, further including an estimation generator. The estimation generator generates estimation result information based on the response information. The estimation result information is information relating to a result estimated for the cause of the specific-error. The display unit then further displays the estimation result information.

The specific-equipment management system generates and displays estimation result information based on the response information. It is therefore possible for the user of the specific-equipment to narrow down the causes of an error at specific-equipment with this specific-equipment management system.

A specific-equipment management system of a seventh aspect of the present invention is the specific-equipment management system of the sixth aspect of the present invention, further including a determination unit. The determination unit determines whether or not it is possible to generate the estimation result information based on the response information. When the determination unit determines that generation of the estimation result information is not possible, the question generator generates the next question information based on the response information. The estimation generator generates the estimation result information based on the response information when the determination unit determines that generation of the estimation result information is possible.

This specific-equipment management system generates estimation result information when it is determined that generation of the estimation result information is possible, and generates next question information when it is determined that generation of the estimation result information is not possible. In this way, question information is repeatedly generated by this specific-equipment management system until the estimation result information is generated. It is therefore possible to generate estimation result information at the specific-equipment management system.

A specific-equipment management system of an eighth aspect of the present invention is the specific-equipment management system of the seventh aspect of the present invention, where verification result information is further inputted to the input unit based on the estimation result information. The verification result information is information for a result where the cause of the specific-error has been verified. The determination unit further determines which of the resolution information or the repair information is to be generated based on the verification result information. "Resolution information" is information indicating that a specific-error has been resolved. "Repair information" is information indicating that repair of a specific-error is necessary.

In this specific-equipment management system, verification result information is inputted for the estimation result information by the user of the specific-equipment. The specific-equipment management system then determines which of the resolution information or the repair information is to be generated based on the inputted verification result information. At this specific-equipment management system, necessity of repair of the specific-equipment is determined automatically based on the verification result information inputted by the user.

A specific-equipment management system of a ninth aspect of the present invention is the specific-equipment management system of the sixth or the seventh aspect of the present invention, where either one of resolution information or repair information is inputted to the input unit based on verification result information. The verification result information is information for a result where the specific-error cause is verified based on the estimation result information. The "resolution information" is information indicating that a specific-error has been resolved. The "repair information" is information indicating that repair of a specific-error is necessary.

In this specific-equipment management system, either one of the resolution information or the repair information is inputted by the user of the specific-equipment after determining the necessity of repair to the specific-equipment based on verification result information for the estimation result information. At this specific-equipment management system, necessity of repair is determined based on resolution information or repair information inputted by the user of the specific-equipment.

A specific-equipment management system of a tenth aspect of the invention is the specific management system of any one of the first to ninth aspects of the invention, an instruction to start up a confirmation program is inputted at the input unit after completion of installation work or repairs. The confirmation program is a program for confirming whether or not installation work or repair is completed normally.

With this specific-equipment management system, a confirmation program for confirming whether or not installation work or repair has been completed normally is started up manually by the person performing the installation work or repair of the specific-equipment. In this way, at this specific-equipment management system, it is possible for the person performing the installation work or repair on the specific-equipment to confirm whether or not the installation work or repair has been completed normally. It is therefore possible to reduce the likelihood of human error in the installation work or repair.

A specific-equipment management system of an eleventh aspect of the present invention is the specific-equipment management system of the seventh aspect of the present invention, further including a remote management apparatus. The remote management apparatus manages the specific-equipment via a network. The remote management apparatus is connected to the question generator and the determination unit via the network. The determination unit further determines whether or not online diagnostic processing is to be carried out when it is determined that generation of the estimation result information is not possible. The remote management apparatus generates next question information or estimation result information based on the response information when the determination unit determines that online diagnostic processing is to be carried out. The display unit receives and displays the next question information or the estimation result information from the remote management apparatus via the network.

With this specific-equipment management system, when question information is generated on the side (hereinafter referred to as the "user side") where the specific-equipment is installed but it is determined that it is not possible to generate estimation result information on the user side, question information is generated on the side where the remote management apparatus is installed (hereinafter referred to as the "remote side"). Namely, the processing is switched over to online diagnostics when it is determined that it is not possible to generate estimation result information on the user side. Typically, it is possible to store a large amount of information such as past examples that are necessary to generate estimation result information in advance on the remote side. It is therefore possible to provide detailed estimates of the cause of the specific-error by utilizing information such as large quantities of past examples at this specific-equipment management system.

A specific-equipment management system of a twelfth aspect of the present invention is the specific-equipment management system of the third aspect of the present invention, where the instruction generator is remote from the input unit and the display unit via a network.

This specific-equipment management system generates instructions to start-up a diagnostic program on the remote side. It is therefore possible to make the user aware of the equipment error remotely, with the specific-equipment management system.

A specific-equipment management system of a thirteenth aspect of the present invention is the specific-equipment management system of the second or third aspect of the present invention, further including a control unit and a remote management apparatus. The control unit controls the question generator, the display unit, and the input unit. The remote management apparatus manages the specific-equipment via a network. The remote management apparatus is connected to the control unit via the network. The remote management apparatus stores information for the diagnostic program. The control unit receives information for the diagnostic program via the network from the remote management apparatus based on information for the instruction to start-up the diagnostic program.

With this specific-equipment management system, information for a diagnostic program is stored on the remote side and is sent from the remote side to the user side via the network when the diagnostic program is started up. It is therefore possible to easily update the diagnostic program at the specific-equipment management system.

A specific-equipment management system of a fourteenth aspect of the present invention is the specific-equipment management system of the eighth aspect of the present invention, further including a remote management apparatus. The remote management apparatus manages the specific-equipment via a network. The remote management apparatus receives at least one of the estimation result information and the verification result information via the network.

In this specific-equipment management system, at least one of the estimation result information and the verification result information is sent from the user side to the remote side via the network. As a result, it is possible for the specific-equipment management system to manage at least one of the estimation result information and the verification result information via the network.

A specific-equipment management system of a fifteenth aspect of the present invention is the specific-equipment management system of the eighth or ninth aspect of the present invention, further including a remote management apparatus. The remote management apparatus manages the specific-equipment via a network. The remote management apparatus receives the repair information via a network.

In this specific-equipment management system, the repair information from the user side to the remote side is sent via the network. Therefore, only when repair of a specific-error is necessary, the fact that the repair is necessary can be notified to the remote side. It is therefore possible to prevent the service staff from making unnecessary journeys to perform repairs.

A specific-equipment management system of a sixteenth aspect of the present invention is the specific-equipment management system of the second or third aspect of the present invention, where the question generator is remote from the input unit and the display unit via a network.

This specific-equipment management system generates question information on the remote side. Typically, it is possible to store a large amount of information such as past examples that are necessary to generate question information in advance on the remote side. It is therefore possible to provide detailed estimates of the cause of a specific-error by utilizing information such as large quantities of past examples at this specific-equipment management system.

A specific-equipment management system of a seventeenth aspect of the present invention is the specific-equipment management system of the third aspect of the present invention, where the question generator and the instruction generator are remote from the input unit and the display unit via a network.

This specific-equipment management system starts up the diagnostic program on the remote side and generates question information on the remote side. Typically, it is possible to store a large amount of information such as past examples that are necessary to generate question information in advance on the remote side and it is possible to store complex diagnostic programs in advance to a greater extent than on the user side. It is therefore possible to provide detailed estimates of the cause of a specific-error by utilizing information such as large quantities of past examples and a complex diagnostic program at this specific-equipment management system.

A specific-equipment management system of an eighteenth aspect of the present invention is the specific-equipment management system of any one of the first to tenth aspects of the present invention, further including a control unit and a remote management apparatus. The control unit controls the question generator, the display unit, and the input unit. The remote management apparatus manages the specific-equipment via a network. The remote management apparatus is connected to the control unit via the network. The remote management apparatus sends next connection information that is information regarding the next connection of the control unit and the remote management apparatus to the control unit via the network.

In this specific-equipment management system, the next connection information is sent from the remote side to the user side via the network. This means that it is possible to implement pseudo-bi-directional connection between the user side and the remote side even in cases where the user side and the remote side are not always connected.

A specific-equipment management system of a nineteenth aspect of the present invention is the specific-equipment management system of the eighteenth aspect of the present invention, where the next connection information includes at least one of time information and transmission information. The time information is information regarding the time of the next connection of the control unit and the remote management apparatus via the network. The transmission information is information regarding data to be transmitted from the control unit to the remote management apparatus at the time of the next connection of the control unit and the remote management apparatus via the network.

With this specific-equipment management system, at least one of the time information and the transmission information is sent from the remote side to the user side. It is therefore possible for the user side to send data designated by the remote side to the remote side at the time designated by the remote side.

A specific-equipment management program of a twentieth aspect of the invention is a specific-equipment management program managing specific-equipment that makes a computer implement a first question generating step, a first display step, an input receiving step, a second question generating step, and a second display step. The specific-equipment is equipment that requires a human operation in the vicinity when used. Question information is generated in the first question generating step. The question information is information relating to a question for estimating a specific-error cause. The "specific-error cause" refers to a cause of a specific-error. The "specific-error" is an error regarding specific-equipment and includes an error resulting from the human operation. The question information is then displayed in the first display step. A response information is inputted in the input receiving step based on the question information displayed in the first display step. The response information is information regarding at least one of the state of the specific-equipment and the state of the human operation. Next question information is generated in the second question generating step based on the response information. The next question information is then displayed in the second display step.

When this specific-equipment management program is executed, the user of the specific-equipment is prompted to input response information to the displayed question information in response to the question information being generated and displayed. When response information is inputted by the user of the specific-equipment, next question information is generated and displayed based on the inputted response information. In this way, when this specific-equipment management program is executed, question information is repeatedly generated and displayed, and response information is repeatedly inputted. According to this specific-equipment management program, it is possible to understand the cause of an error even when the error is a specific-error caused by a human operation.

A specific-equipment management method of a twenty-first aspect of the invention is a specific-equipment management method that manages specific-equipment including a first question generating step, a first display step, an input receiving step, a second question generating step, and a second display step. The specific-equipment is equipment that requires a human operation in the vicinity when used. Question information is generated in the first question generating step. The question information is information relating to a question for estimating a specific-error cause. The "specific-error cause" refers to a cause of a specific-error. The "specific-error" is an error regarding specific-equipment and includes an error resulting from the human operation. The question information is then displayed in the first display step. The response information is inputted in the input receiving step based on the question information displayed in the first display step. The response information is information regarding at least one of the state of the specific-equipment and the state of the human operation. Next question information is generated in the second question generating step based on the response information. The next question information is then displayed in the second display step.

With this specific-equipment management method, the user of the specific-equipment is prompted to input response information to the displayed question information in response to the question information being generated and displayed. When response information is inputted by the user of the specific-equipment, next question information is generated and displayed based on the inputted response information. In this way, with this specific-equipment management method, question information is repeatedly generated and displayed, and response information is repeatedly inputted. According to this specific-equipment management method, it is possible to understand the cause of an error even when the error is a specific-error caused by a human operation.

ADVANTAGEOUS EFFECTS

A specific-equipment management system of a first aspect of the present invention generates and displays question information and prompts an input of response information to the question information by the user of the specific-equipment. When the response information is inputted by the user of the specific-equipment, next question information is generated and displayed based on the inputted response information. In this way, question information is repeatedly generated and displayed and response information is repeatedly inputted at the specific-equipment management system. It is therefore possible for the specific-equipment management system to understand the cause of an error even when the error is a specific-error caused by a human operation.

With the specific-equipment management system of a second aspect of the invention, the diagnostic program that is the program diagnosing a specific-error is started up manually by the user of the specific-equipment. It is therefore possible for the specific-equipment management system to understand the cause of a specific-error when the user of the specific-equipment has become aware of the specific-error.

With the specific-equipment management system of a third aspect of the present invention, when a specific-error is detected, a diagnostic program that is a program for diagnosing the specific-error is automatically started up. It is therefore possible for the specific-equipment management system to understand the cause of a specific-error when the specific-error is detected.

The specific-equipment management system of a fourth aspect of the present invention manages equipment utilizing the water supply. It is therefore possible for the specific-equipment management system to understand the cause of a specific-error occurring at equipment utilizing the water supply.

The specific-equipment management system of a fifth aspect of the present invention manages the hot water heater. It is therefore possible for the specific-equipment management system to understand the cause of a specific-error occurring at the hot water heater.

The specific-equipment management system of a sixth aspect of the present invention generates and displays estimation result information based on the response information. It is therefore possible for the user of the specific-equipment to narrow down the causes of an error at specific-equipment with this specific-equipment management system.

The specific-equipment management system of a seventh aspect of the present invention generates estimation result information when it is determined that generation of the estimation result information is possible, and generates next question information when it is determined that generation of the estimation result information is not possible. In this way, question information is repeatedly generated by this specific-equipment management system until the estimation result information is generated. It is therefore possible to generate estimation result information at the specific-equipment management system.

In the specific-equipment management system of an eighth aspect of the present invention, verification result information is inputted for the estimation result information by the user of the specific-equipment. The specific-equipment management system then determines which of the resolution information or the repair information is to be generated based on the inputted verification result information. At this specific-equipment management system, necessity of repair of the specific-equipment is determined automatically based on the verification result information inputted by the user.

In the specific-equipment management system of a ninth aspect of the present invention, either one of the resolution information or the repair information is inputted by the user of the specific-equipment after determining the necessity of repair to the specific-equipment based on verification result information for the estimation result information. At this specific-equipment management system, necessity of repair is determined based on resolution information or repair information inputted by the user of the specific-equipment.

With the specific-equipment management system of a tenth aspect of the invention, a confirmation program for confirming whether or not installation work or repair has been completed normally is started up manually by the person performing the installation work or repair of the specific-equipment. In this way, at this specific-equipment management system, it is possible for the person performing the installation work or repair on the specific-equipment to confirm whether or not the installation work or repair has been completed normally. It is therefore possible to reduce the likelihood of human error in the installation work or repair.

With the specific-equipment management system of an eleventh aspect of the present invention, when question information is generated on the side (hereinafter referred to as the "user side") where the specific-equipment is installed but it is determined that it is not possible to generate estimation result information on the user side, question information is generated on the side where the remote management apparatus is installed (hereinafter referred to as the "remote side"). Namely, the processing is switched over to online diagnostics when it is determined that it is not possible to generate estimation result information on the user side. Typically, it is possible to store a large amount of information such as past examples that are necessary to generate estimation result information in advance on the remote side. It is therefore possible to provide detailed estimates of the cause of the specific-error by utilizing information such as large quantities of past examples at this specific-equipment management system.

The specific-equipment management system of a twelfth aspect of the present invention generates instructions to start-up a diagnostic program on the remote side. It is therefore possible to make the user aware of the equipment error remotely, with the specific-equipment management system.

With the specific-equipment management system of a thirteenth aspect of the present invention, information for a diagnostic program is stored on the remote side and is sent from the remote side to the user side via the network when the diagnostic program is started up. It is therefore possible to easily update the diagnostic program at the specific-equipment management system.

In the specific-equipment management system of a fourteenth aspect of the present invention, at least one of the estimation result information and the verification result information is sent from the user side to the remote side via the network. As a result, it is possible for the specific-equipment management system to manage at least one of the estimation result information and the verification result information via the network.

In the specific-equipment management system of a fifteenth aspect of the present invention, the repair information from the user side to the remote side is sent via the network. Therefore, only when repair of a specific-error is necessary, the fact that the repair is necessary can be notified to the remote side. It is therefore possible to prevent the service staff from making unnecessary journeys to perform repairs.

The specific-equipment management system of a sixteenth aspect of the present invention generates question information on the remote side. Typically, it is possible to store a large amount of information such as past examples that are necessary to generate question information in advance on the remote side. It is therefore possible to provide detailed estimates of the cause of a specific-error by utilizing information such as large quantities of past examples at this specific-equipment management system.

The specific-equipment management system of a seventeenth aspect of the present invention starts up the diagnostic program on the remote side and generates question information on the remote side. Typically, it is possible to store a large amount of information such as past examples that are necessary to generate question information in advance on the remote side and it is possible to store complex diagnostic programs in advance to a greater extent than on the user side. It is therefore possible to provide detailed estimates of the cause of a specific-error by utilizing information such as large quantities of past examples and a complex diagnostic program at this specific-equipment management system.

In the specific-equipment management system of an eighteenth aspect of the present invention, the next connection information is sent from the remote side to the user side via the network. This means that it is possible to implement pseudo-bi-directional connection between the user side and the remote side even in cases where the user side and the remote side are not always connected.

With the specific-equipment management system of a nineteenth aspect of the present invention, at least one of the time information and the transmission information is sent from the remote side to the user side. It is therefore possible for the user side to send data designated by the remote side to the remote side at the time designated by the remote side.

When the specific-equipment management program of a twentieth aspect of the invention is executed, the user of the specific-equipment is prompted to input response information to the displayed question information in response to the question information being generated and displayed. When response information is inputted by the user of the specific-equipment, next question information is generated and displayed based on the inputted response information. In this way, when this specific-equipment management program is executed, question information is repeatedly generated and displayed, and response information is repeatedly inputted. According to this specific-equipment management program, it is possible to understand the cause of an error even when the error is a specific-error caused by a human operation.

With the specific-equipment management method of a twenty-first aspect of the invention, the user of the specific-equipment is prompted to input response information to the displayed question information in response to the question information being generated and displayed. When response information is inputted by the user of the specific-equipment, next question information is generated and displayed based on the inputted response information. In this way, with this specific-equipment management method, question information is repeatedly generated and displayed, and response information is repeatedly inputted. According to this specific-equipment management method, it is possible to understand the cause of an error even when the error is a specific-error caused by a human operation.

DETAILED DESCRIPTION OF THE INVENTION

First Embodiment

Figure 1:
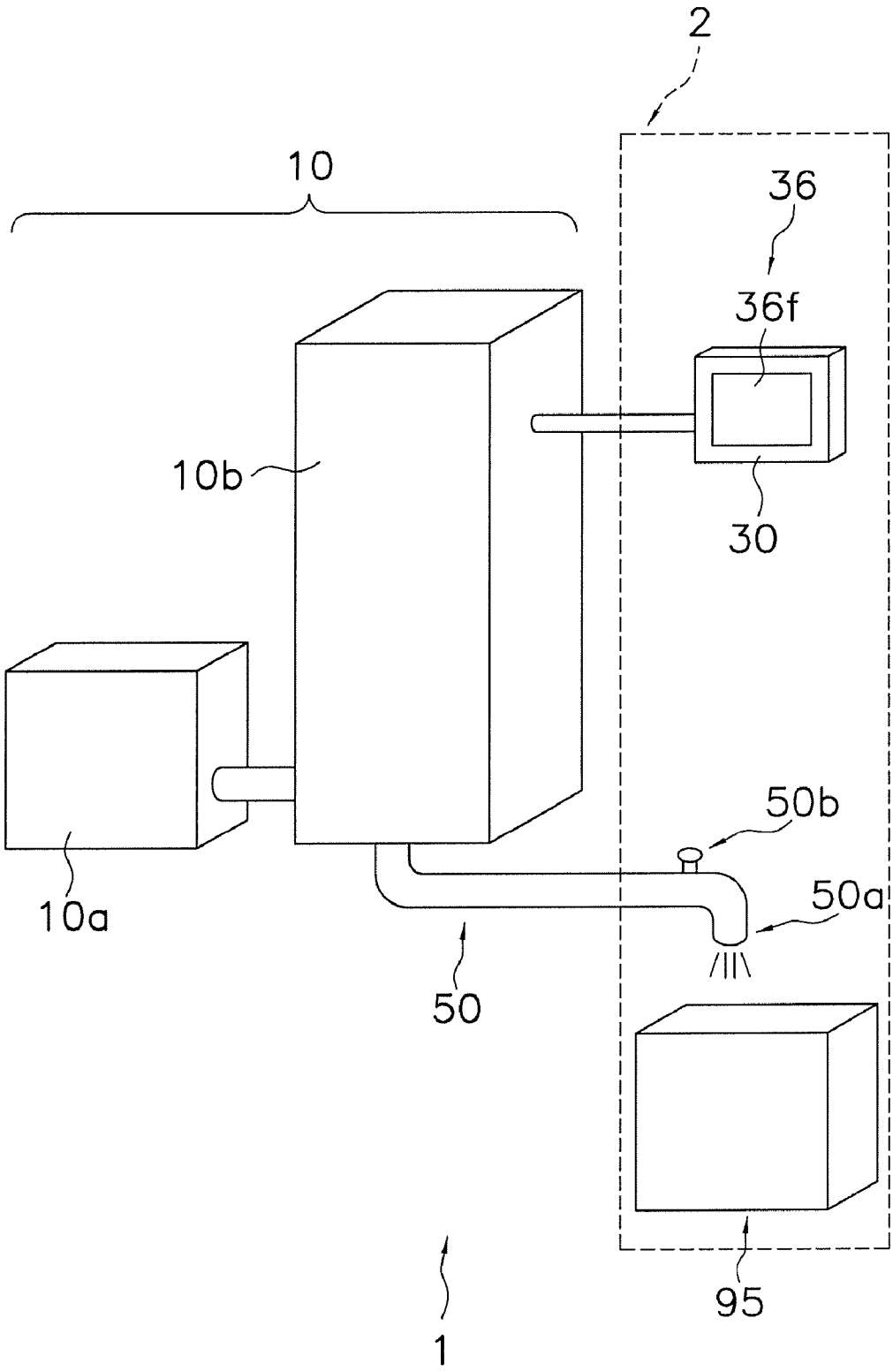
FIG. 1 is a structural view of a specific-equipment management system of a first embodiment of the present invention.
Figure 2:
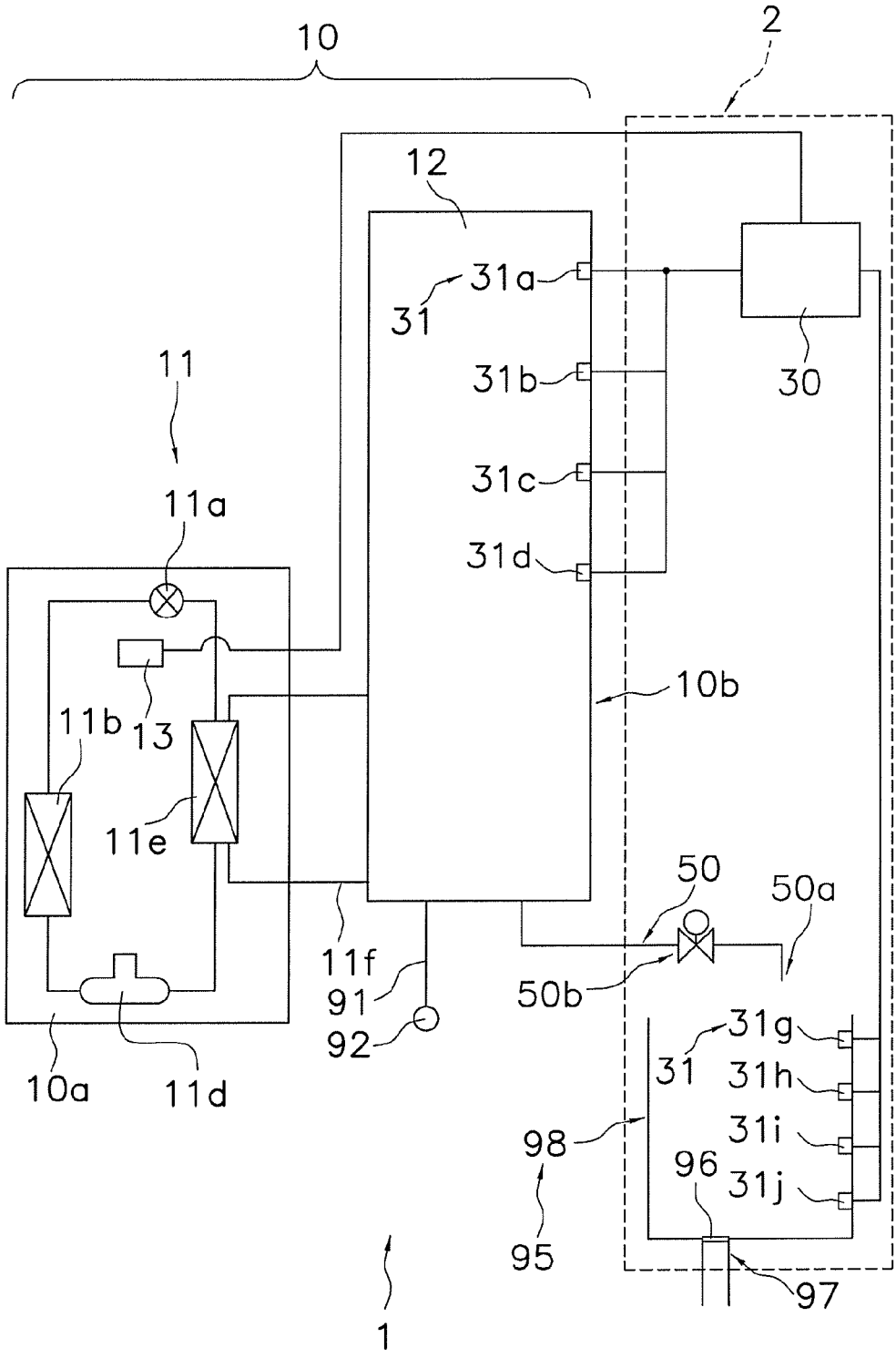
FIG. 2 is a further structural view of the specific-equipment management system of the first embodiment of the present invention.
Figure 3:
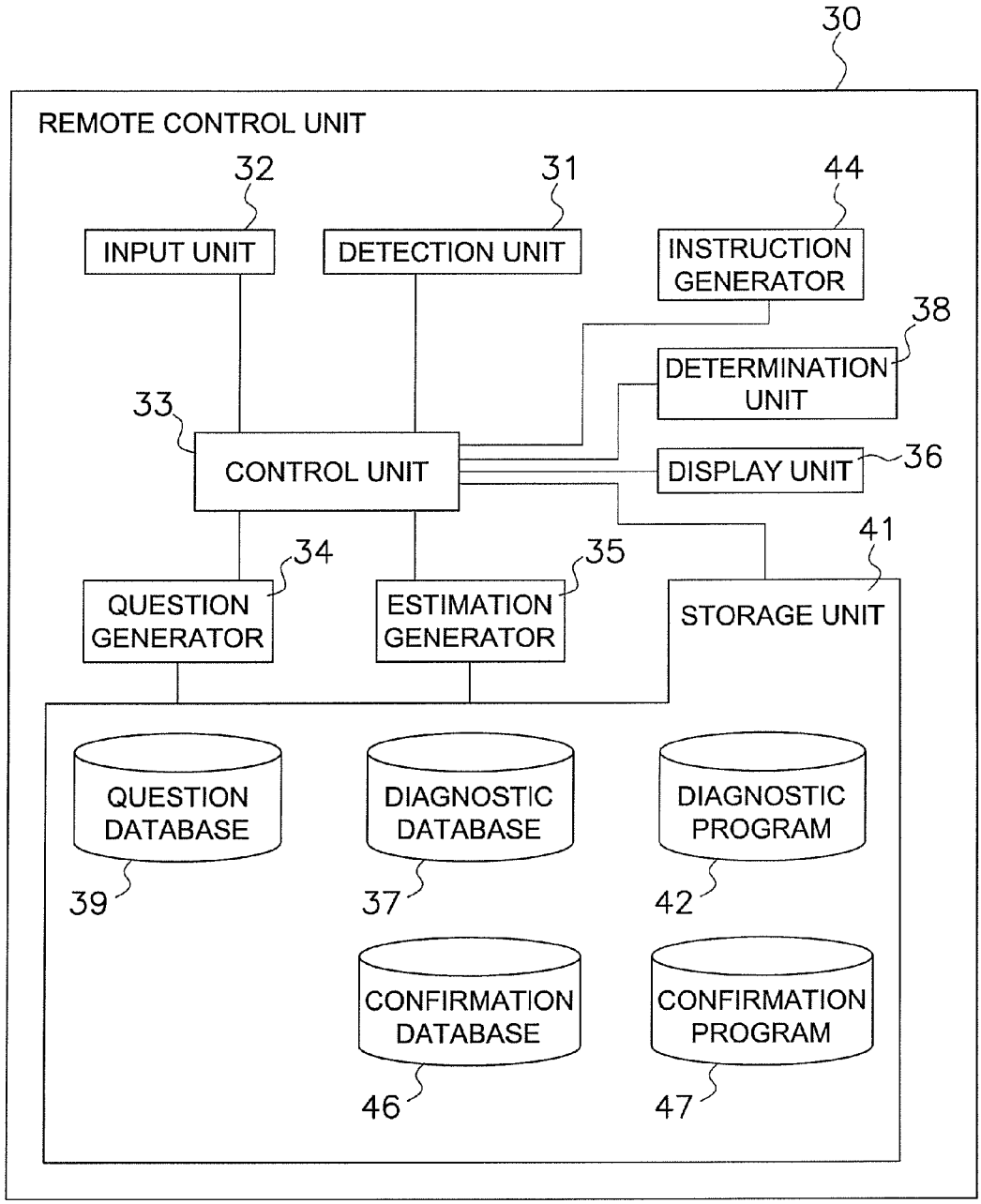
FIG. 3 is a structural view of a remote control unit for the first embodiment of the present invention.

A structural view of a specific-equipment management system 1 of a first embodiment of the present invention is shown in FIG. 1. Structural views of configurational elements of the specific-equipment management system 1 of the first embodiment of the present invention are shown in FIG. 2 and FIG. 3. The specific-equipment management system 1 is a system for managing principally a hot water heater 10. Here, the hot water heater 10 is equipment requiring operation by a person in the vicinity when used.

<Overall Configuration of the Specific-Equipment Management System 1>

The specific-equipment management system 1 shown in FIG. 1 mainly includes the hot water heater 10, piping 50, a remote control unit 30, and a bathtub 95. The hot water heater 10 mainly includes a heat pump unit 10*a* and a hot water unit 10*b*. The heat pump unit 10*a* and the hot water unit 10*b* are installed outside a users building 2. The remote control unit 30 is installed inside the users building 2. The piping 50 extends from outside to within the users building 2.

<Configuration of a Hot Water Heater 10>

The hot water heater 10 shown in FIG. 1 mainly includes a heater 11, a controller 13 and a hot water section 12, as shown in FIG. 2.

Hot water is stored in the hot water section 12. The controller 13 receives instructions from the remote control unit 30. The controller 13 then controls the heater 11 based on instructions received from the remote control unit 30. The heater 11 heats water stored in the hot water section 12 under the control of the controller 13.

A water supply 92 is connected to the hot water section 12 via a water supply pipe 91 so as to supply tap water.

<Configuration of the Heater 11>

The heater 11 shown in FIG. 2 mainly includes an air heat exchanger 11*b*, a water heat exchanger 11*e*, an expansion valve 11*a*, a compressor 11*d*, and water heating piping 11*f*.

A low temperature, low pressure refrigerant pressure-reduced via the expansion valve 11*a* is vaporized by absorbing heat from the air outside the room in the air heat exchanger 11*b*. This then be changed to a high temperature, high pressure refrigerant by the compressor 11*d*. The high temperature, high pressure refrigerant is then condensed in the water heat exchanger 11*e* by providing heat to the hot water in the water heating piping 11*f* from the hot water section 12. The hot water in the hot water section 12 can then be heated.

The air heat exchanger 11*b*, the expansion valve 11*a*, the compressor 11*d* and the water heat exchanger 11*e* are provided at the heat pump unit 10*a*. The water heating piping 11*f* can be provided between the heat pump unit 10*a* and the hot water unit 10*b*.

<Structure of the Piping 50>

The piping 50 shown in FIG. 1 mainly includes a hot water outlet 50*a* and a hot water valve 50*b*, as shown in FIG. 2.

The hot water valve 50*b* is opened by a user of the hot water heater 10 when the hot water heater 10 is used. This makes it possible for hot water stored in the hot water section 12 of the hot water heater 10 to be discharged from the hot water outlet 50*a* via the hot water valve 50*b*. Namely, a human operation of opening the hot water valve 50*b* is required in the vicinity of the hot water heater 10 when hot water supplied from the hot water heater 10 is to be discharged from the hot water outlet 50*a*.

The hot water valve 50*b* is closed by the user of the hot water heater 10 when the hot water heater 10 is not used. This makes it possible for the hot water stored in the hot water section 12 of the hot water heater 10 not to be discharged from the hot water valve 50*b*.

<Structure of the Bathtub 95>

The bathtub 95 shown in FIG. 1 mainly includes a bath wall section 98, a plug 96 and a plughole 97, as shown in FIG. 2.

The hot water supplied from the hot water outlet 50*a* of the piping 50 fills up a space surrounded by the bath wall section 98 when the plughole 97 is covered by the plug 96. This is to say that a human operation of covering up the plughole 97 with the plug 96 is required in the vicinity of the hot water heater 10 when the hot water supplied from the hot water heater 10 fills up a space surrounded by the bath wall section 98.

<Structure of the Remote Control Unit 30>

As shown in FIG. 3, the remote control unit 30 shown in FIG. 1 mainly includes a detection unit 31, an input unit 32, a question generator 34, an estimation generator 35, an instruction generator 44, a display unit 36, a determination unit 38, a storage unit 41, and a control unit 33 that controls the units 31, 32, 34 to 36, 38, 41, and 44. A question database 39, a diagnostic database 37, a diagnostic program 42, a confirmation database 46, and a confirmation program 47 are stored in the storage unit 41. As shown in FIG. 2, the detection unit 31 mainly includes water level sensors 31*a* to 31*d*, and water level sensors 31*g* to 31*j*. The water level sensors 31*a* to 31*d* are provided in a hot water section 12 of the hot water heater 10. The water level sensors 31*g* to 31*j* are provided on the inside of the bath wall section 98 of the bathtub 95.

<Overall Operation of the Specific-Equipment Management System 1>

Each of the units 31 to 36, 38, 41, and 44 of the specific-equipment management system 1 operates mainly as follows.

The detection unit 31 shown in FIG. 3 detects a specific-error. Here, the specific-error is an error relating to the hot water heater 10 and includes a human error. The "human error" is an error relating to a human operation. The control unit 33 determines the occurrence of a specific-error by receiving specific-error information from the detection unit 31. Here, "specific-error information" is error code information. When the control unit 33 determines that there is a specific-error, the instruction generator 44 receives specific-error information from the control unit 33. The instruction generator 44 then generates a start-up instruction for the diagnostic program 42 based on the specific-error information. The control unit 33 then receives start-up instruction information for the diagnostic program 42 from the instruction generator 44. The control unit 33 then refers to the storage unit 41 based on the start-up instruction information for the diagnostic program 42 and starts up the diagnostic program 42.

The control unit 33 then makes the instruction generator 44 generate an instruction for generating a question at based on the diagnostic program 42. The control unit 33 passes the instruction information for generating a question and the specific-error information over to the question generator 34. The question generator 34 receives the instruction information for generating the question and the specific-error information from the control unit 33. The question generator 34 refers to the question database 39 of the storage unit 41 and generates question information based on the instruction information for generating the question and the specific-error information. Here, the question information is information relating to a question for estimating a specific-error cause. The "specific-error cause" refers to the cause of a specific-error. The display unit 36 receives the question information from the question generator 34 via the control unit 33. The display unit 36 displays the question information.

Response information is then inputted to the input unit 32 by the user of the hot water heater 10 based on question information displayed at the display unit 36. The determination unit 38 receives the response information from the input unit 32 via the control unit 33. The determination unit 38 then refers to the diagnostic database 37 of the storage unit 41 via the control unit 33 and determines whether or not it is possible to generate estimation result information based on the response information. Here, the estimation result information is information relating to a result estimated for the specific-error cause.

When the determination unit 38 determines that generation of the estimation result information is not possible, the question generator 34 receives information indicating that the determination unit 38 has determined generation of the estimation result information is not possible and response information from the determination unit 38 via the control unit 33. The question generator 34 then refers to the question database 39 of the storage unit 41 and generates the next question information based on the response information. The display unit 36 then receives the next question information from the question generator 34 via the control unit 33. The display unit 36 then displays the next question information.

Alternatively, when the determination unit 38 determines that it is possible to generate estimation result information, the estimation generator 35 receives information indicating that the determination unit 38 has determined that generation of estimation result information is possible and response information. The estimation generator 35 then refers to the diagnostic database 37 of the storage unit 41 and generates estimation result information based on the response information. The display unit 36 receives estimation result information from the estimation generator 35 via the control unit 33. The display unit 36 displays the estimation result information.

When the estimation result information is displayed on the display unit 36, the user of the hot water heater 10 inputs verification result information to the input unit 32 based on the estimation result information displayed at the display unit 36. Here, the verification result information is information relating to a result verified for the specific-error cause.

Repair information is then inputted to the input unit 32 by the user of the hot water heater 10 based on the verification result information. Here, "repair information" is information indicating that repair of a specific-error is necessary. The control unit 33 receives the repair information from the input unit 32. The control unit 33 refers to the storage unit 41 based on the verification result information and the repair information and acquires information indicating an object which is to be requested for repair and the information to be communicated at the time of the request from the storage unit 41. The display unit 36 receives the information indicating an object which is to be requested for repair and the information to be communicated at the time of the request from the control unit 33. The display unit 36 then displays the information indicating an object which is to be requested for repair and information to be communicated at the time of the request. The user of the hot water heater 10 then makes a request to service staff to repair the hot water heater 10 based on the information displayed at the display unit 36.

Alternatively, resolution information is then inputted to the input unit 32 by the user of the hot water heater 10 based on the verification result information. Here, "resolution information" is information indicating that the specific-error has been resolved. The control unit 33 receives the resolution information from the input unit 32 and stores the resolution information in the storage unit 41.

A start-up instruction of the confirmation program 47 is then inputted to the input unit 32 by the service staff after the hot water heater 10 is repaired by the service staff. The control unit 33 receives start-up instruction information for the confirmation program 47 from the input unit 32. The control unit 33 refers to the storage unit 41 and starts up the confirmation program 47 based on the start-up instruction of the confirmation program 47. The control unit 33 makes the instruction generator 44 generate an instruction for generating a question based on the confirmation program 47. The control unit 33 passes the instruction information for generating a question over to the question generator 34. The question generator 34 receives the instruction information for generating the question from the control unit 33. The question generator 34 refers to the question database 39 of the storage unit 41 and generates question information based on the instruction information for generating the question. The display unit 36 receives the question information from the question generator 34 via the control unit 33. The display unit 36 displays the question information. Response information is then inputted by the service staff to the input unit 32 based on the question information displayed at the display unit 36. The determination unit 38 receives the response information from the input unit 32 via the control unit 33. The determination unit 38 then refers to the confirmation database 46 of the storage unit 41 via the control unit 33 and determines whether or not it is possible to generate estimation result information based on the response information.

When the determination unit 38 determines that generation of the estimation result information is not possible, the question generator 34 receives information indicating that the determination unit 38 has determined generation of the estimation result information is not possible and response information from the determination unit 38 via the control unit 33. The question generator 34 then refers to the question database 39 of the storage unit 41 and generates the next question information based on the response information. The display unit 36 then receives the next question information from the question generator 34 via the control unit 33. The display unit 36 then displays the next question information.

Alternatively, when the determination unit 38 determines that it is possible to generate estimation result information, the estimation generator 35 receives information indicating that the determination unit 38 has determined that generation of estimation result information is possible and response information. The estimation generator 35 refers to the confirmation database 46 of the storage unit 41 and generates estimation result information based on the response information. The display unit 36 receives estimation result information from the estimation generator 35 via the control unit 33. The display unit 36 displays the estimation result information.

<Structure of Question Database 39>

Figure 8:
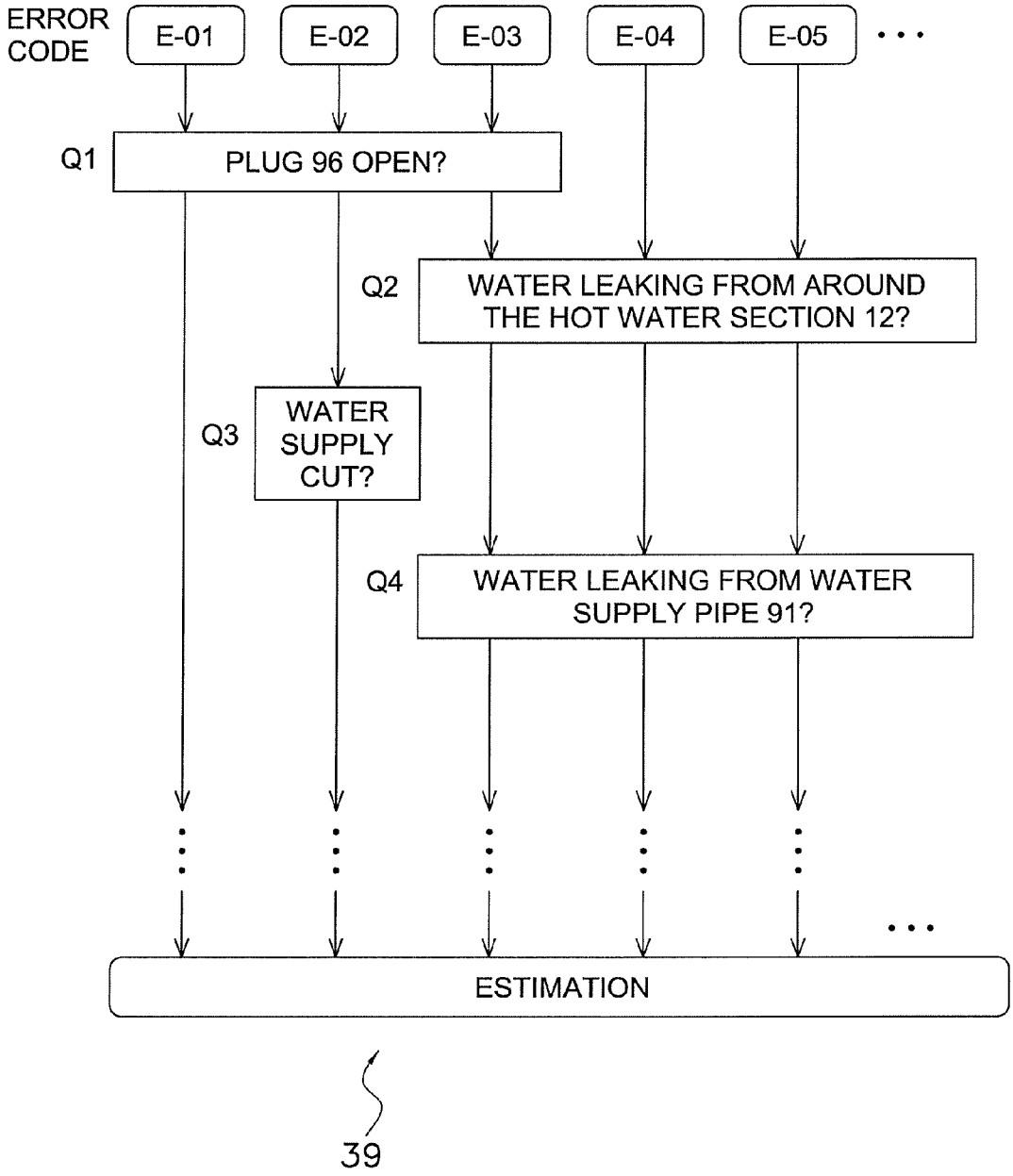
FIG. 8 is a conceptual view showing a structure of a question database.

As shown in FIG. 8, the question database 39 shown in FIG. 3 mainly stores information correlating error code information E-01, E-02, . . . , question information Q1, Q2, . . . and question completion flags (not shown).

For example, when the error code is "E-01", the question information Q1, . . . is generated in order by referring to the question database 39. For example, when the error code is "E-02", the question information Q1, Q3, . . . is generated in order by referring to the question database 39.

Information Q1, Q2, . . . for a question that has been asked once and information for a question that has not been asked yet are distinguished using question completed flags (not shown).

Figure 10:
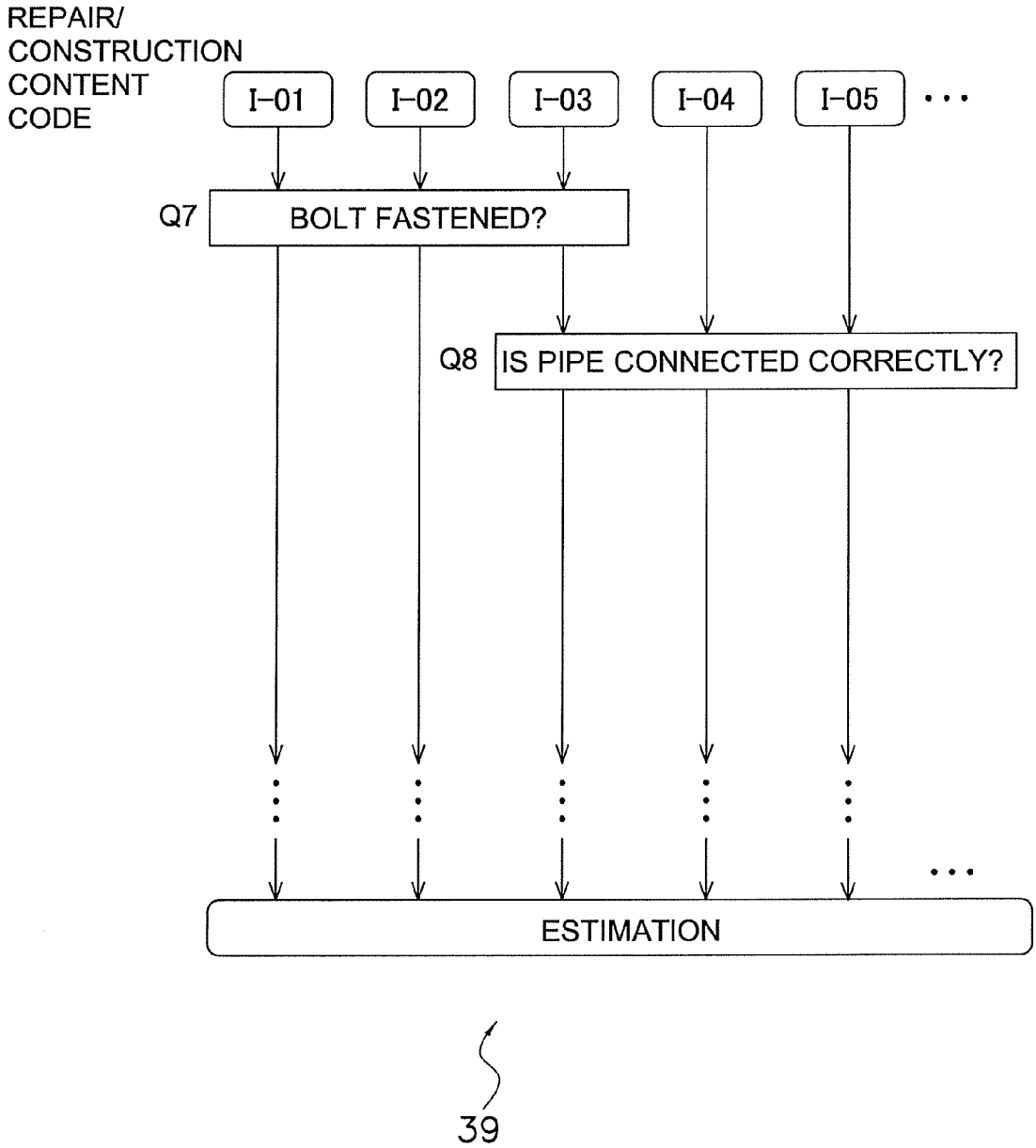
FIG. 10 is a conceptual view showing a further structure of the question database.

Further, the question database 39 shown in FIG. 3 mainly stores information correlating repair and constriction content code information I-01, I-02, . . . , question information Q7, Q8, . . . and question completion flags (not shown), as shown in FIG. 10.

For example, when repair and construction content code is "I-01", the question information Q7, . . . is generated in order by referring to the question database 39. For example, when repair and construction content code is "I-03", the question information Q7, Q8 . . . is generated in order by referring to the question database 39.

Information Q7, Q8, . . . for a question that has been asked once and information for a question that has not been asked yet are distinguished using question completed flags (not shown).

<Structure of Diagnostic Database 37>

Figure 9:
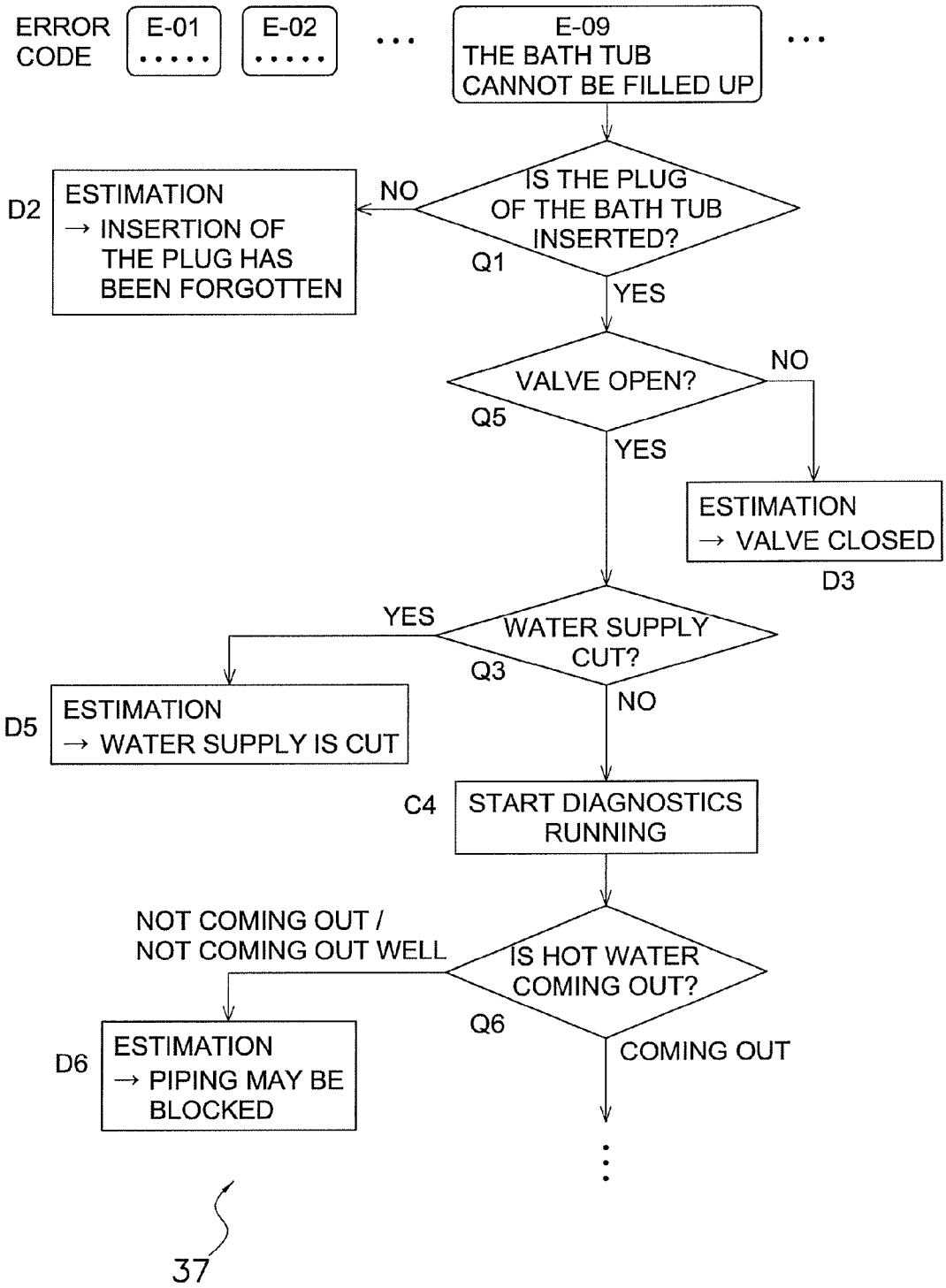
FIG. 9 is a conceptual view showing a structure of a diagnostic database.

As shown in FIG. 9, the diagnostic database 37 shown in FIG. 3 mainly stores information correlating error code information E-01, E-02, . . . , question information Q1, Q5 . . . , estimation result information D2, D3, . . . and instruction information C4, . . . .

For example, when the response information for the question information Q1 is "NO" for an error code of "E-09", it can be understood that it is possible to generate estimation result information by referring to the diagnostic database 37 and estimation result information D2 can be generated. For example, when the response information for the question information Q1 is "YES" for an error code of "E-09", it can be understood that it is not possible to generate estimation result information by referring to the diagnostic database 37. For example, when the response information for the question information Q3 is "NO", it can be understood that it is not possible to generate estimation result information and that this corresponds to instruction information C4 "start running diagnostics".

<Structure of Confirmation Database 46>

Figure 11:
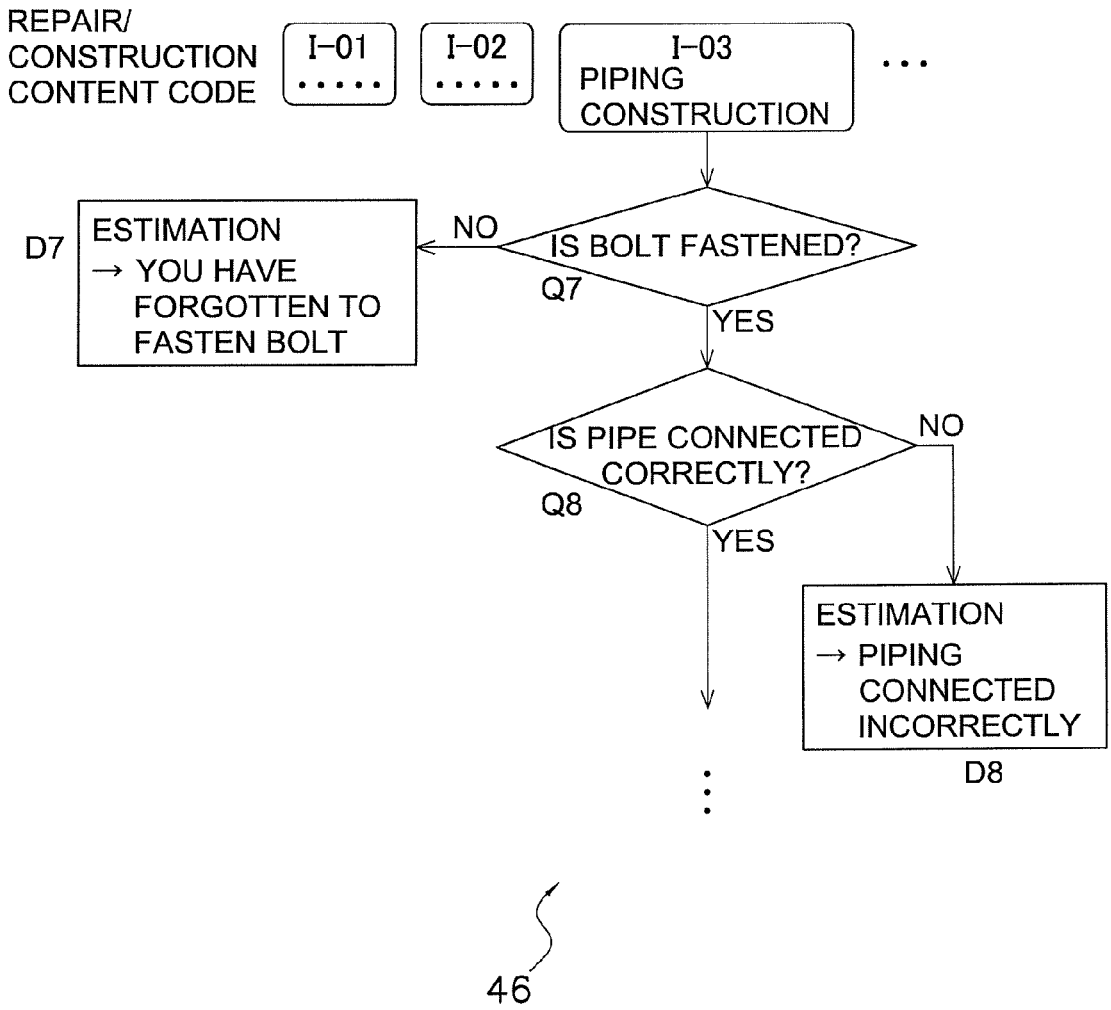
FIG. 11 is a conceptual view showing a structure of a confirmation database.

As shown in FIG. 11, the confirmation database 46 shown in FIG. 3 mainly stores information correlating repair and construction content code information I-01, I-02, . . . , question information Q7, Q8, . . . , and estimation result information D7, D8 . . . .

For example, when the response information for the question information Q7 is "NO" for a repair and construction content code of "I-03", it can be understood that it is possible to generate estimation result information by referring to the confirmation database 46 and estimation result information D7 can be generated. For example, when the response information for the question information Q7 is "YES" for a repair and construction content code of "I-03", it can be understood that it is not possible to generate estimation result information by referring to the confirmation database 46.

<Flow of Process in which the Specific-Equipment Management System 1 Manages the Hot Water Heater 10>

Figure 4:
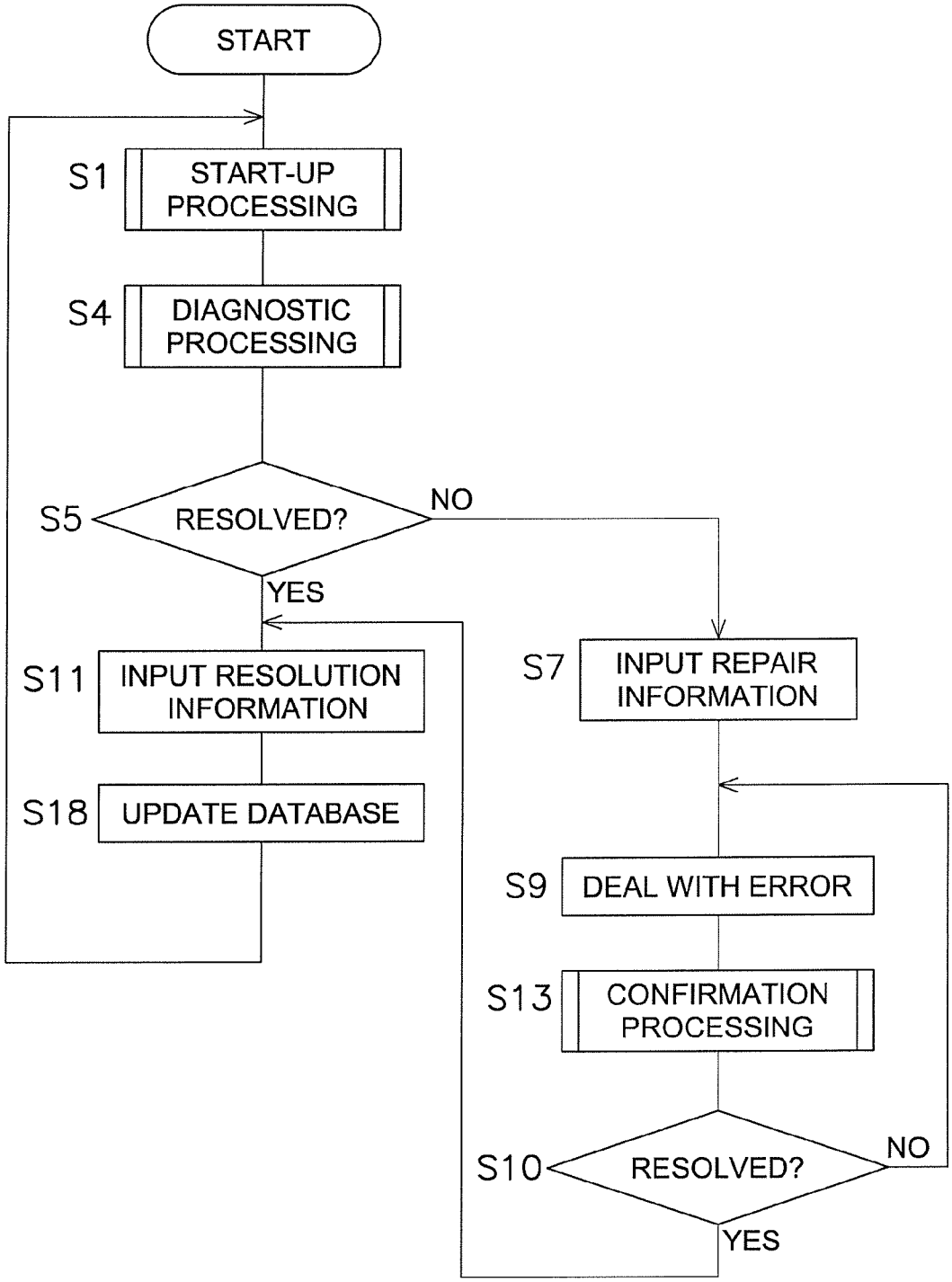
FIG. 4 is a flowchart showing a flow of processing where the specific-equipment management system manages a hot water heater.

The flow of the process in which the specific-equipment management system 1 shown in FIG. 1 manages the hot water heater 10 is described using the flowchart shown in FIG. 4.

Start-up processing is carried out in step S1 shown in FIG. 4.

Diagnostic processing is carried out in step S4 shown in FIG. 4.

It is determined whether or not the specific-error is resolved in step S5 shown in FIG. 4. Namely, the user of the hot water heater 10 (refer to FIG. 1) determines whether or not the specific-error is resolved based on the verification result information. When it is determined that the specific-error is resolved, i.e. when repair is not required for the specific-error, the process goes to step S11. When it is determined that the specific-error is not resolved, i.e. when it is determined that repair of the specific-error is required, the process goes to step S7.

Repair information is then inputted in step S7, as shown in FIG. 4. Namely, repair information is then inputted to the input unit 32 of the remote control unit 30 shown in FIG. 3 by the user of the hot water heater 10 based on the verification result information. The control unit 33 receives the repair information from the input unit 32. The control unit 33 refers to the storage unit 41 based on the verification result information and the repair information and acquires information indicating an object which is to be requested for repair and the information to be communicated at the time of the request from the storage unit 41. The display unit 36 receives the information indicating an object which is to be requested for repair and the information to be communicated at the time of the request from the control unit 33. The display unit 36 then displays the information indicating an object which is to be requested for repair and information to be communicated at the time of the request. The user of the hot water heater 10 then makes a request to service staff to repair the hot water heater 10 based on the information displayed at the display unit 36.

Repair to the specific-error is then dealt with in step S9 shown in FIG. 4. This means that repairs to the hot water heater 10 are performed by the service staff dispatched to the users building 2 (refer to FIG. 1).

Confirmation processing is carried out in step S13 shown in FIG. 4.

It is determined whether or not the specific-error is resolved in step S10 shown in FIG. 4. Namely, it is determined whether or not the specific-error has been resolved by the service staff based on the results of the confirmation processing of step S13. When it is determined that the specific-error is resolved, the process goes to step S11. When it is determined that the specific-error is not resolved, the process goes to step S9.

Resolution information is then inputted in step S11, as shown in FIG. 4. Namely, resolution information is inputted to the input unit 32 of the remote control unit 30 shown in FIG. 3 by the user of the hot water heater 10 or by the service staff based on the verification result information.

The databases 37, 39 and 46 are then updated in step S18 shown in FIG. 4. Namely, the control unit 33 of the remote control unit 30 shown in FIG. 3 accesses the question database 39 and the diagnostic database 37 of the storage unit 41 and updates the question database 39 and the diagnostic database 37 based on the question information, the response information, the estimation result information, the verification result information and the resolution information. Specifically, insufficient question information is added to the error code information E-01, . . . (refer to FIG. 8) or question information determined to be unnecessary is deleted from the error code information E-01, . . . (refer to FIG. 8).

The control unit 33 accesses the question database 39 and the confirmation database 46 of the storage unit 41 and updates the question database 39 and the confirmation database 46 based on the question information, the response information, the estimation result information, the verification result information, the repair information, and the resolution information. Specifically, insufficient question information is added to the repair and construction content code information I-01, . . . (refer to FIG. 10) or question information determined to be unnecessary is deleted from the repair and construction content code information I-01, . . . (refer to FIG. 10).

<Flow of Start-Up Processing>

Figure 5:
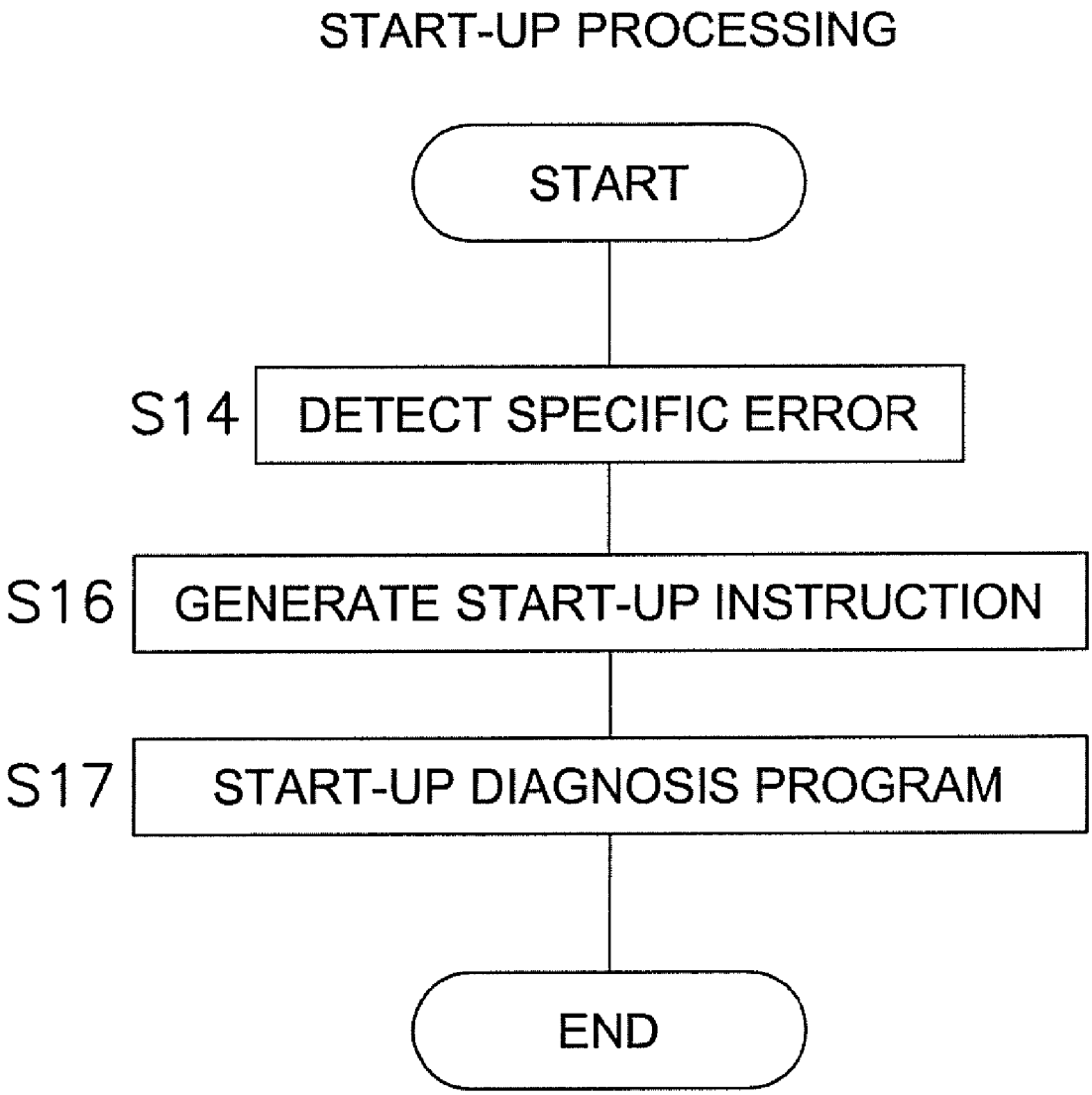
FIG. 5 is a flowchart showing a flow of start-up processing.

The details of the start-up processing S1 shown in FIG. 4 are described using the flowchart shown in FIG. 5.

A specific-error is then detected in step S14 shown in FIG. 5. Namely, the detection unit 31 of the remote control unit 30 shown in FIG. 3 detects a specific-error. For example, the water level sensors 31*a* to 31*d* of the detection unit 31 shown in FIG. 2 detect errors regarding the water level of the hot water section 12 and the water level sensors 31*g* to 31*j* of the detection unit 31 detect errors regarding the water level of the bathtub 95. The control unit 33 then receives specific-error information from the detection unit 31.

A start-up instruction is then generated in step S16 shown in FIG. 5. Namely, the instruction generator 44 of the remote control unit 30 shown in FIG. 3 receives specific-error information from the control unit 33. The instruction generator 44 then generates a start-up instruction for the diagnostic program 42 based on the specific-error information. The control unit 33 then receives start-up instruction information for the diagnostic program 42 from the instruction generator 44.

The diagnostic program is then started up in step S17 shown in FIG. 5. Namely, the control unit 33 of the remote control unit 30 shown in FIG. 3 refers to the storage unit 41 and starts up the diagnostic program 42. The control unit 33 then makes the instruction generator 44 generate an instruction for generating a question based on the diagnostic program 42. The control unit 33 passes the instruction information for generating a question and the specific-error information over to the question generator 34.

<Flow of Diagnostic Processing>

Figure 6:
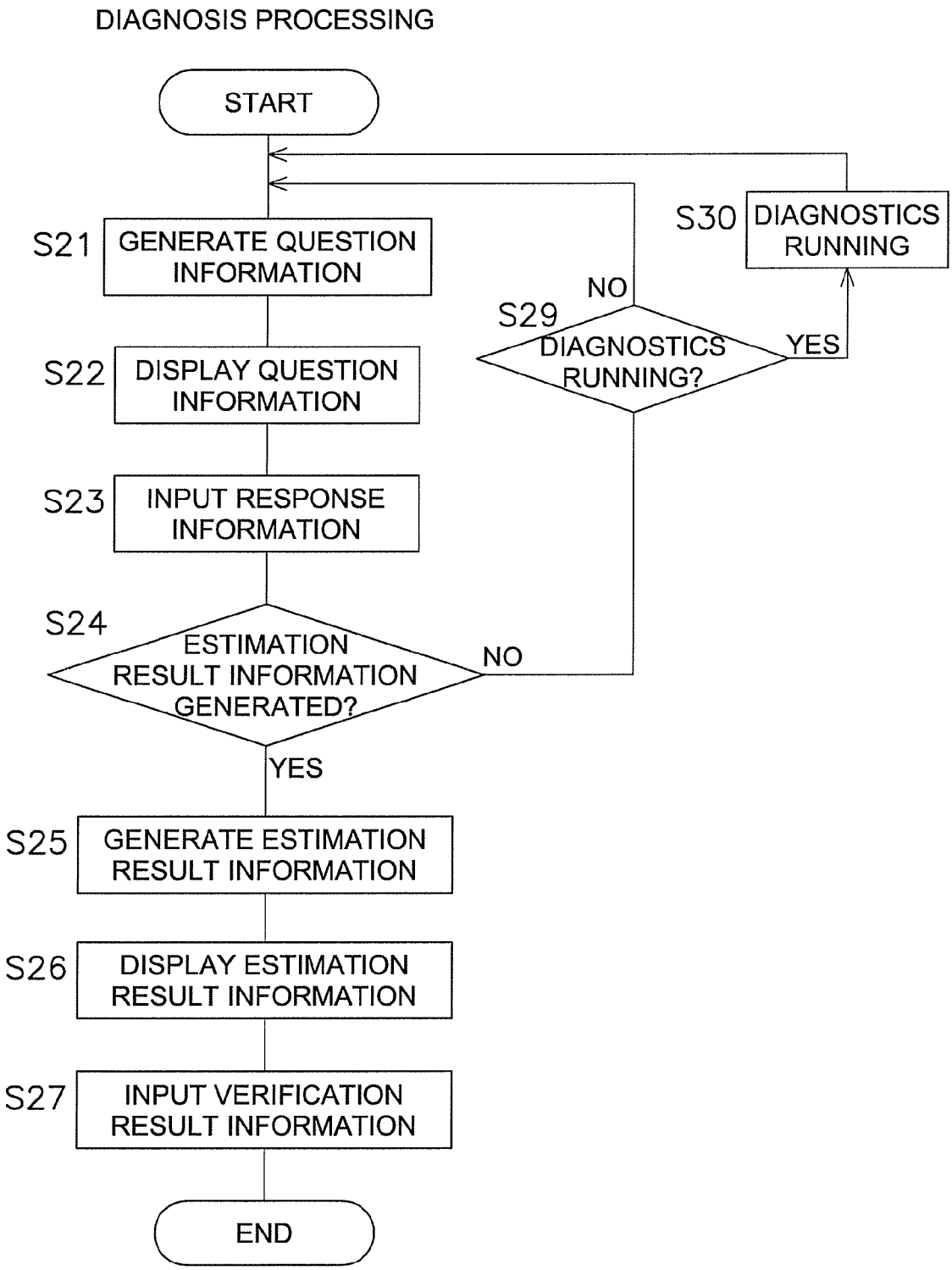
FIG. 6 is a flowchart showing a flow of diagnostic processing.

The details of the diagnostic processing S4 shown in FIG. 4 are described using the flowchart shown in FIG. 6.

Question information is generated in step S21 shown in FIG. 6. The question generator 34 of the remote control unit 30 shown in FIG. 3 receives instruction information for generating a question or response information and specific-error information from the control unit 33. The question generator 34 refers to the question database 39 of the storage unit 41 and generates question information based on the instruction information for generating a question or the response information and the specific-error information. The question generator 34 then passes the question information over to the control unit 33.

Figure 12:
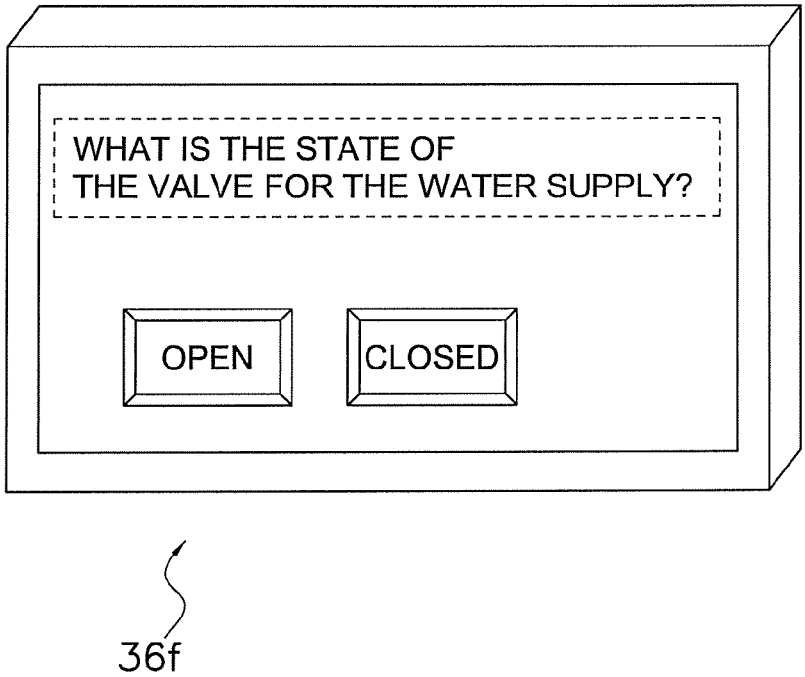
FIG. 12 is a conceptual view showing an example of a display screen.

The question information is then displayed in step S22 shown in FIG. 6. Namely, the display unit 36 of the remote control unit 30 shown in FIG. 3 receives question information from the control unit 33. The display unit 36 displays the question information. For example, as shown in FIG. 12, the question information Q5 is displayed on a display screen 36*f* (refer to FIG. 1).

Response information is then inputted in step S23, as shown in FIG. 6. Namely, response information is inputted to the input unit 32 of the remote control unit 30 shown in FIG.

3 by the user of the hot water heater 10 based on the question information displayed at the display unit 36. The input unit 32 then passes the response information over to the control unit 33.

It is then determined whether or not it is possible to generate estimation result information in step S24 shown in FIG. 6. Namely, the determination unit 38 of the remote control unit 30 shown in FIG. 3 receives response information from the input unit 32 via the control unit 33. The determination unit 38 then refers to the diagnostic database 37 of the storage unit 41 via the control unit 33 and determines whether or not it is possible to generate estimation result information based on the response information. When it is determined that it is possible to generate estimation result information, the process goes to step S25. When it is determined that it is not possible to generate estimation result information, the process goes to step S29.

It is then determined whether or not diagnostics are to be run in step S29 shown in FIG. 6. The determination unit 38 of the remote control unit 30 shown in FIG. 3 then refers to the diagnostic database 37 of the storage unit 41 via the control unit 33 and determines whether or not this corresponds to instruction information C4 "start running diagnostics" based on the response information. When this is determined to correspond to instruction information C4 "start running diagnostics", it is determined that running of diagnostics is to be carried out and the process goes to step S30. When this is determined not to correspond to the instruction information C4 "start running diagnostics", it is determined that it is not intended to start running diagnostics, and the process goes to step S21.

Diagnostics are then run in step S30 shown in FIG. 6. The control unit 33 shown in FIG. 3 then receives information indicating that diagnostics are to be run from the determination unit 38. The control unit 33 then runs a running mode for determining the cause of a specific-error at the hot water heater 10. In this state, the detection unit 31 detects a specific-error. The control unit 33 then receives specific-error information from the detection unit 31 and makes the instruction generator 44 generates an instruction for generating a question. The control unit 33 passes the instruction information for generating a question and the specific-error information over to the question generator 34.

Estimation result information is then generated in step S25 shown in FIG. 6. The estimation generator 35 of the remote control unit 30 shown in FIG. 3 then receives information indicating that it is determined that generation of estimation result information is possible and response information. The estimation generator 35 then refers to the diagnostic database 37 of the storage unit 41 and generates estimation result information based on the response information. The estimation generator 35 then passes the estimation result information over to the control unit 33.

Estimation result information is then displayed in step S26 shown in FIG. 6. Namely, the display unit 36 of the remote control unit 30 shown in FIG. 3 receives the estimation result information from the control unit 33. The display unit 36 then displays the estimation result information.

Verification result information is then inputted in step S27 shown in FIG. 6. The specific-error cause is then verified by the user of the hot water heater 10 based on the estimation result information displayed at the display unit 36. For example, when estimation result information D2 "insertion of the bath plug has been forgotten" is displayed at the display unit 36 (refer to FIG. 9), the user of the hot water heater 10 can then confirm whether or not the plug 96 of the bathtub 95 completely covers the plughole 97. The user of the hot water heater 10 then inputs the verification result information to the input unit 32 based on the verified specific-error cause.

<Flow of Confirmation Processing>

Figure 7:
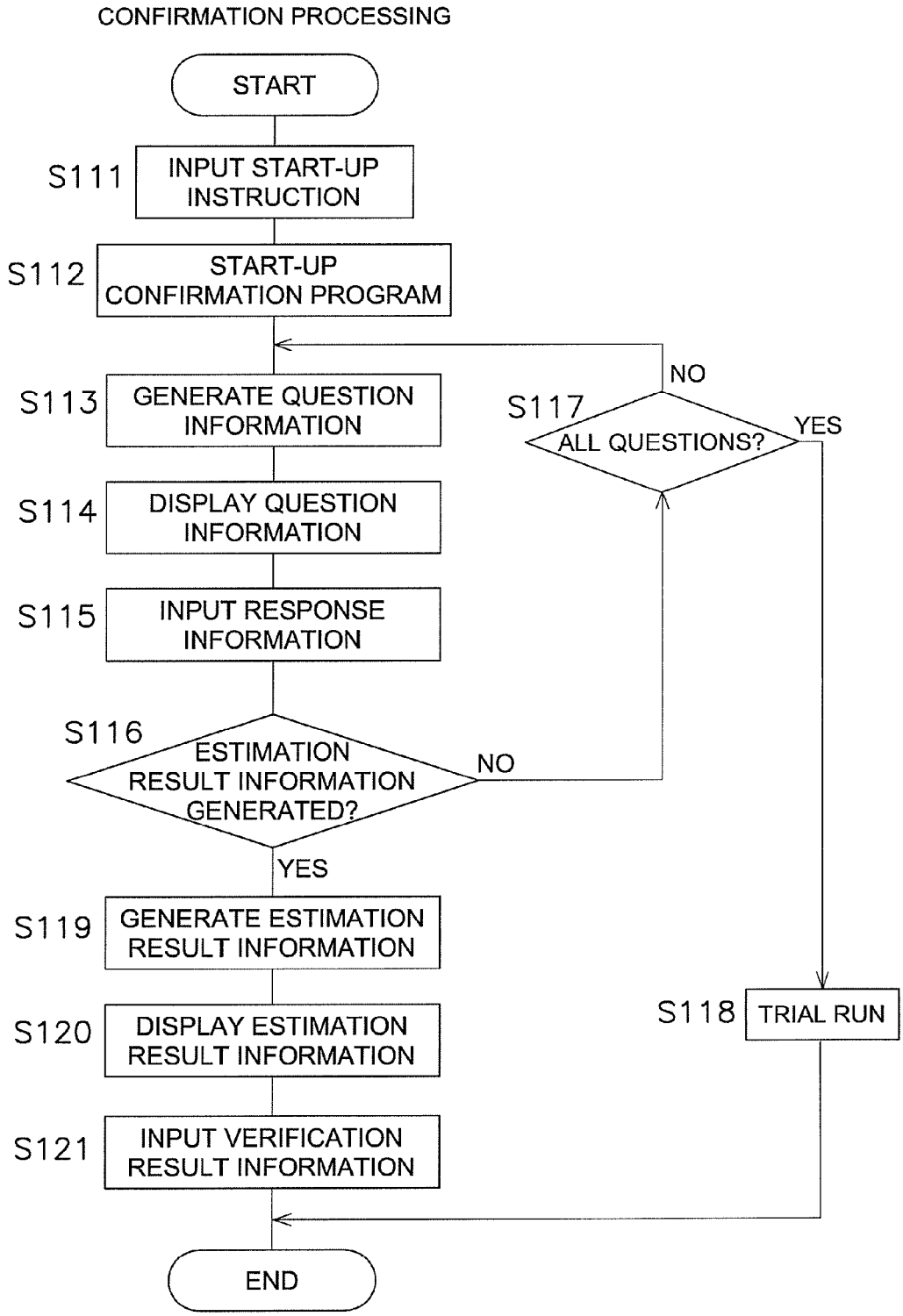
FIG. 7 is a flowchart showing a flow of confirmation processing.

The details of the confirmation processing S13 shown in FIG. 4 are described using the flowchart shown in FIG. 7.

A start-up instruction is inputted in step S111 shown in FIG. 7. Namely, an instruction to start up the confirmation program 47 can then be inputted to the input unit 32 of the remote control unit 30 shown in FIG. 3 by the service staff.

The confirmation program is then started up in step S112 shown in FIG. 7. The control unit 33 of the remote control unit 30 shown in FIG. 3 then receives the start-up instruction information of the confirmation program 47 from the input unit 32, refers to the storage unit 41, and starts up the confirmation program 47. The control unit 33 makes the instruction generator 44 generate an instruction for generating a question based on the confirmation program 47.

Question information is generated in step S113 shown in FIG. 7. The question generator 34 of the remote control unit 30 shown in FIG. 3 receives instruction information for generating a question or response information from the control unit 33. The question generator 34 refers to the question database 39 of the storage unit 41 and generates question information based on the instruction information for generating a question or the response information and the specific-error information. The question generator 34 then passes the question information over to the control unit 33.

The question information is then displayed in step S114 shown in FIG. 7. Namely, the display unit 36 of the remote control unit 30 shown in FIG. 3 receives question information from the control unit 33. The display unit 36 displays the question information. For example, as shown in FIG. 12, the question information Q5 is displayed on the display screen 36*f* (refer to FIG. 1).

Response information is then inputted in step S115, as shown in FIG. 7. Namely, response information is inputted to the input unit 32 of the remote control unit 30 shown in FIG. 3 by the service staff based on the question information displayed at the display unit 36. The input unit 32 then passes the response information over to the control unit 33.

It is then determined whether or not it is possible to generate estimation result information in step S116 shown in FIG. 7. Namely, the determination unit 38 of the remote control unit 30 shown in FIG. 3 receives response information from the input unit 32 via the control unit 33. The determination unit 38 then refers to the confirmation database 46 of the storage unit 41 via the control unit 33 and determines whether or not it is possible to generate estimation result information based on the response information. When it is determined that it is possible to generate estimation result information, the process goes to step S119. When it is determined that it is not possible to generate estimation result information, the process goes to step S117.

In step S117 shown in FIG. 7, it is determined whether or not all of the question information corresponding to the repair and construction content code have been displayed. The determination unit 38 of the remote control unit 30 shown in FIG. 3 refers to the question database 39 of the storage unit 41 via the control unit 33, and determines whether or not all of the question information corresponding to the repair and construction content code have been displayed based on the question complete flags. When it is determined that all of the question information have been displayed, the process goes to step S118. When it is determined that all of the question information have not been displayed yet, the process goes to step S113.

A trial run is then carried out in step S118 shown in FIG. 7. The control unit 33 of the remote control unit 30 shown in FIG. 3 receives information indicating that all of the question information have been displayed from the determination unit 38, and passes information indicating that a trial run is to be carried out over to the display unit 36. The display unit 36 displays the information indicating that a trial run is to be carried out at the display screen 36*f* (refer to FIG. 1). A trial run instruction is then inputted to the input unit 32 by the service staff based on the fact that the information indicating that a trial run is to be carried out is displayed at the display unit 36. The control unit 33 then receives the trial run instruction information from the input unit 32 and performs a trial run at the hot water heater 10.

Estimation result information is then generated in step S119 shown in FIG. 7. The estimation generator 35 of the remote control unit 30 shown in FIG. 3 then receives information indicating that it is determined that generation of estimation result information is possible and response information. The estimation generator 35 then refers to the confirmation database 46 of the storage unit 41 and generates estimation result information based on the response information. The estimation generator 35 then passes the estimation result information over to the control unit 33.

Estimation result information is then displayed in step S120 shown in FIG. 7. Namely, the display unit 36 of the remote control unit 30 shown in FIG. 3 receives the estimation result information from the control unit 33. The display unit 36 then displays the estimation result information.

Verification result information is inputted in step S121 shown in FIG. 7. The specific-error cause is verified by the service staff based on the estimation result information displayed at the display unit 36. For example, when the estimation result information displayed at the display unit 36 is estimation result information D7 "you have forgotten to fasten a bolt" (refer to FIG. 11), the service staff confirms whether or not a bolt has been fastened. The service staff then inputs the verification result information to the input unit 32 based on the verified specific-error cause.

<Features of the Specific-Equipment Management System 1>

(1)

Here, the question generator 34 shown in FIG. 3 generates question information. The display unit 36 displays question information. Response information is then inputted to the input unit 32 by the user based on question information displayed at the display unit 36. When it is determined that generation of estimation result information is not possible, the question generator 34 generates the next question information based on the response information. The display unit 36 then displays the next question information.

The specific-equipment management system 1 repeatedly generates and displays question information and repeatedly prompts the user to input response information until it is determined that generation of estimation result information is possible. It is therefore possible to understand the specific-error cause.

(2)

An instruction to start up the confirmation program 47 is then inputted to the input unit 32 by the service staff after the hot water heater 10 is repaired by the service staff.

The service staff can then confirm whether repairs have been completed normally.

(3)

The detection unit 31 shown in FIG. 3 then detects a specific-error. The instruction generator 44 then generates a start-up instruction for the diagnostic program 42 based on the specific-error information. The control unit 33 then starts up the diagnostic program 42 based on the start-up instruction information of the diagnostic program 42.

When a specific-error occurs, the diagnostic program 42 is automatically started up.

(4)

Here, the specific-equipment management system 1 manages the hot water heater 10. The hot water heater 10 is equipment utilizing a water supply and requires the intervention of a human near itself when used.

There are therefore also cases where, at the specific-equipment management system 1, a specific-error is detected that is caused by the operation of a person in the vicinity when used of the hot water heater 10. Even in this kind of case it is possible for the specific-equipment management system 1 to generate and display question information for estimating the cause of a specific-error due to human error such as "is the plug of the bathtub inserted?" (FIG. 9) to prompt the user to input response information. It is therefore possible to understand the cause of specific-errors even when a specific-error caused by human error occurs.

(5)

Here, the estimation generator 35 generates estimation result information. The display unit 36 then displays the estimation result information.

The user can therefore be aware of the estimation result information.

Figure 13:
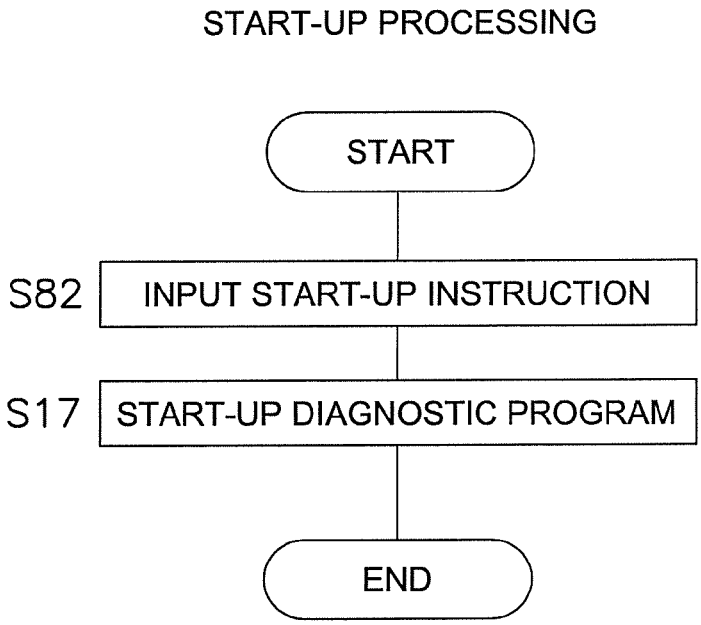
FIG. 13 is a flowchart showing a flow of start-up processing (modified example)

Modified Example of the First Embodiment (A) The start-up processing S1 shown in FIG. 4 can also be as shown in FIG. 13. The details of FIG. 13 are described in the following. In FIG. 13, steps that are the same as for the start-up processing S1 shown in FIG. 5 are given the same numerals and are not described.

A start-up instruction is then inputted in step S82 shown in FIG. 13. Namely, an instruction to activate the diagnostic program 42 is inputted to the input unit 32 of the remote control unit 30 shown in FIG. 3 by the user of the hot water heater 10. The control unit 33 then receives start-up instruction information for the diagnostic program 42 from the input unit 32.

An instruction to start up the diagnostic program 42 is therefore inputted by the user of the hot water heater 10. It is therefore possible to start up the diagnostic program 42 based on the will of the user.

In this case, it is also possible for the user of the hot water heater 10 to input information for an error code to the input unit 32 together with the instruction to start up the diagnostic program 42. When error code information is not inputted to the input unit 32, predetermined error codes can also be selected by the control unit 33 while referring to the question database 39 and the diagnostic database 37.

It is also possible for the question database 39 and the diagnostic database 37 shown in FIG. 3 not to be correlated to the error codes. In this case, the question information first selected at each of the question database 39 and the diagnostic database 37 is always the same question information. It is also possible for the question database 39 and the confirmation database 46 shown in FIG. 3 not to be correlated to the repair and construction content codes. In this case, the question information first selected at each of the question database 39 and the confirmation database 46 is always the same question information.

Further, it is also possible for only the question database 39 and/or the diagnostic database 37 to be updated in step S18 shown in FIG. 4. In this case, it is possible for the processing carried out in step S18 to be simplified.

Figure 14:
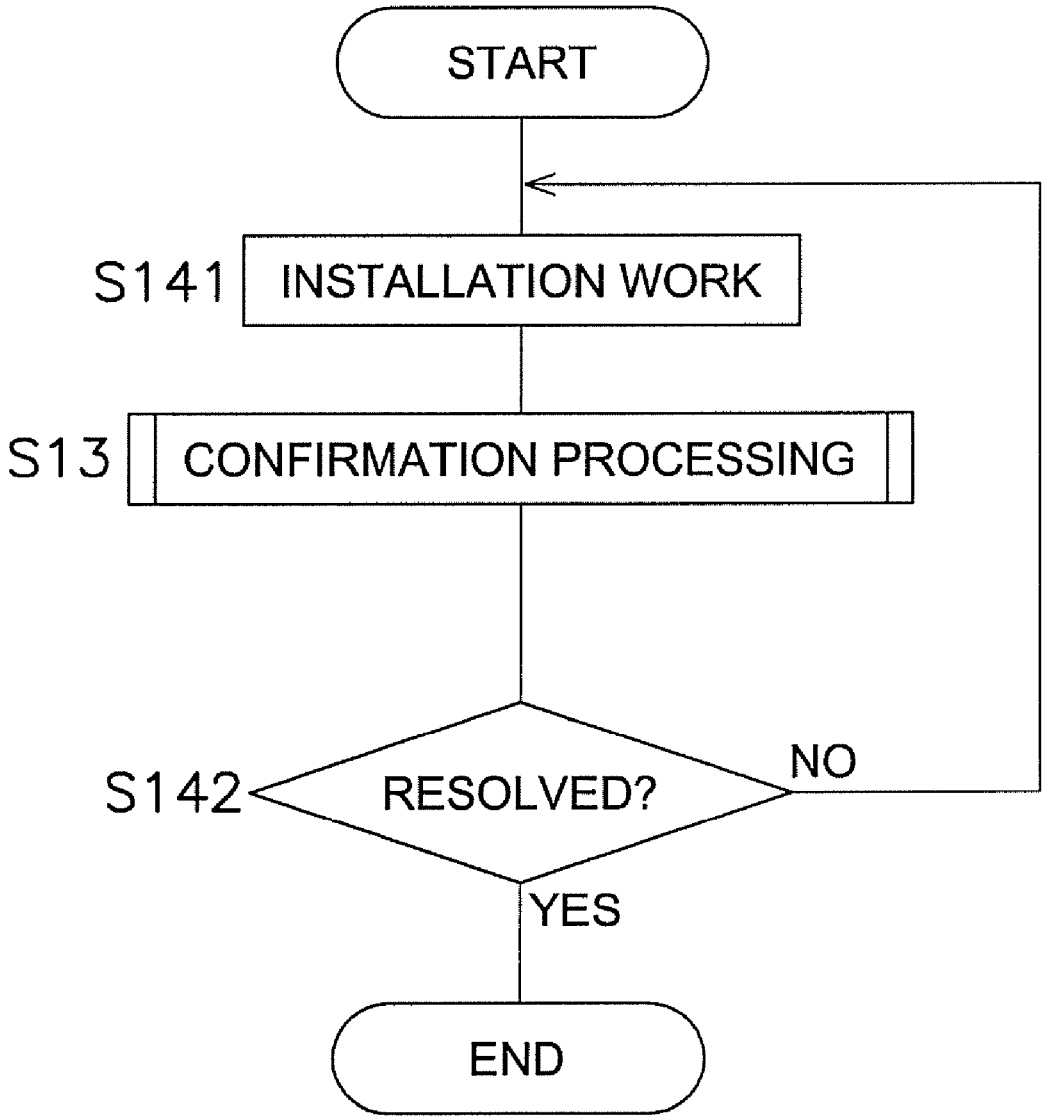
FIG. 14 is a flowchart showing a flow of processing during installation work for the hot water heater (modified example)

(B) It is also possible to perform work for installing the hot water heater 10 shown in FIG. 1 in the order shown in FIG. 14. In FIG. 14, steps that are the same as for FIG. 4 are given the same numerals as in FIG. 4 and are not described.

Installation work is then carried out in step S141 shown in FIG. 14. Namely, the hot water heater 10 is installed in the users building 2 by the service staff as shown in FIG. 1. For example, the heat pump unit 10*a* and the hot water unit 10*b* are installed outside the users building 2 and the remote control unit 30 is installed inside the users building 2. The piping 50 is then run from outside the users building 2 to inside the users building 2.

It is then determined whether or not the installation work is completed normally in step S142 shown in FIG. 14. Namely, it is determined whether or not the installation work has been finished normally by the service staff based on the results of the confirmation processing of step S13. When it is determined that the installation work is completed normally, the processing is completed. When it is determined that the installation work is not completed normally, the process goes to step S141.

The confirmation processing S13 (refer to FIG. 14) is carried out after the installation work. It is therefore possible to ensure that the quality of the installation work is uniform. Further, it is possible to discover errors in installation work immediately after completion of the installation work. This means that the likelihood of having to unnecessarily dispatch service staff can be reduced.

(C) In step S5 shown in FIG. 4, instead of the user of the hot water heater 10, the determination unit 38 shown in FIG. 3 may determine whether or not the specific-error has been resolved. Namely, the determination unit 38 of the remote control unit 30 shown in FIG. 3 receives the verification result information from the control unit 33. The determination unit 38 then determines whether or not the specific-error has been resolved based on the verification result information. When it is determined that the specific-error is resolved, it is determined that repair is not required for the specific-error and the process goes to step S11. When it is determined that the specific-error is not resolved, it is determined that repair of the specific-error is required, and the process goes to step S7.

At this time, in step S7, it is also possible for the repair information to be automatically generated by the control unit 33 rather than being manually inputted to the input unit 32 by the user of the hot water heater 10. For example, a database storing information denoting a combination of the repair information, error code information, estimation result information, and verification result information is stored in the storage unit 41. Repair information is then automatically selected by the control unit 33 based on this database.

Similarly, in step S11, it is also possible for the resolution information to be automatically generated by the control unit 33 rather than being manually inputted to the input unit 32 by the user of the hot water heater 10 or by service staff. For example, a database storing information denoting a combination of the resolution information, error code information, estimation result information, and verification result information is stored in the storage unit 41. Resolution information is then automatically selected by the control unit 33 based on this database.

In other words, the processing of steps S5, S7, and S11 is automated and alleviates the load on the user of the hot water heater 10.

(D) The hot water heater 10 can also adopt a gas method, or heating wire method etc. instead of the heat pump method shown in FIG. 2. The hot water heater 10 can be any kind of equipment such as water supply equipment or sprinkler equipment that requires operation by a person in the vicinity when used.

(E) The question database 39 shown in FIG. 3 can be separated to a database used for the diagnostic program 42 and another database used for the confirmation program 47.

(F) It is also possible to store an operation history for the remote control unit 30 in the storage unit 41 of the remote control unit 30 shown in FIG. 3. For example, information for the running modes of the hot water heater 10 inputted to the input unit 32 of the remote control unit 30 and information for the time when this inputting was carried out can be stored in a correlated manner.

(G) The input unit 32 of the remote control unit 30 may be a keyboard or touch panel, or may be a speech recognition type input device. The remote control unit 30 may be provided with a sound output device (not shown) rather than the display unit 36, so that the question information is outputted as a speech sound. In this case, it is possible for people such as the elderly that are not good at operating input devices or that are inexperienced to easily input response information and to understand the question information.

(H) In step S7 shown in FIG. 5, it is also possible to display information other than information indicating an object which is to be requested for repair or information to be communicated at the time of a request at the display unit 36. For example, it is possible to display that an error running mode or a life-extending running mode is to be executed until the service staff arrives, or to display a method to be adopted in emergencies for safety purposes.

(I) The question database 39, the diagnostic database 37, the diagnostic program 42, the confirmation database 46, and the confirmation program 47 shown in FIG. 3 can also be customized so as to match the characteristics of the area (temperature, weather, etc.) and/or individual circumstances (usage conditions, years of use, equipment type, etc.). It is therefore possible to estimate causes of specific-errors while taking into consideration characteristics of regions and individual circumstances. As the result, the causes of specific-errors can be estimated in more detail.

Second Embodiment

Figure 15:
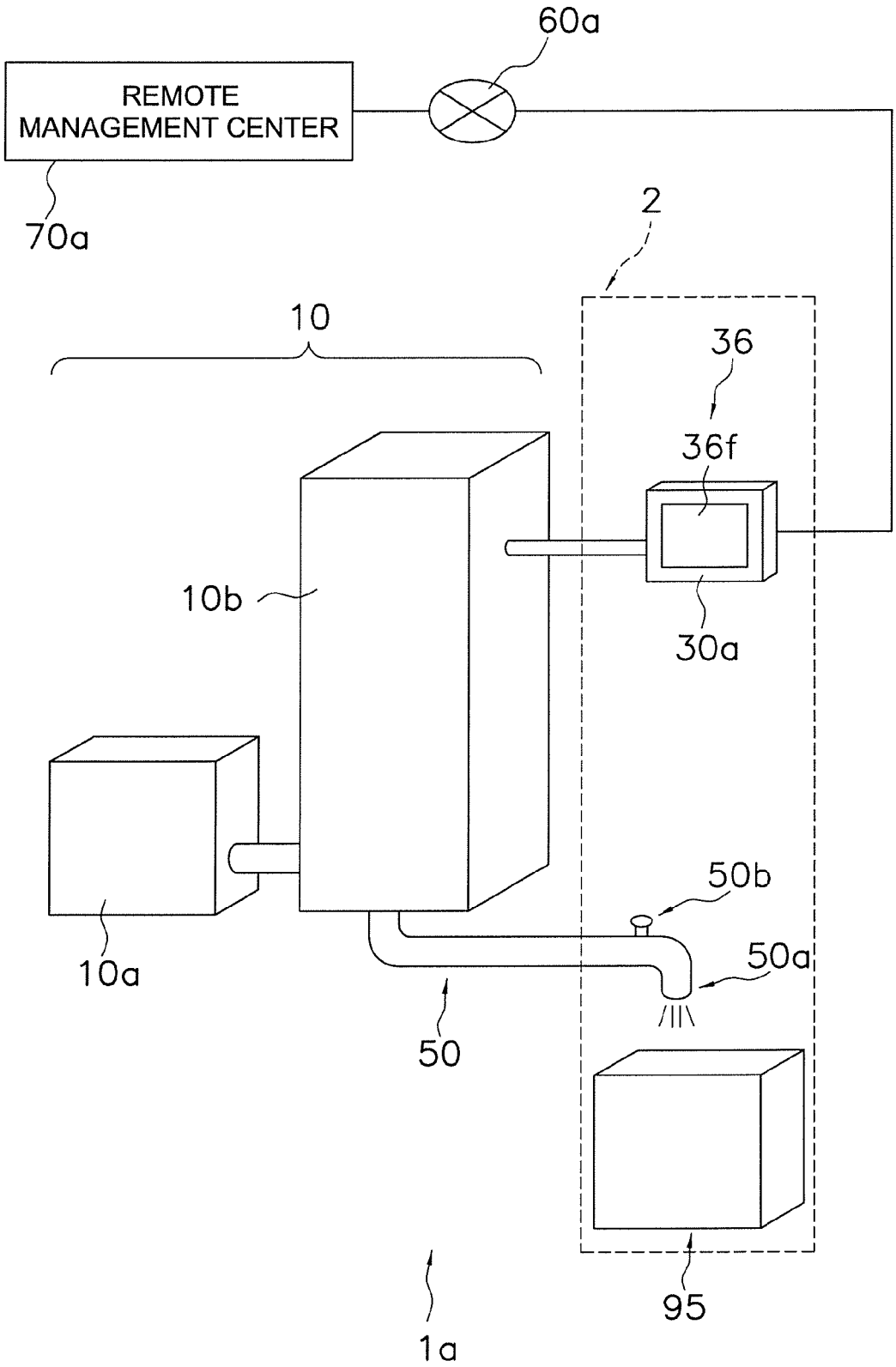
FIG. 15 is a structural view of a specific-equipment management system of a second embodiment of the present invention.
Figure 16:
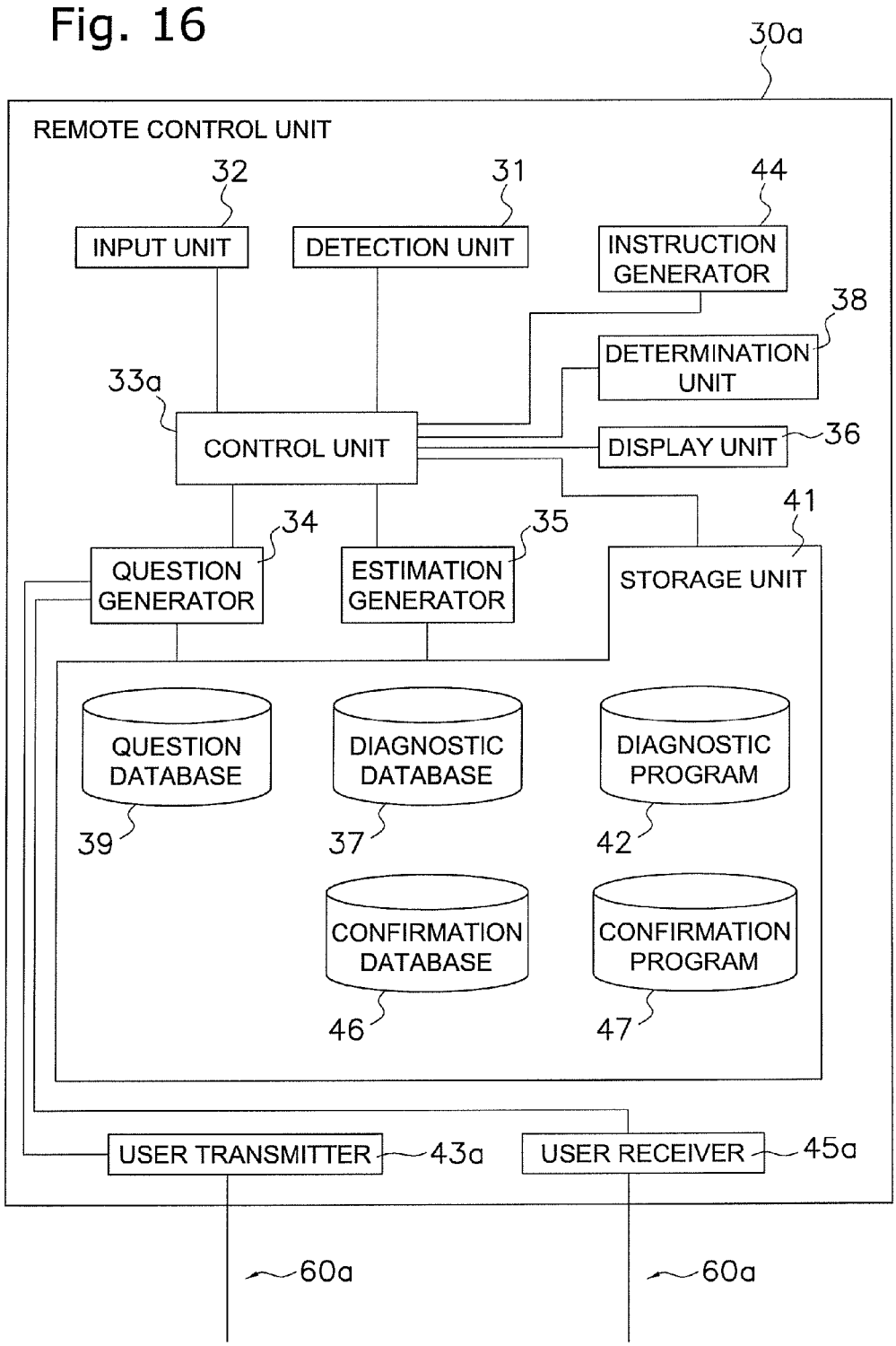
FIG. 16 is a structural view of a remote control unit for the second embodiment of the present invention.
Figure 17:
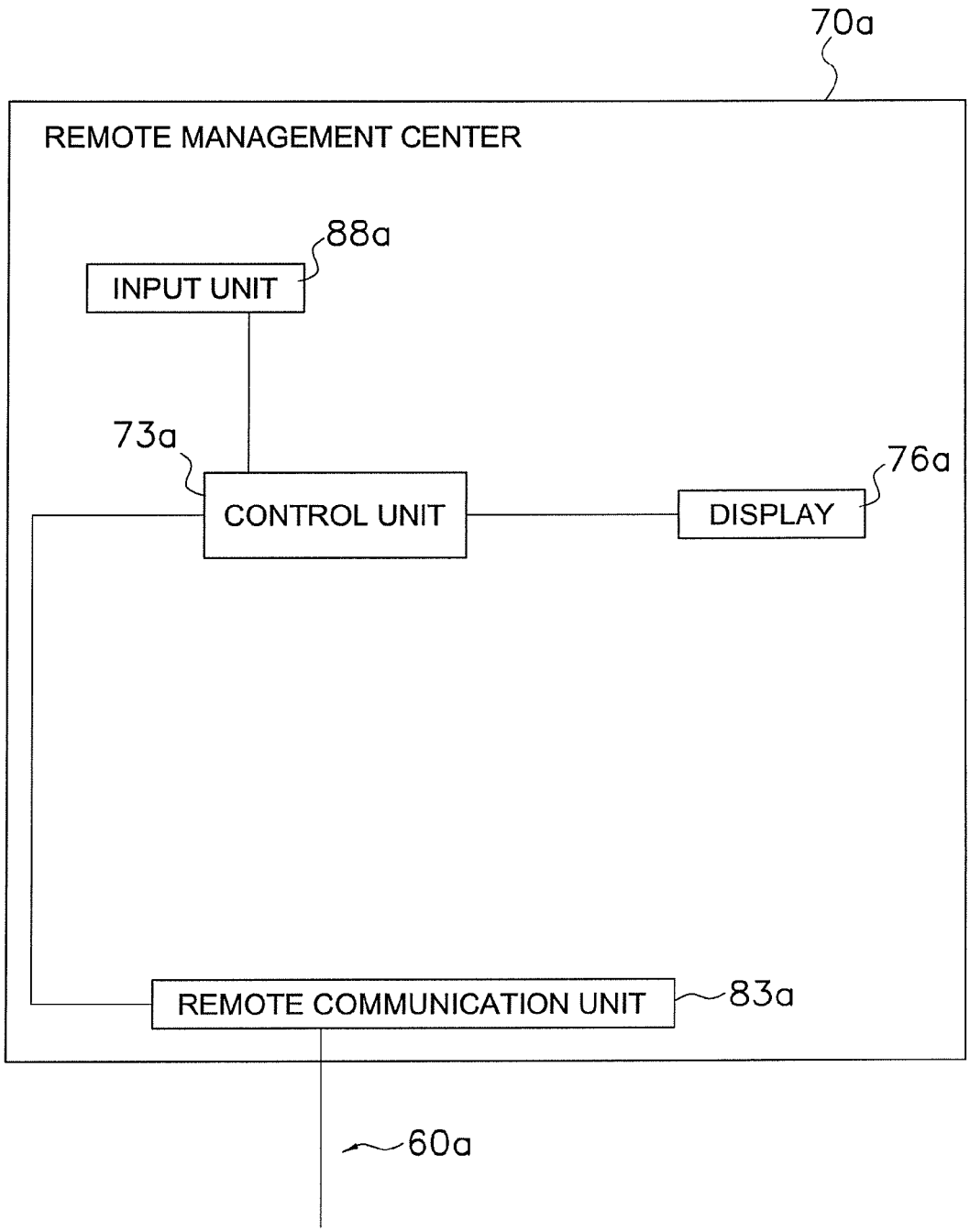
FIG. 17 is structural view of a remote management center of the second embodiment of the present invention.

A structural view of a specific-equipment management system 1*a* of a second embodiment of the present invention is shown in FIG. 15. Structural views of each configurational element of the specific-equipment management system 1*a* of the second embodiment of the present invention are shown in FIG. 16 and FIG. 17. In FIG. 15 to FIG. 17, elements of the configuration that are the same as elements of the configuration of the specific-equipment management system 1 shown in FIG. 1 to FIG. 3 are shown using the same numbers. The specific-equipment management system 1*a* shown in FIG. 15 is a system for managing principally a hot water heater 10. Here, the hot water heater 10 is equipment requiring operation by a person in the vicinity when used.

As shown in FIG. 15 to FIG. 17, the basic structure of the specific-equipment management system 1*a* is the same as for the first embodiment. However, a main point of distinction with the first embodiment is that a remote control unit 30*a* is connected to a remote management center 70*a* via a network 60*a*. In the following, the second embodiment is described focusing on the points of distinction with the first embodiment.

As shown in FIG. 16, the remote control unit 30*a* shown in FIG. 15 includes a user transmitter 43*a* and a user receiver 45*a*.

As shown in FIG. 17, the remote management center 70*a* shown in FIG. 15 mainly includes a control unit 73*a*, a remote communication unit 83*a*, an input unit 88*a*, and a display unit 76*a*.

Figure 18:
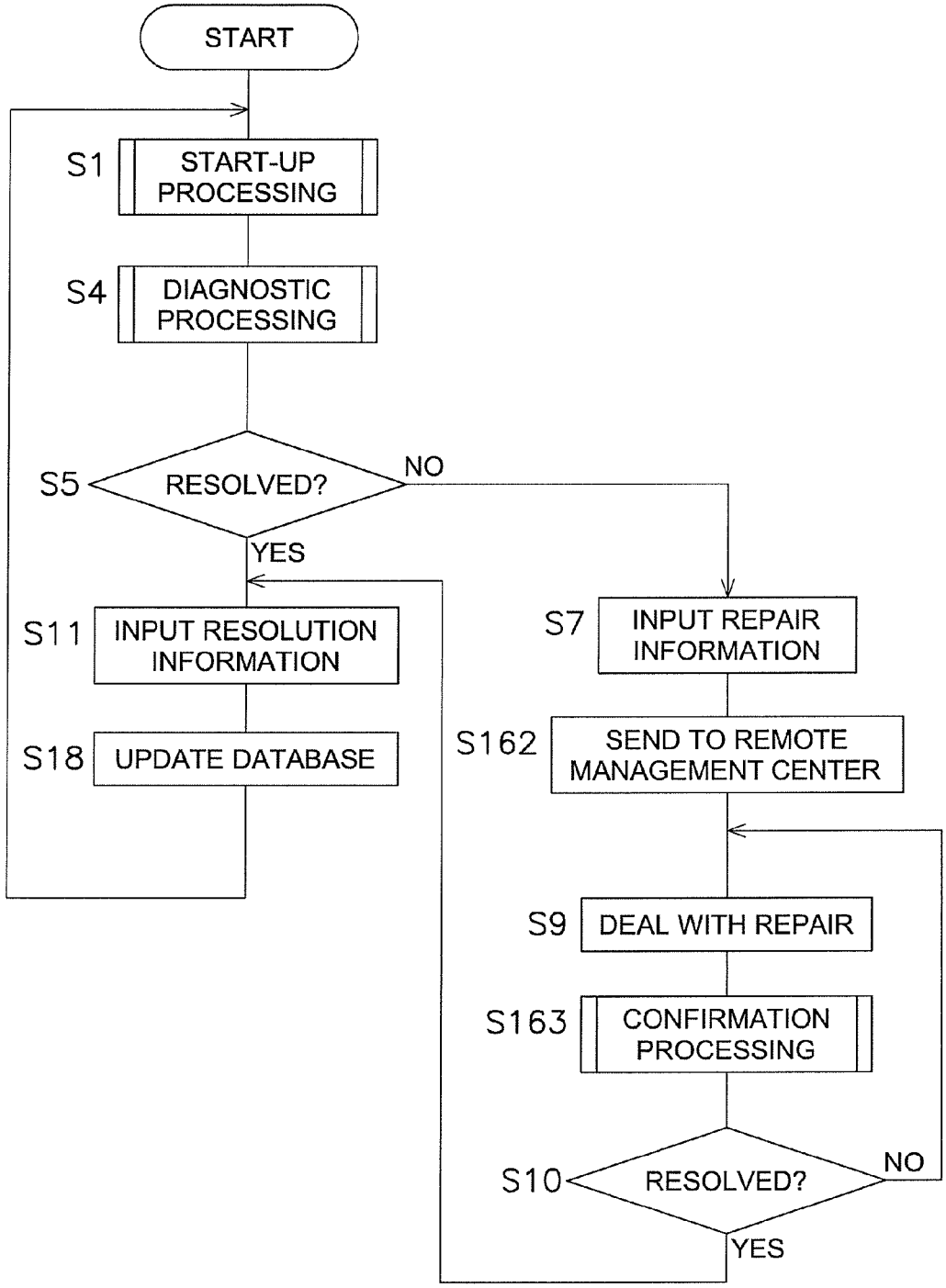
FIG. 18 is a flowchart showing a flow of processing where the specific-equipment management system manages a hot water heater.

The flow of the process in which the specific-equipment management system 1*a* shown in FIG. 15 manages the hot water heater 10 is shown in FIG. 18. In FIG. 18, processing that is the same as the processing shown in FIG. 4 is given the same numerals and is not described.

In step S162 shown in FIG. 18, repair information and verification result information are sent to the remote management center 70*a*. Namely, the user transmitter 43*a* of the remote control unit 30*a* shown in FIG. 3 receives repair information and verification result information from the input unit 32 via a control unit 33*a*. The user transmitter 43*a* sends the repair information and the verification result information to the remote management center 70*a* via the network 60*a*. The remote communication unit 83*a* of the remote management center 70*a* shown in FIG. 17 receives the repair information and the verification result information from the remote control unit 30*a* via the network 60*a*. The display unit 76*a* receives the repair information and the verification result information from the remote communication unit 83*a* via the control unit 73*a* and displays the information at the display screen (not shown). The operator of the remote management center 70*a* then makes a request for service staff to repair the hot water heater 10 based on the repair information and the verification result information displayed at the display unit 76*a* and inputs information indicating that service staff have been requested to perform repairs to the input unit 88*a*. The remote communication unit 83*a* then receives information indicating that a request for repair has been made to the service staff from the input unit 88*a* via the control unit 73*a* and sends this information to the remote control unit 30*a* via the network 60*a*. The user receiver 45*a* of the remote control unit 30*a* shown in FIG. 16 receives information indicating that repairs have been requested to the service staff from the remote management center 70*a* via the network 60*a*. The display unit 36 receives information indicating that a request has been made to the service staff for repairs from the user receiver 45*a* via the control unit 33*a* and displays the information at the display screen 36*f*.

Figure 19:
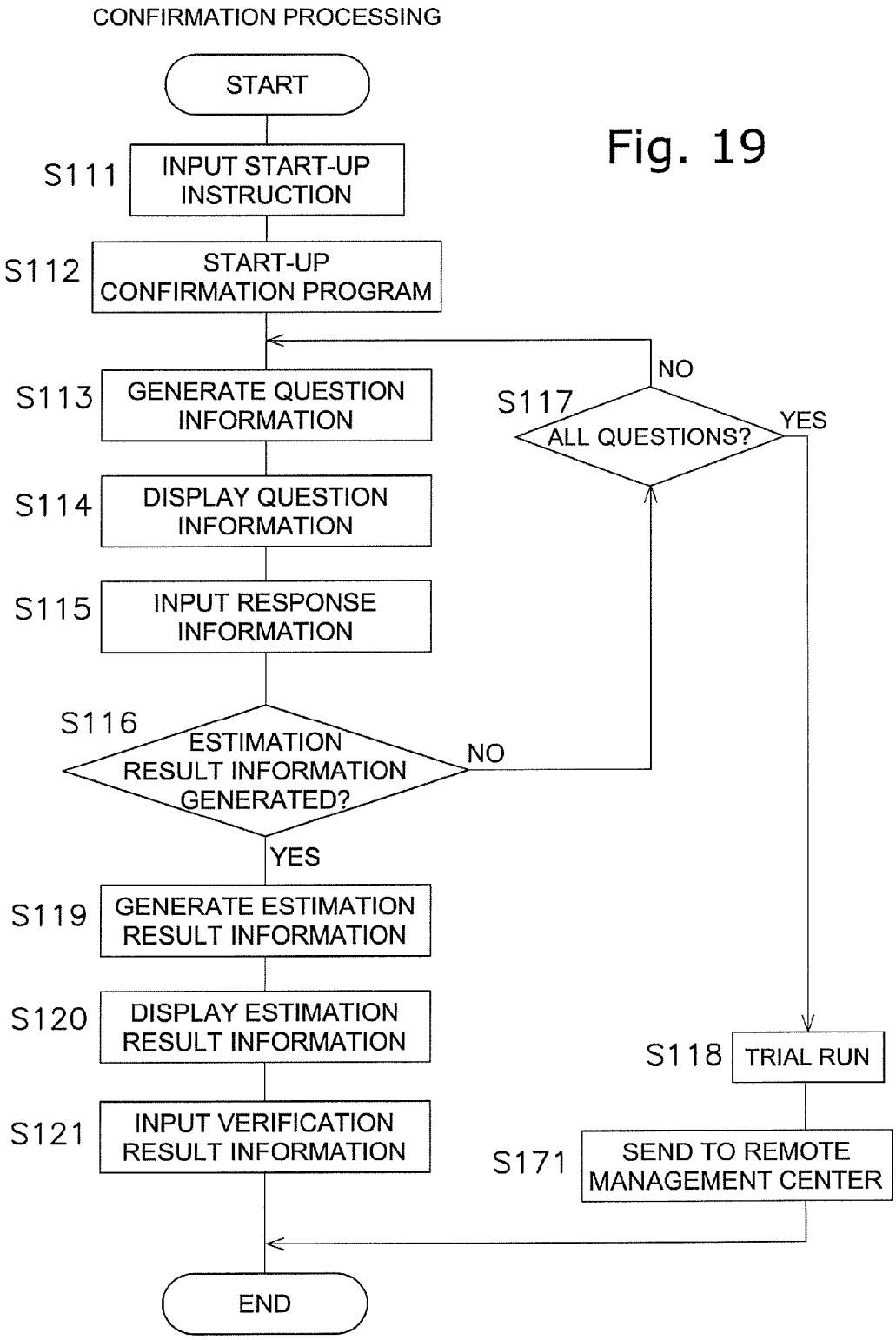
FIG. 19 is a flowchart showing a flow of confirmation processing.

Confirmation processing is then carried out in step S163 shown in FIG. 18. The flow of the confirmation processing S163 shown in FIG. 18 is shown in FIG. 19. In FIG. 19, processing that is the same as the processing shown in FIG. 7 is given the same numerals and is not described.

In step S171 shown in FIG. 19, information regarding the trial run is sent to the remote management center 70*a*. Namely, the user transmitter 43*a* shown in FIG. 16 receives information relating to the trial run of the hot water heater 10 from the control unit 33*a* and sends the information to the remote management center 70*a* via the network 60*a*. Here, information regarding the trial run is, for example, running data obtained during the trial run, etc. The remote communication unit 83*a* of the remote management center 70*a* shown in FIG. 17 receives information regarding the trial run for the hot water heater 10 from the remote control unit 30*a* via the network 60*a*. The display unit 76*a* receives the information relating to the hot water heater 10 from the remote communication unit 83*a* via the control unit 73*a* and displays the information at the display screen (not shown).

In this way, the verification result information is sent to the remote management center 70*a* via the network 60*a*. It is therefore possible to notify the remote management center 70*a* of the verification result information. Management of the verification result information is therefore possible via the network 60*a*. Further, the repair information and the verification result information is sent to the remote management center 70*a* via the network 60*a* only when the user of the hot water heater 10 determines that repair of a specific-error is necessary. This means that it is possible to notify the remote management center 70*a* of repair of a specific-error being required only when repair of a specific-error is actually required. It is therefore possible to reduce the number of times requests are made for repair of specific-equipment to the service staff. Further, information relating to the trial run is sent to the remote management center 70*a*. It is then possible to manage the history of execution of the trial run via the network 60*a*.

The second embodiment has the features (1) to (5) of the first embodiment.

Modified Example of the Second Embodiment (A) In step S162 shown in FIG. 18, estimation result information can also be further sent to the remote management center 70*a* via the network 60*a*. In this case, it is possible to notify the remote management center 70*a* of the estimation result information. Management of the estimation result information is therefore possible via the network 60*a*.

(B) The remote communication unit 83*a* of the remote management center 70*a* shown in FIG. 17 can also send next connection information to the remote control unit 30*a* via the network 60*a*. Here, "next connection information" is information relating to the next connection of the user transmitter 43*a* and the remote communication unit 83*a* and is, for example, time information and transmission information, etc. The time information is information regarding the time when the user transmitter 43*a* and the remote communication unit 83*a* are to be connected the next time. The transmission information is information regarding data to be sent from the user transmitter 43*a* to the remote communication unit 83*a* when the user transmitter 43*a* and the remote communication unit 83*a* are connected the next time.

Figure 20:
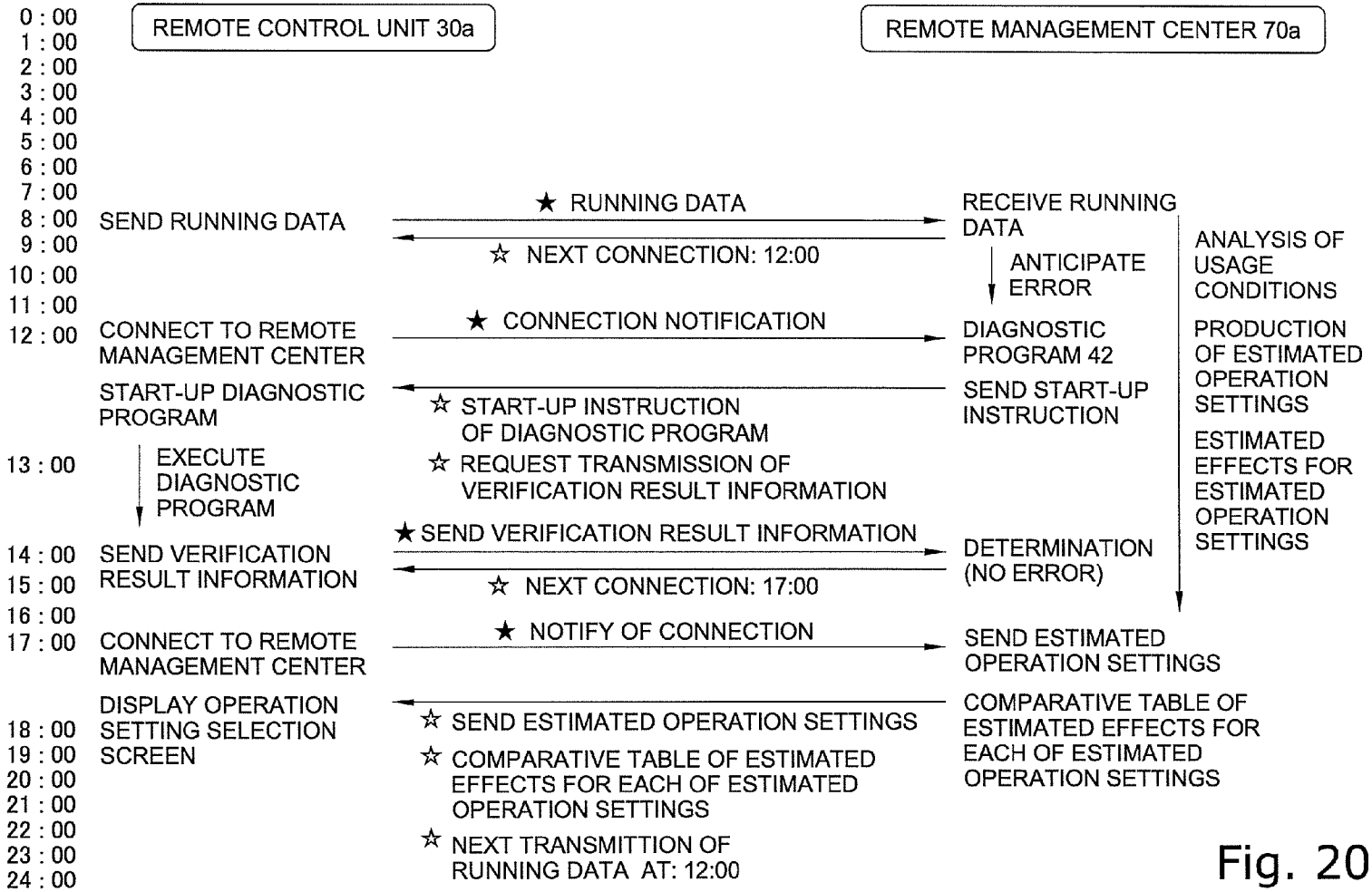
FIG. 20 is a conceptual view showing information for the next connection.

For example, as shown in FIG. 20, information of "next connection: 12:00" is sent from the remote management center 70*a* to the remote control unit 30*a* as the next connection information while running data is being sent from the remote control unit 30*a* to the remote management center 70*a* at 8:00. In this case, the next connection information includes time information. The remote management center 70*a* carries out processing to monitor errors on the side of the remote management center 70*a* based on running data received from the remote control unit 30*a*.

Next, at 12:00, the remote control unit 30*a* establishes a connection with the remote management center 70*a* based on information of "next connection: 12:00" and sends notification of connection to the remote management center 70*a*. When an error is anticipated on the side of the remote management center 70*a*, information for an instruction to start-up the diagnostic program 42 is sent from the remote management center 70*a* to the remote control unit 30*a* and information for a "verification result information transmission request" is sent as the next connection information. In this case, the next connection information includes transmission information. The diagnostic program 42 is then executed on the side of the remote control unit 30*a* based on start-up information for the diagnostic program 42 from the remote management center 70*a*.

Next, at 14:00, the remote control unit 30*a* sends verification result information to the remote management center 70*a* based on the results of executing the diagnostic program 42. The remote management center 70*a* then determines the error based on the verification result information received from the remote control unit 30*a*. The information "next connection: 17:00" is then sent from the remote management center 70*a* to the remote control unit 30*a* as the next connection information. In this case, the next connection information includes time information.

Next, at 17:00, the remote control unit 30*a* establishes a connection with the remote management center 70*a* based on information of "next connection: 17:00" and sends notification of connection to the remote management center 70*a*. Information for recommended operation settings and information for a comparative table of effects for each of recommended operation settings is sent from the remote management center 70*a* to the remote control unit 30*a* and information of the "next transmission of running data at 12:00" is sent as next connection information. In this case, the next connection information includes time information and transmission information.

As a result, when the next connection information is sent to the remote control unit 30*a* via the network 60*a*, it is possible to implement a pseudo-bi-directional connection even with, for example, dial-up connections that are not always connected. As a result, it is possible to manage specific-errors pseudo-bi-directionally via the network 60*a* even in cases when a connection is not always connected. Further, when the next connection information is taken to be more detailed information, it is possible to implement a pseudo-bi-directional connection in more detail even when a connection is not always on.

(C) In step S7 shown in FIG. 18, it is also possible to display information other than information indicating an object which is to be requested for repair or information to be communicated at the time of a request at the display unit 36. For example, it is possible to display that an error running mode or a life-extending running mode is to be executed until the service staff arrives, or to display a method to be adopted in emergencies for safety purposes.

Further, in step S162 shown in FIG. 18, after repair information and verification result information is sent to the remote management center 70*a*, for example, it is also possible to send a dates and times when a service staff member is able to visit from the remote management center 70*a* to the remote control unit 30*a* for display at the display unit 36. At this time, when a date and time for requesting repair is selected from the dates and times when the service staff is able to visit by the user at the input unit 32, the service staff can be informed of the selected input information via the remote management center 70*a*.

(D) In step S10 shown in FIG. 18, when it is determined that a specific-error has been resolved and the process goes to step S11, after step S11, it is also possible to send resolution information and verification result information to the remote management center 70*a*. In this case, the user transmitter 43*a* receives the resolution information and the verification result information from the input unit 32 via the control unit 33*a* and sends the resolution information and the verification result information to the remote management center 70*a* via the network 60*a*.

It is therefore possible to manage whether or not repairs by the service staff have been reliably carried out at the remote management center 70*a*. This makes it possible to make the quality of repairs uniform and makes it possible to further reduce inconvenience resulting from errors when making repairs.

Third Embodiment

Figure 21:
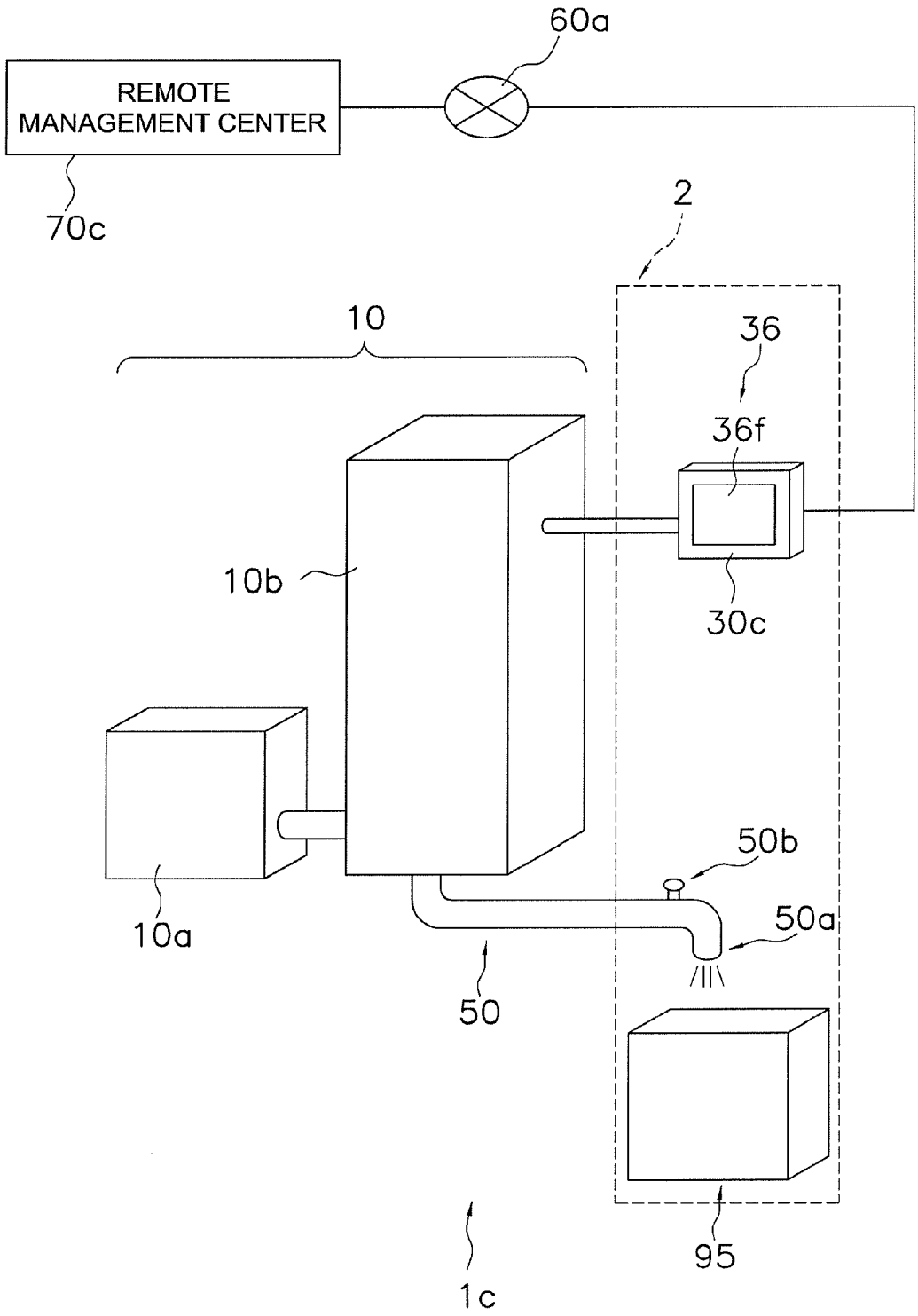
FIG. 21 is a structural view of a specific-equipment management system of a third embodiment of the present invention.
Figure 22:
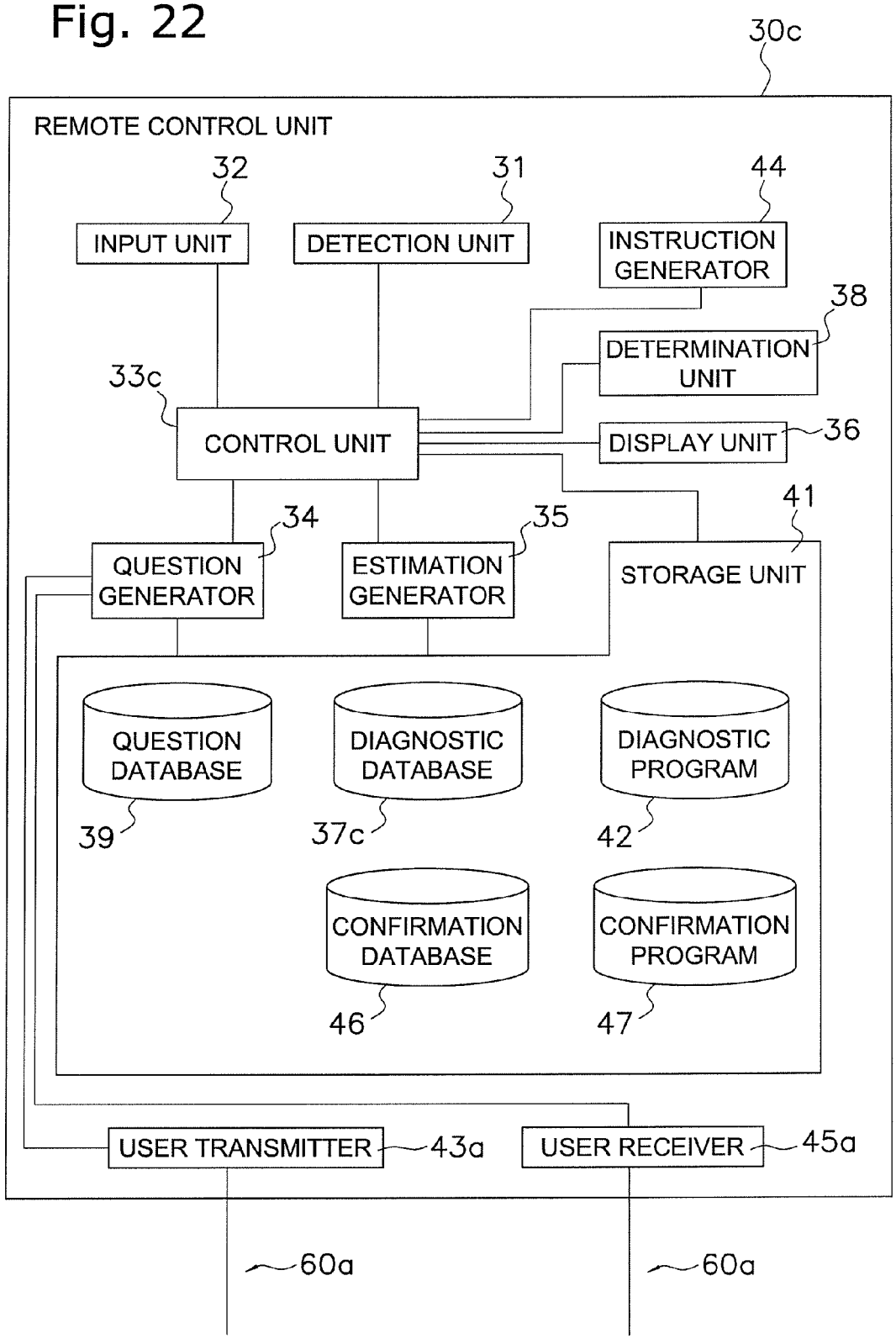
FIG. 22 is a structural view of a remote control unit for the third embodiment of the present invention.
Figure 23:
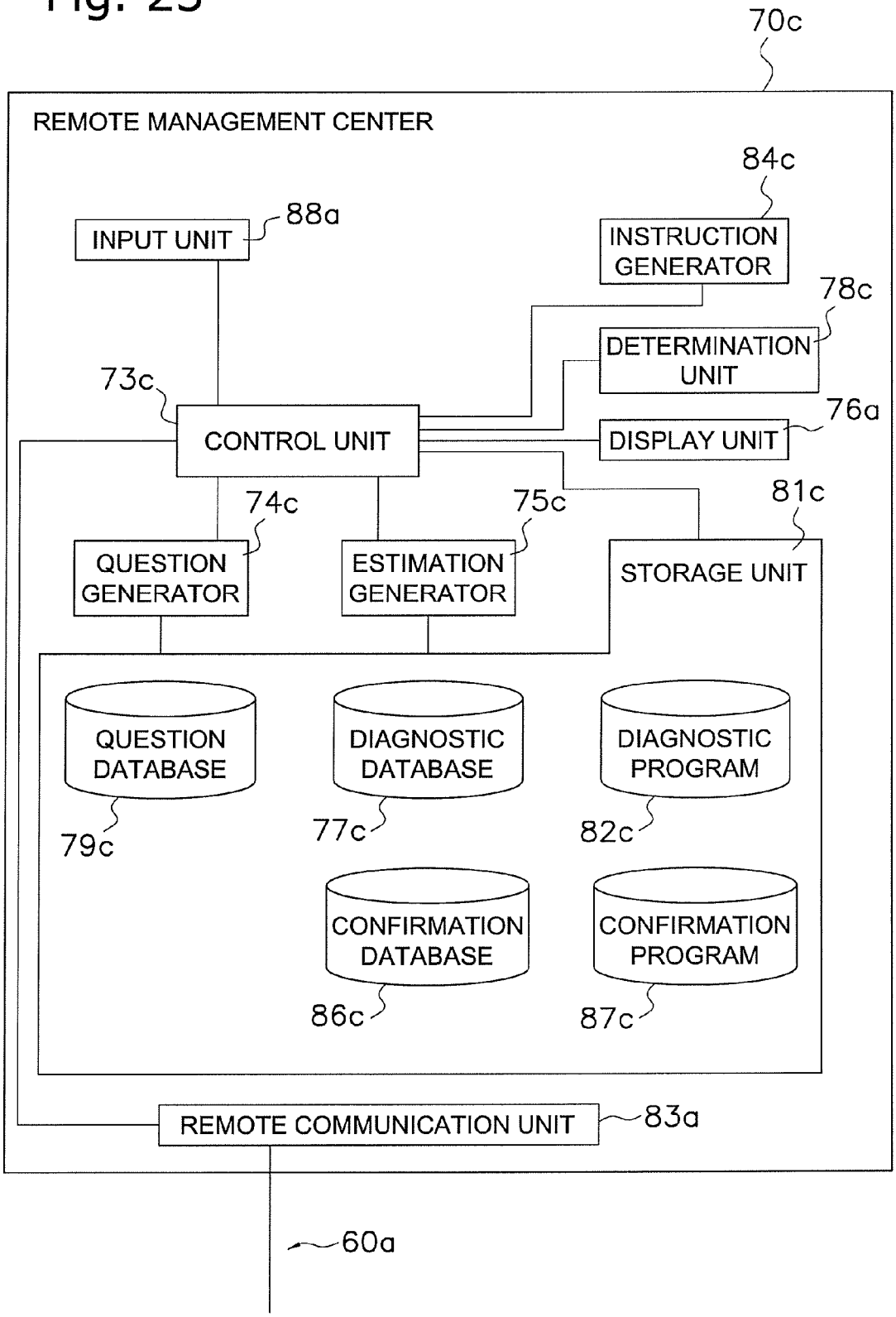
FIG. 23 is a structural view of a remote management center of the third embodiment of the present invention.

A structural view of a specific-equipment management system 1*c* of a third embodiment of the present invention is shown in FIG. 21. Structural views of each configurational element of the specific-equipment management system 1*c* of a third embodiment of the present invention are shown in FIG. 22 and FIG. 23. In FIG. 21 to FIG. 23, elements of the configuration that are the same as for the first and second embodiments are shown using the same numerals. The specific-equipment management system 1*c* shown in FIG. 21 is a system for managing principally a hot water heater 10. Here, the hot water heater 10 is equipment requiring operation by a person in the vicinity when used.

The specific-equipment management system 1*c* has basically the same structure as in the first and second embodiments. However, a remote control unit 30*c* and a remote management center 70*c* differ from the first and second embodiments as shown in the following. In the following, the third embodiment is described focusing on the points of difference with the first and second embodiments.

Figure 27:
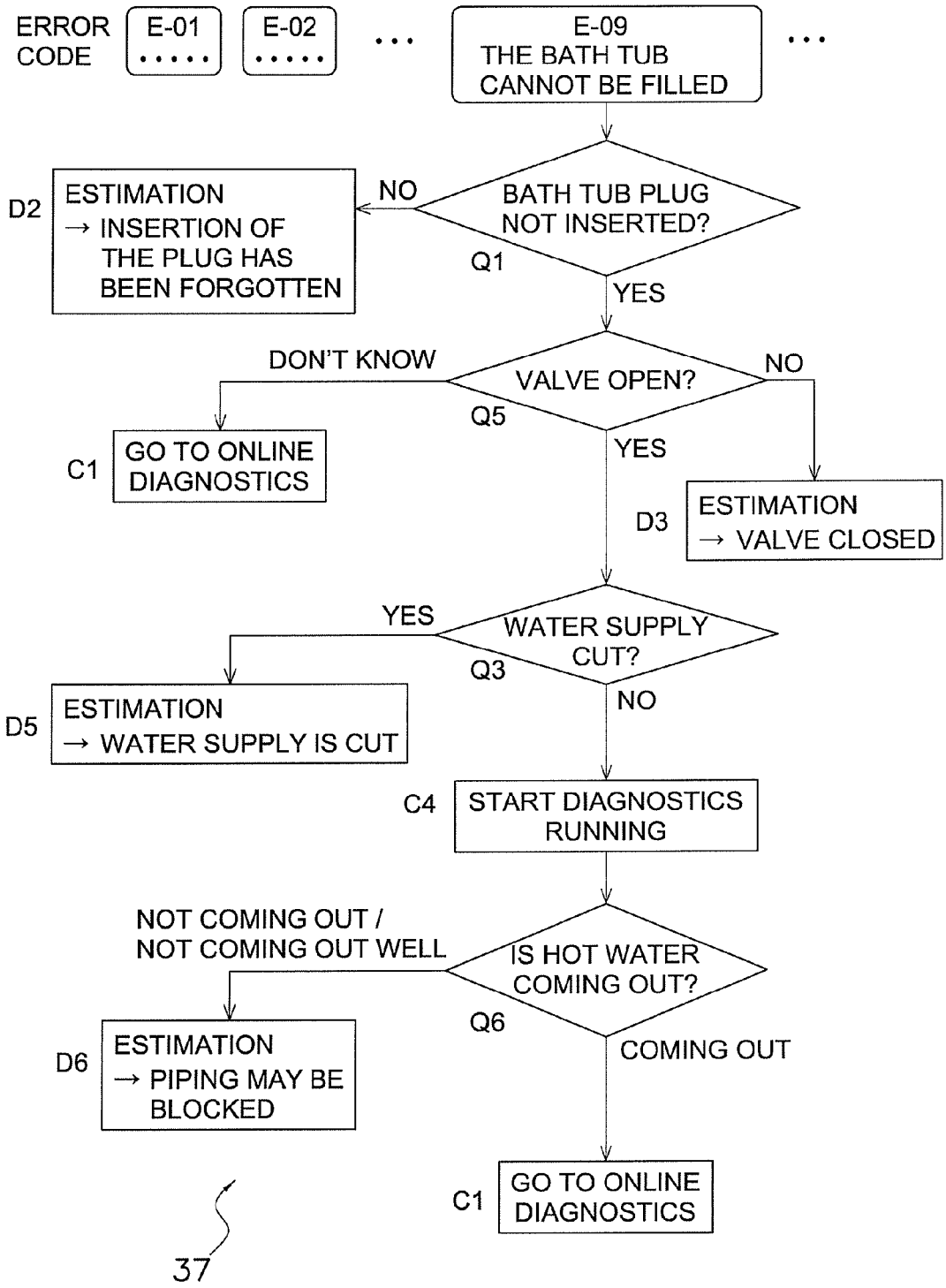
FIG. 27 is a conceptual view showing a structure of a diagnostic database.

A diagnostic database 37*c* is stored in the storage unit 41 of the remote control unit 30*c* shown in FIG. 22 in place of the diagnostic database 37. The diagnostic database 37*c* is similar to the diagnostic database 37 but, as shown in FIG. 27, differs in that instruction information C1 indicating "going to online diagnostics" is stored. For example, when the response information for the question information Q5 is "Don't Know" for an error code of "E-09", it can be understood that it is not possible to generate estimation result information at the remote control unit 30*c* by referring to the diagnostic database 37*c* and that this corresponds to instruction information C1 "go to online diagnostics". For example, when the response information for the question information Q6 is "coming out" for an error code of "E-09", it can be understood that it is not possible to generate estimation result information at the remote control unit 30*c* by referring to the diagnostic database 37*c* and that this corresponds to instruction information C1 "go to online diagnostics".

The remote management center 70*c* shown in FIG. 23 is provided with a control unit 73*c* in place of the control unit 73*a* and is further provided with a determination unit 78*c*, a question generator 74*c*, an estimation generator 75*c*, a storage unit 81*c* and an instruction generator 84*c*. A question database 79*c*, a diagnostic database 77*c*, a confirmation database 86*c*, a diagnostic program 82*c*, and a confirmation program 87*c* are stored in the storage unit 81*c*. The question database 79*c*, the diagnostic database 77*c*, and the confirmation database 86*c* respectively have the same structure as the question database 39, the diagnostic database 37*c*, and the confirmation database 46 (refer to FIG. 3) but store more detailed information than the question database 39, the diagnostic database 37*c* and the confirmation database 46.

Figure 24:
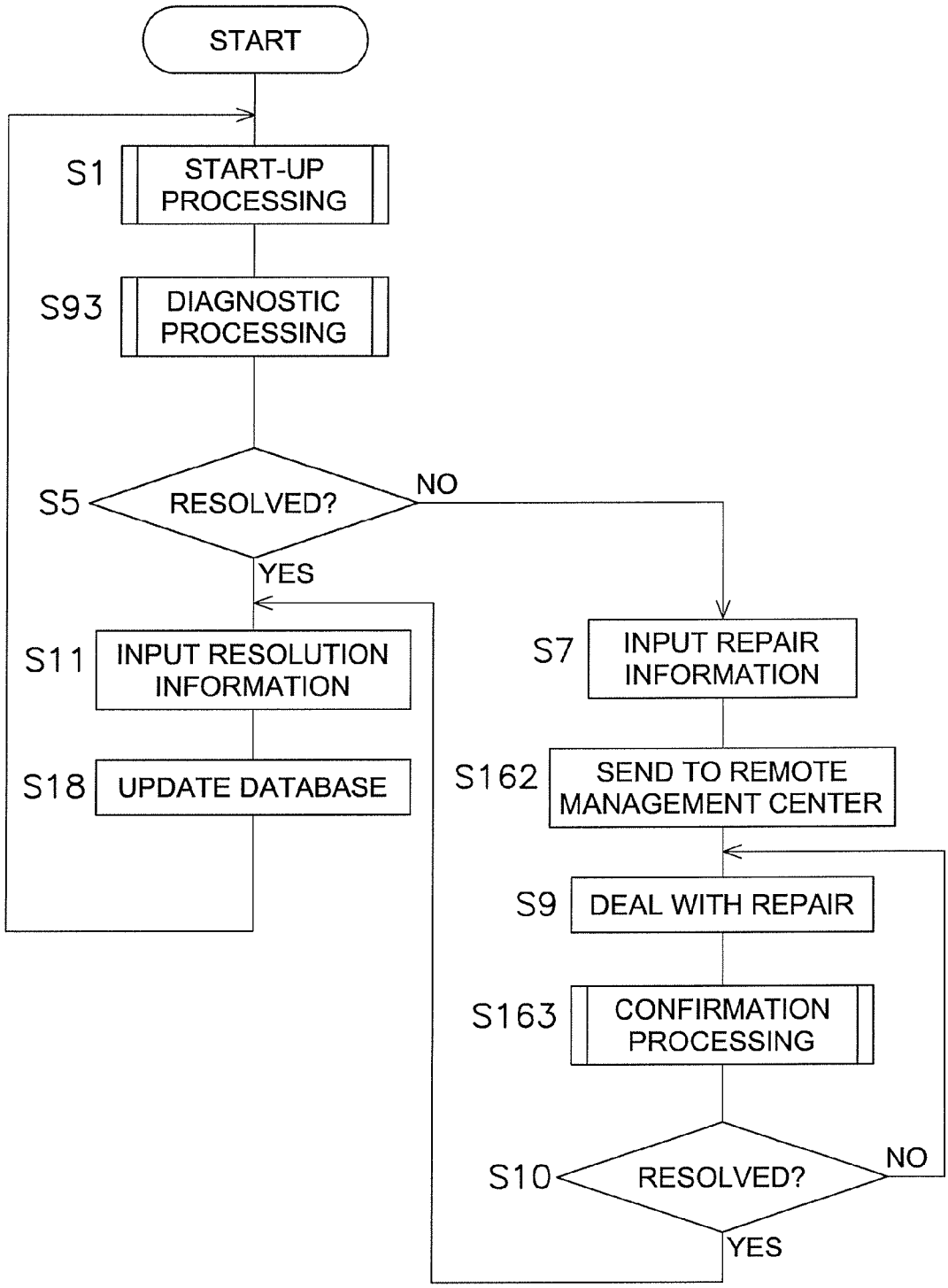
FIG. 24 is a flowchart showing a flow of processing where a specific-equipment management system manages a hot water heater.

As shown in FIG. 24, the flow of processing in which the specific-equipment management system 1*c* shown in FIG. 21 manages the hot water heater 10 differs from the second embodiment in that diagnostic processing S93 is carried out in place of the diagnostic processing S4. Processing in FIG. 24 that is the same as for the first and second embodiments and is given the same numerals in FIG. 4 and FIG. 18 is not described here.

Figure 25:
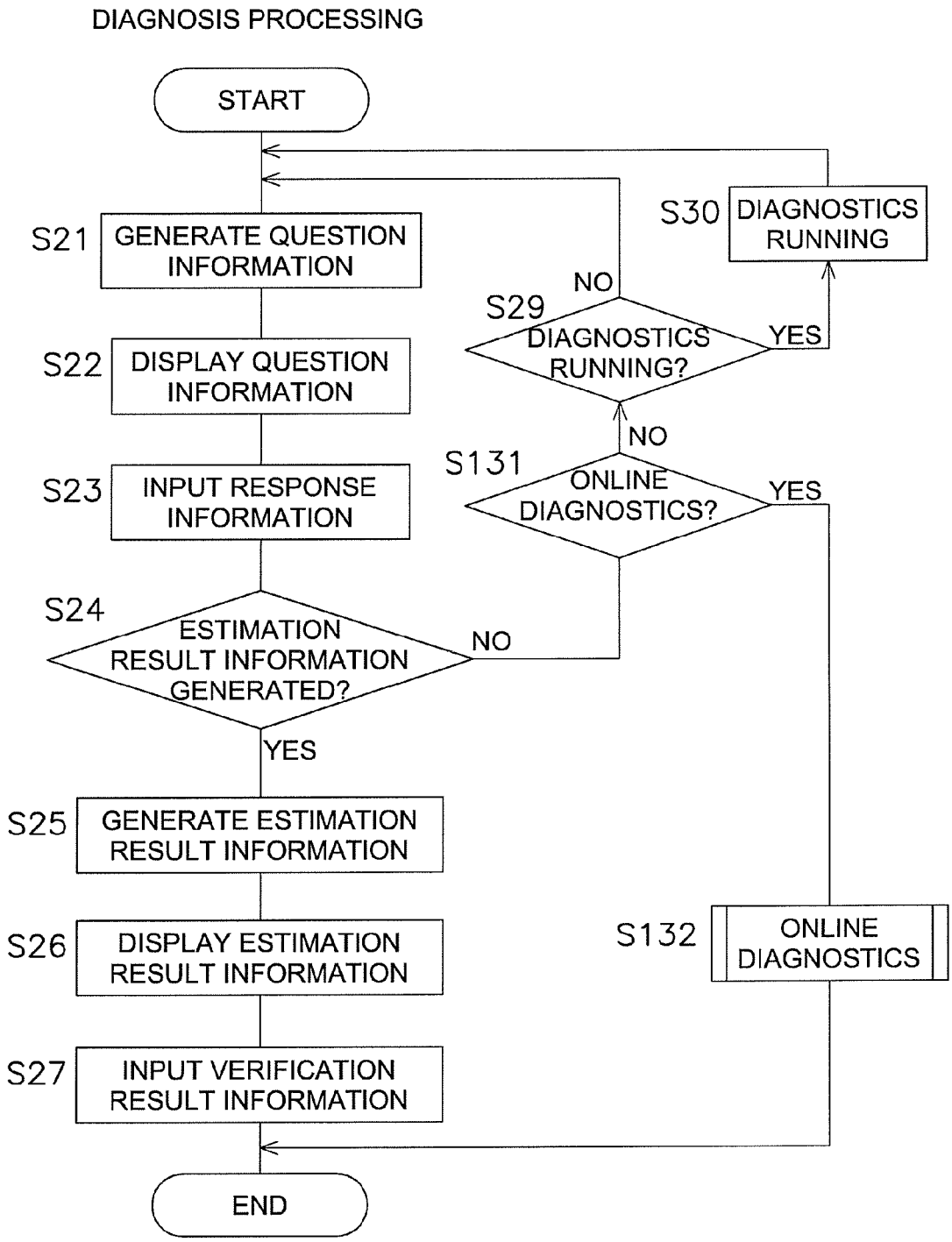
FIG. 25 is a flowchart showing a flow of diagnostic processing.

Next, a detailed description is given in FIG. 25 of the diagnostic processing S93 of FIG. 24. In FIG. 25, processing that is the same as diagnostic processing S4 of the first embodiment is shown using the same numerals as for FIG. 6 and is not described. Step S131 shown in FIG. 25 determines whether or not online diagnostics is to be performed, i.e. whether or not the next question information is to be received via a network 60. The determination unit 38 of the remote control unit 30c shown in FIG. 22 then refers to the diagnostic database 37c of the storage unit 41 via a control unit 33c and determines whether or not this corresponds to instruction information C1 "go to online diagnostics" based on the response information inputted in step S23. When this is determined to correspond to instruction information C1 "go to online diagnostics", it is determined that online diagnostics is to be carried out. When this is determined not to correspond to the instruction information C1 "go to online diagnostics", it is determined that online diagnostics should not be carried out. When it is determined that online diagnostics are to be carried out, the process goes to step S132 after generation of an instruction indicating that online diagnostics are to be performed by the control unit 33c. When it is determined that online diagnostics should not be carried out, the process goes to step S29.

Figure 26:
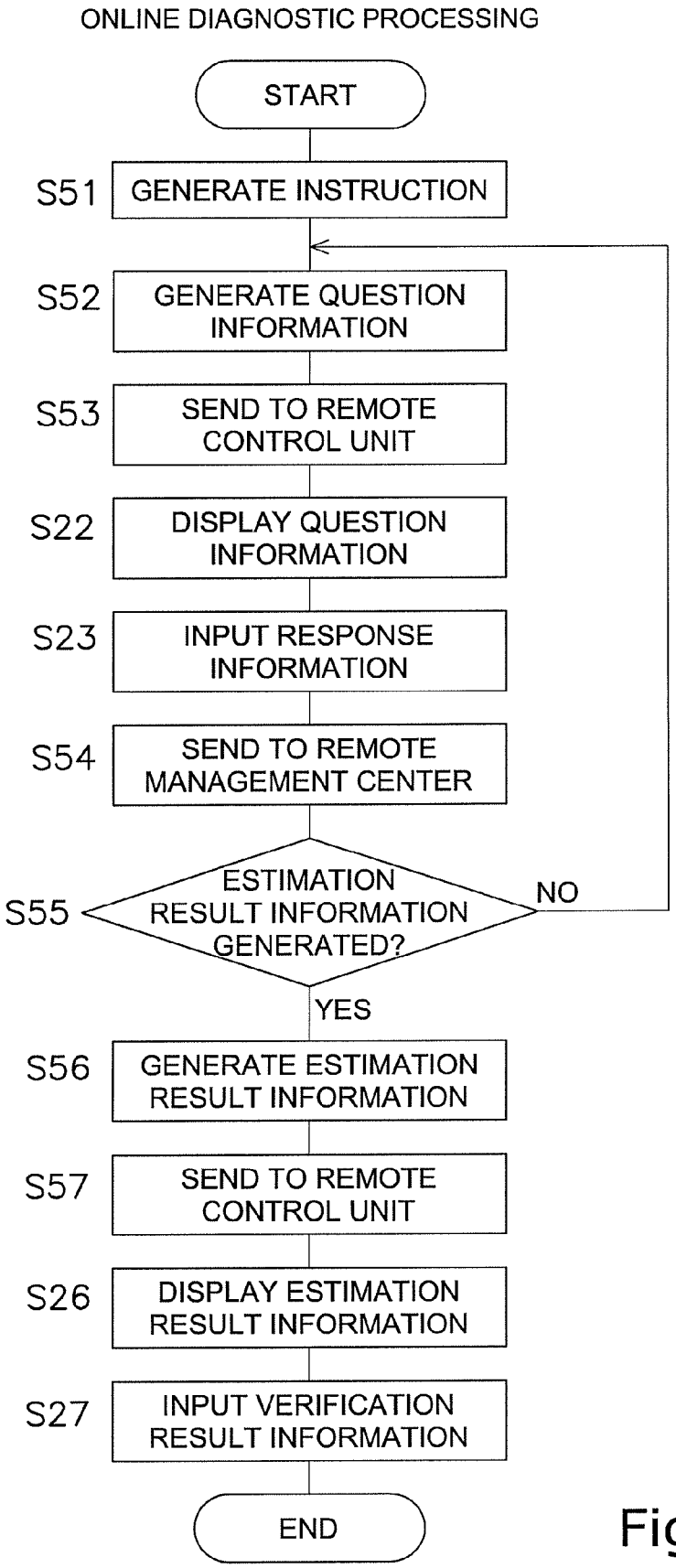
FIG. 26 is a flowchart showing a flow of online diagnostic processing.

The details of online diagnostics processing S132 shown in FIG. 25 are described using the flowchart shown in FIG. 26. In FIG. 26, processing that is the same as the diagnostic processing S4 shown in FIG. 6 is given the same numerals and is not described.

An instruction is then generated in step S51 shown in FIG. 26. Namely, the instruction generator 44 of the remote control unit 30c shown in FIG. 22 receives information indicating that online diagnostics are to be performed from the control unit 33c. The instruction generator 44 generates a start-up instruction for the diagnostic program 82c based on information indicating that the online diagnostic processing is to be carried out. Information for the start-up instruction is then received by the user transmitter 43a from the instruction generator 44 via the control unit 33c and information for a specific-error is received from the detection unit 31 via the control unit 33c. The user transmitter 43a sends the start-up instruction information and the specific-error information to the remote management center 70c via the network 60a. The remote communication unit 83a of the remote management center 70c then receives the start-up instruction information and the specific-error information from the user transmitter 43a via the network 60a. The control unit 73c then receives the start-up instruction information and the specific-error information from the remote communication unit 83a.

Question information is then generated in step S52 shown in FIG. 26. Namely, when the processing proceeds from step S51 to step S52, the control unit 73c of the remote management center 70c shown in FIG. 23 passes the start-up instruction information and the specific-error information over to the question generator 74c. The question generator 74c then refers to the question database 79c of the storage unit 81c and generates question information based on the start-up instruction information and the specific-error information. Alternatively, when the processing proceeds from step S55 to step S52, the question generator 74c receives information indicating that it has been determined that it is not possible to generate estimation result information and response information from the determination unit 78c via the control unit 73c. The question generator 74c then generates next question information based on the response information.

Question information is then sent to the remote control unit in step S53 shown in FIG. 26. Namely, the control unit 73c of the remote management center 70c shown in FIG. 23 receives question information from the question generator 74c. The remote communication unit 83a then receives the question information from the control unit 73c. The remote communication unit 83a sends the question information to the remote control unit 30c shown in FIG. 22 via the network 60a. The user receiver 45a of the remote control unit 30c then receives the question information from the remote communication unit 83a via the network 60a. The control unit 33c receives the question information from the user receiver 45a.

In step S54 shown in FIG. 26, the response information is sent to the remote management center. Namely, the control unit 33c of the remote control unit 30c shown in FIG. 22 passes over the response information from the input unit 32 to the user transmitter 43a. The user transmitter 43a sends the response information to the remote management center 70c shown in FIG. 23 via the network 60a. The remote communication unit 83a then receives the response information from the user transmitter 43a via the network 60a.

It is then determined whether or not it is possible to generate estimation result information in step S55 shown in FIG. 26. Namely, the control unit 73c of the remote management center 70c shown in FIG. 23 passes over the response information from the remote communication unit 83a to the determination unit 78c. The determination unit 78c then refers to the diagnostic database 77c of the storage unit 81c via the control unit 73c and determines whether or not it is possible to generate estimation result information based on the response information. When it is determined that it is possible to generate estimation result information, the process goes to step S56. When it is determined that it is not possible to generate estimation result information, the process goes to step S52.

Estimation result information is then generated in step S56 shown in FIG. 26. The estimation generator 75c of the remote management center 70c shown in FIG. 23 then receives information indicating that it is determined that generation of estimation result information is possible and response information from the determination unit 78c via the control unit 73c. The estimation generator 75c then refers to the diagnostic database 77c of the storage unit 81c and generates estimation result information based on the response information. The estimation generator 75c then passes the estimation result information over to the control unit 73c.

Estimation result information is then sent to the remote control unit 30c in step S57 shown in FIG. 26. Namely, the remote communication unit 83a of the remote management center 70c shown in FIG. 23 receives the estimation result information from the estimation generator 75c via the control unit 73c. The remote communication unit 83a sends the estimation result information to the remote control unit 30c shown in FIG. 22 via the network 60a. The user receiver 45a of the remote control unit 30c then receives the estimation result information from the remote communication unit 83a via the network 60a. The control unit 33c receives the estimation result information from the user receiver 45a.

It is therefore possible to generate question information and estimation result information referring to the question database 79c and the diagnostic database 77c storing more detailed information than the question database 39 and the diagnostic database 37c. This means that it is possible to specify specific-errors in detail by carrying out online diagnostic processing as shown in FIG. 26 even in cases where specific-errors that can be specified by the diagnostic program 42 are kept to straightforward errors in order to keep the storage capacity of the storage unit 41 of the remote control unit 30c from becoming too large. Further, the diagnostic program 82c is stored on the side of the remote management center 70*c*. It is therefore possible to use a diagnostic program 82*c* that is much more sophisticated than the diagnostic program 42.

It is also possible for some of the processing performed by the determination unit 38, the question generator 34, and the estimation generator 35 to be carried out on the side of the remote management center 70*c*. This means that it is possible to reduce the processing load placed on the side of the remote control unit 30*c*.

In confirmation processing S163 shown in FIG. 24, online confirmation processing is carried out as necessary. This online confirmation processing is implemented by the confirmation program 87*c* stored in the storage unit 81*c* of the remote management center 70*c* referring to the confirmation database 86*c*. The details of the online confirmation processing are the same as the online diagnostic processing shown in FIG. 26. The confirmation program 87*c* is a more sophisticated program than the confirmation program 47 (refer to FIG. 22). It is also possible to store more detailed information in the confirmation database 86*c* than in the confirmation database 46. This makes it possible to generate next question information and estimation result information while taking into consideration response information inputted at the input unit 32 (refer to FIG. 22) in more detail. The third embodiment has the features (1) to (5) of the first embodiment.

Modified Examples of the Third Embodiment (A) In step S51 shown in FIG. 26, start-up instructions for the diagnostic program 82*c* can be inputted to the input unit 32 of the remote control unit 30*c* shown in FIG. 22 by the user of the hot water heater 10. The inputted start-up instruction information can then be sent to the remote management center 70*c* via the network 60*a*.

(B) It is also possible to carry out online confirmation processing in place of the confirmation processing 163 shown in FIG. 24. In this case, it is no longer necessary to store the confirmation program 47 and the confirmation database 46 on the side of the remote control unit 30*c* and it is possible to keep down the storage capacity of the remote control unit 30*c*.

Figure 28:
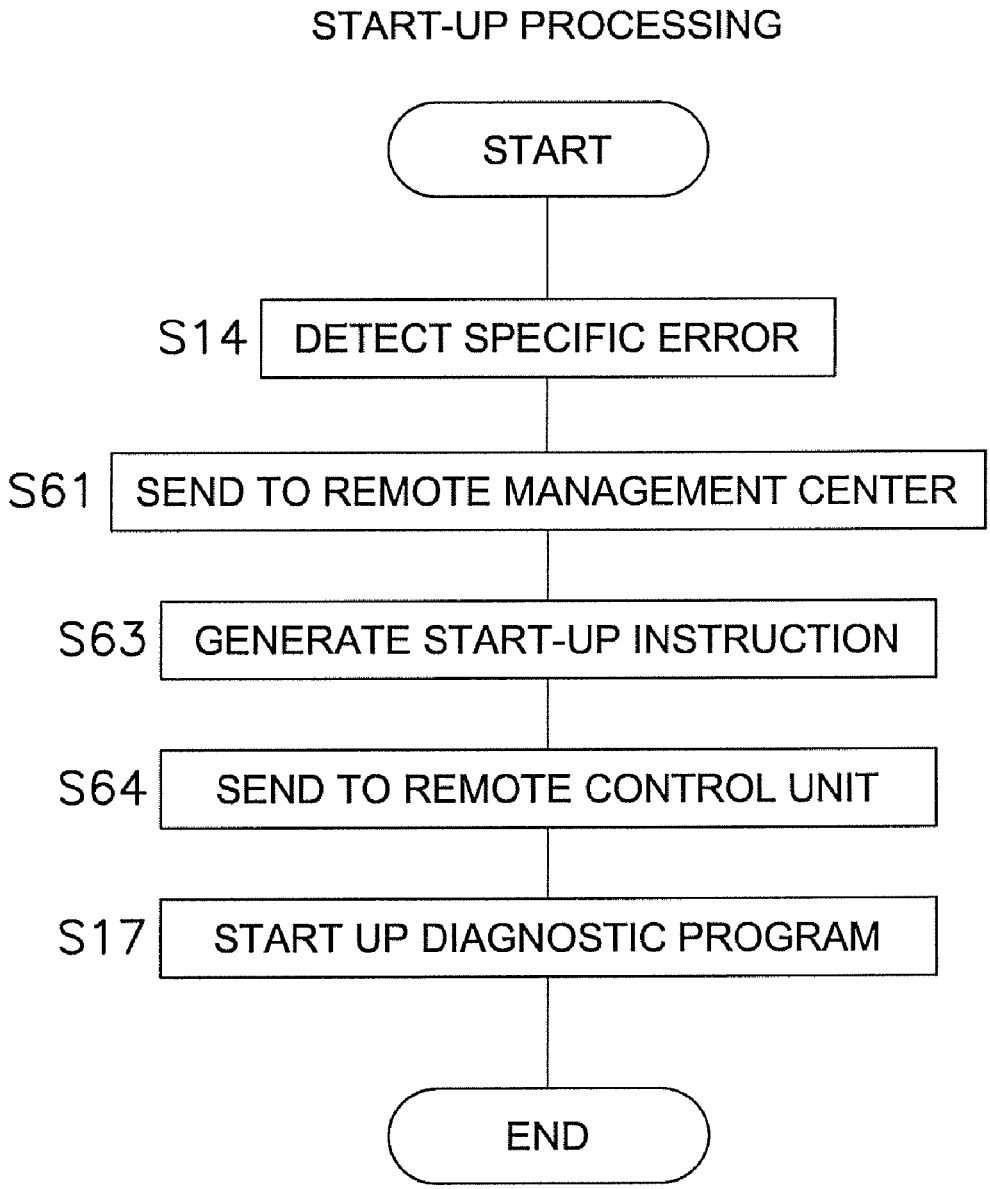
FIG. 28 is a flowchart showing a flow of start-up processing.

(C) The instruction generator 84*c* of the remote management center 70*c* shown in FIG. 23 can also then generate a start-up instruction for the diagnostic program 42 based on the specific-error information. In this case, the details of the start-up processing S1 shown in FIG. 24 can be as shown in FIG. 28. In FIG. 28, processing that is the same as the start-up processing shown in FIG. 5 is given the same numerals and is not described.

In step S61 shown in FIG. 28, the specific-error information is sent to the remote management center. Namely, the user transmitter 43*a* shown in FIG. 22 receives specific-error information from the control unit 33*c*. The user transmitter 43*a* sends the specific-error information to the remote management center 70*c* shown in FIG. 23 via the network 60*a*. The remote communication unit 83*a* of the remote management center 70*c* then receives the specific-error information from the user transmitter 43*a* via the network 60*a*.

A start-up instruction is then generated in step S63 shown in FIG. 28. Namely, the instruction generator 84*c* of the remote management center 70*c* shown in FIG. 23 receives specific-error information from the control unit 73*c*. The instruction generator 84*c* then generates a start-up instruction for the diagnostic program 42 based on the specific-error information. The control unit 73*c* then receives start-up instruction information for the diagnostic program 42 from the instruction generator 84*c*.

Start-up instruction information is then sent to the remote control unit 30*c* in step S64 shown in FIG. 28. Namely, the control unit 73*c* of the remote management center 70*c* shown in FIG. 23 passes over the start-up instruction information to the remote communication unit 83*a*. The remote communication unit 83*a* sends the start-up instruction information to the remote control unit 30*c* shown in FIG. 22 via the network 60*a*. The user receiver 45*a* of the remote control unit 30*c* then receives the start-up instruction information from the remote communication unit 83*a* via the network 60*a*. The control unit 33*c* then receives start-up instruction information for the diagnostic program 42 from the user receiver 45*a*.

The start-up instruction information is therefore sent to the remote control unit 30*c* via the network 60*a*. It is therefore possible to start-up the diagnostic program 42 based on the occurrence of a specific-error. This means that it is possible to reduce the load on the user for managing specific-errors.

(D) The diagnostic program 42 may not be stored in the storage unit 41 shown in FIG. 22 and it is possible to send the diagnostic program 82*c* from the remote management center 70*c* to the remote control unit 30*c*. Alternatively, it is possible to send the diagnostic program 82*c* from the remote management center 70*c* to the remote control unit 30*c* only when updating of the diagnostic program 42 is required.

In this case, the user transmitter 43*a* of the remote control unit 30*c* shown in FIG. 22 receives start-up instruction information from the control unit 33*c*. The user transmitter 43*a* sends the start-up instruction information to the remote management center 70*c* shown in FIG. 23 via the network 60*a*. The remote communication unit 83*a* of the remote management center 70*c* receives the start-up instruction information from the user transmitter 43*a* via the network 60*a*. The control unit 73*c* receives information for the diagnostic program 82*c* from the storage unit 81*c* based on the start-up instruction information. The remote communication unit 83*a* receives the information for the diagnostic program 82*c* from the control unit 73*c*. The remote communication unit 83*a* sends the information for the diagnostic program 82*c* to the remote control unit 30*c* shown in FIG. 22 via the network 60*a*. The user receiver 45*a* of the remote control unit 30*c* then receives the information for the diagnostic program 82*c* from the remote communication unit 83*a* via the network 60*a*. The control unit 33*c* receives information for the diagnostic program 82*c* from the user receiver 45*a*. The control unit 33*c* accesses the storage unit 41 and updates the diagnostic program 42 based on the information for the diagnostic program 82*c*. These points are different from the first embodiment.

In this way, the information for the diagnostic program 82*c* is sent to the remote control unit 30*c* via the network 60*a*. It is therefore possible to easily update the diagnostic program by performing processing only for the remote management center 70*c* even in cases where the diagnostic program 82*c* is to be updated. The structure for this modified example is particularly effective in cases where a plurality of remote control units 30*c* are connected to the remote management center 70*c*.

(E) It is also possible to store an operation history for the remote control unit 30*c* in the storage unit 41 of the remote control unit 30*c* shown in FIG. 22. For example, information for the running modes of the hot water heater 10 inputted to the input unit 32 of the remote control unit 30*c* and information for the time when this inputting was carried out can be stored in a correlated manner. Information for the operation history of the remote control unit 30*c* can also be taken into consideration when updating the databases 37*c*, 39, and 46 in step S18 shown in FIG. 24.

Fourth Embodiment

Figure 29:
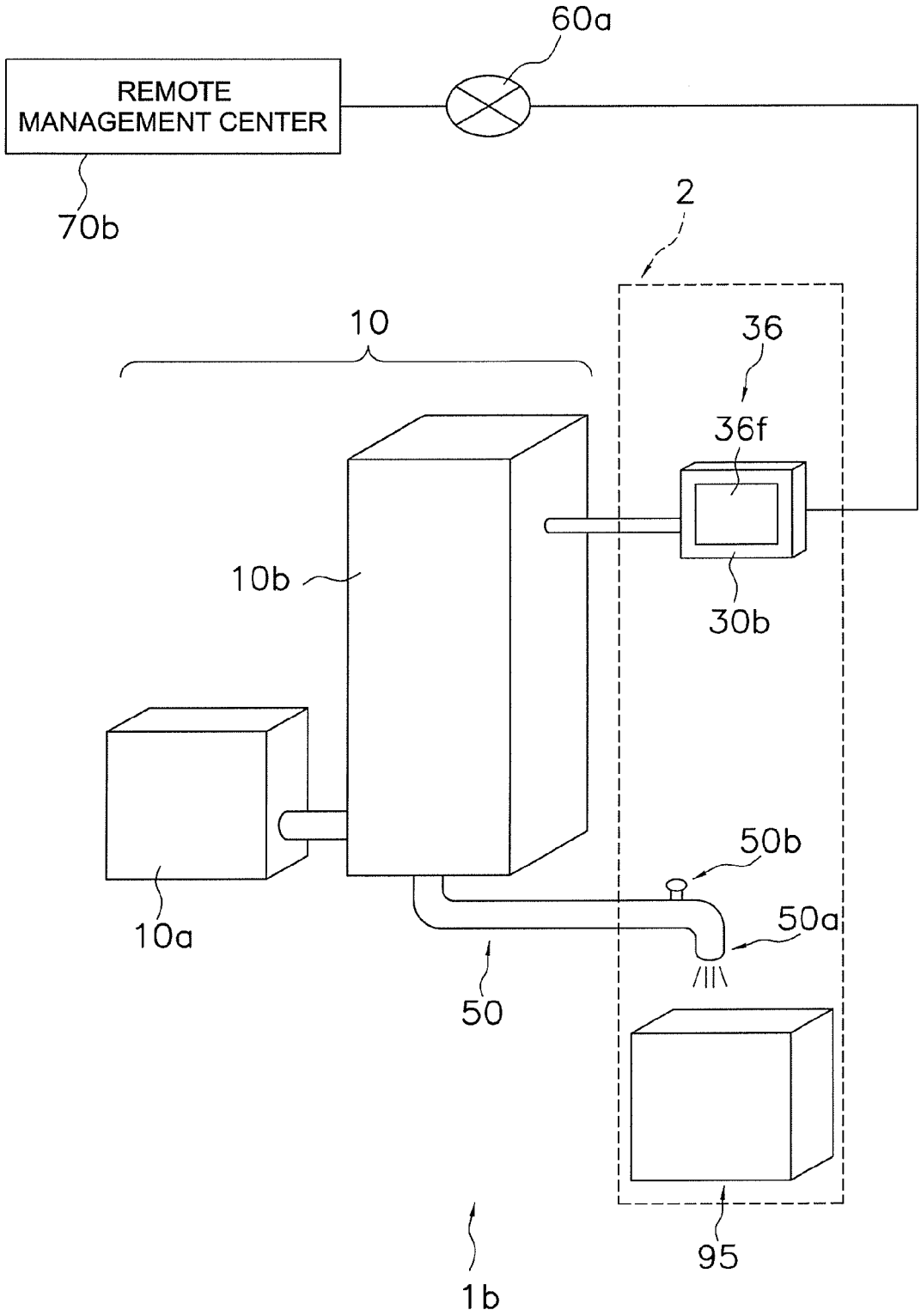
FIG. 29 is a structural view of a specific-equipment management system of a fourth embodiment of the present invention.
Figure 30:
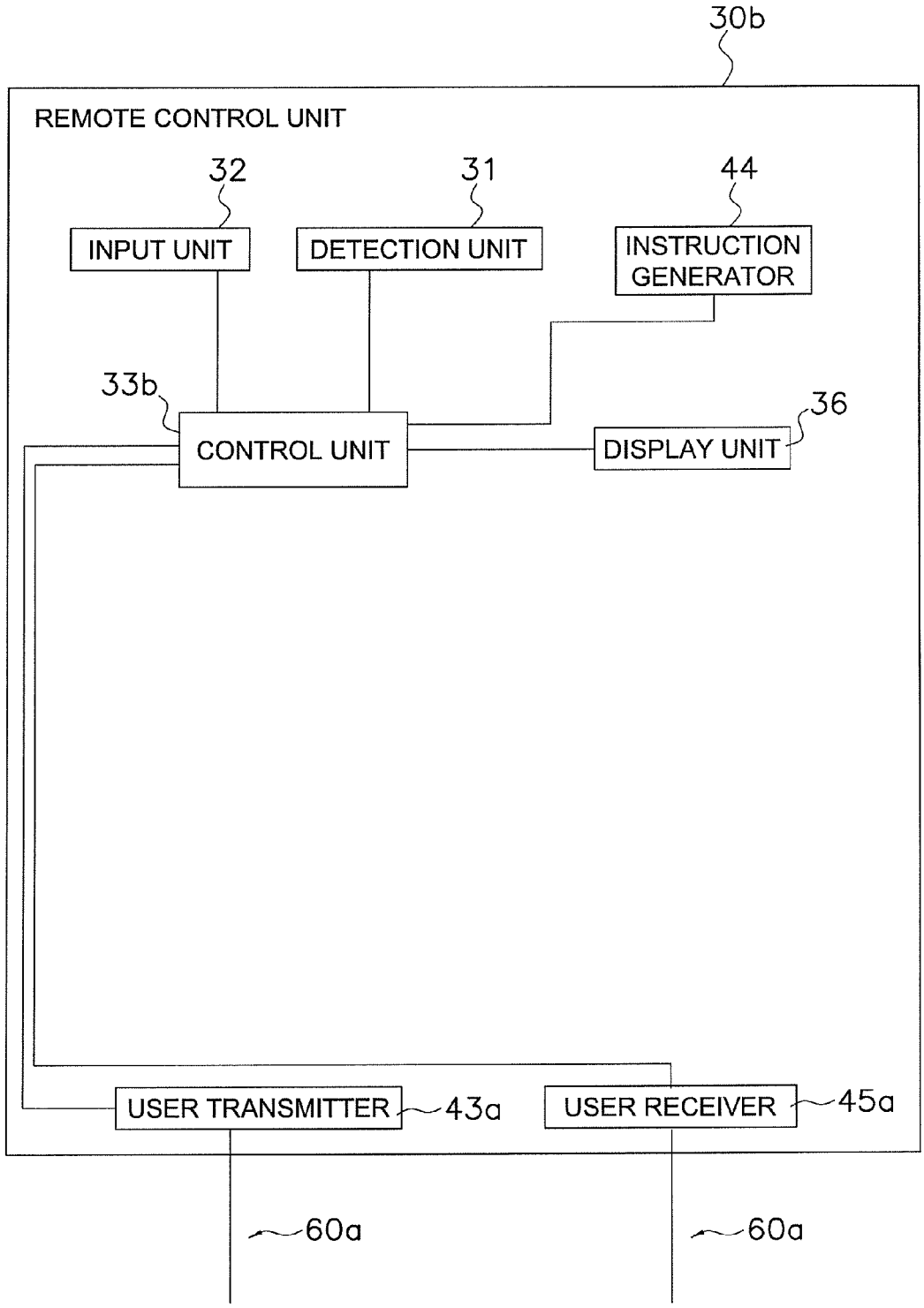
FIG. 30 is a structural view of a remote control unit for the fourth embodiment of the present invention.
Figure 31:
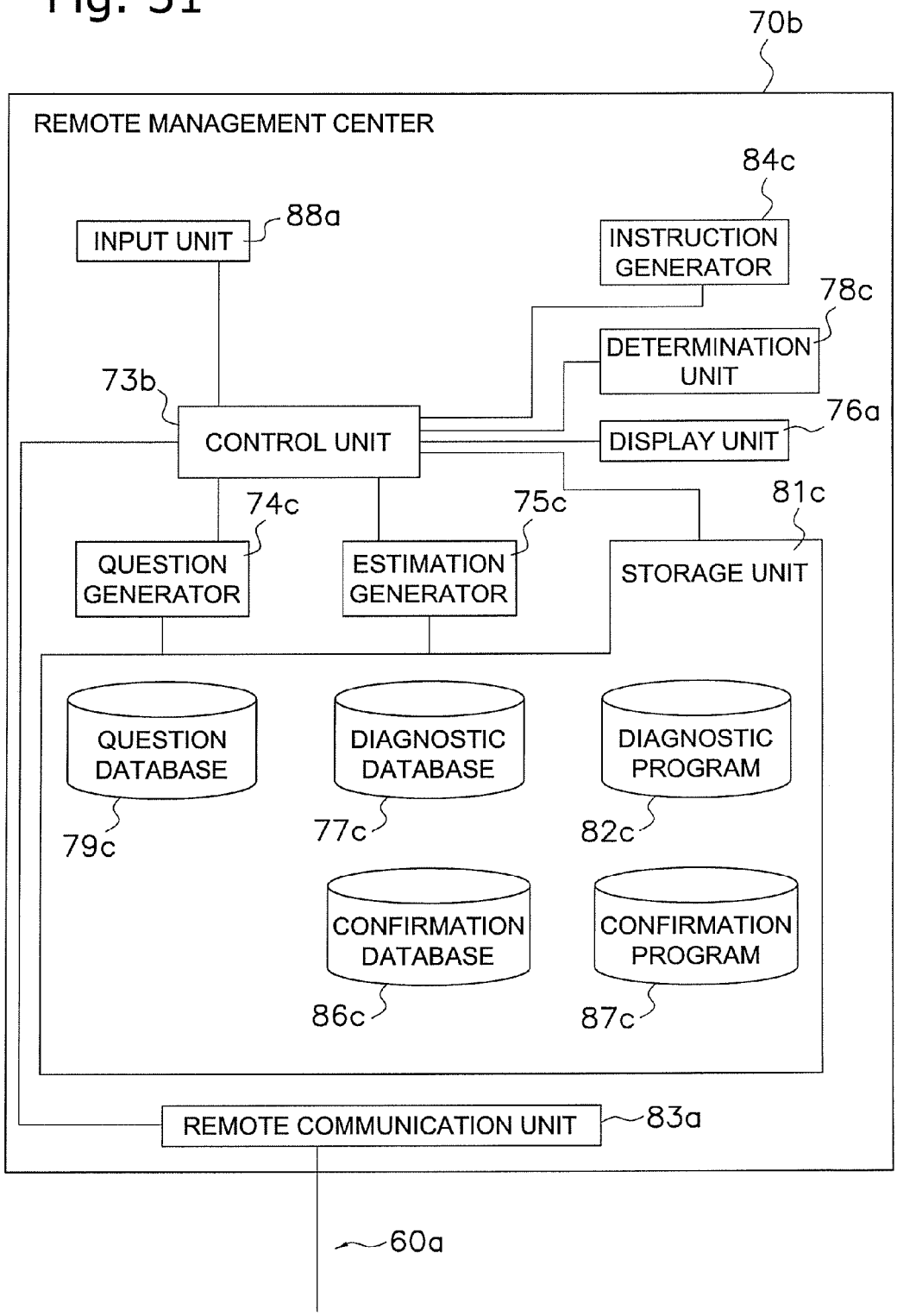
FIG. 31 is a structural view of a remote management center of the fourth embodiment of the present invention.

A structural view of a specific-equipment management system 1*b* of a fourth embodiment of the present invention is shown in FIG. 29. Structural views of each configurational element of the specific-equipment management system 1*b* of a fourth embodiment of the present invention are shown in FIG. 30 and FIG. 31. In FIG. 29 to FIG. 31, elements of the configuration that are the same as for the first, second, and third embodiments are shown using the same numerals. The specific-equipment management system 1*b* shown in FIG. 29 is a system for managing principally a hot water heater 10. Here, the hot water heater 10 is equipment requiring operation by a person in the vicinity when used.

As shown in FIG. 29 to FIG. 31, the basic configuration of the specific-equipment management system 1*b* is the same as for the first, second, and third embodiments. However, the remote control unit 30*b* not being provided with the determination unit 38, the question generator 34, the estimation generator 35, and the storage unit 41 differs from the first, second, and third embodiments. Namely, at the remote control unit 30*b* of the specific-equipment management system 1*b*, the diagnostic processing of step S4 (refer to FIG. 4 and FIG. 18) and of step S93 (refer to FIG. 24) is not carried out. On the other hand, the structure of a remote management center 70*b* is different from the third embodiment in that a control unit 73*b* is provided instead of the control unit 73*c*. The diagnostic program 82*c* (refer to FIG. 31) carrying out online diagnostic processing S152 (refer to FIG. 32) is the same as the third embodiment.

Figure 32:
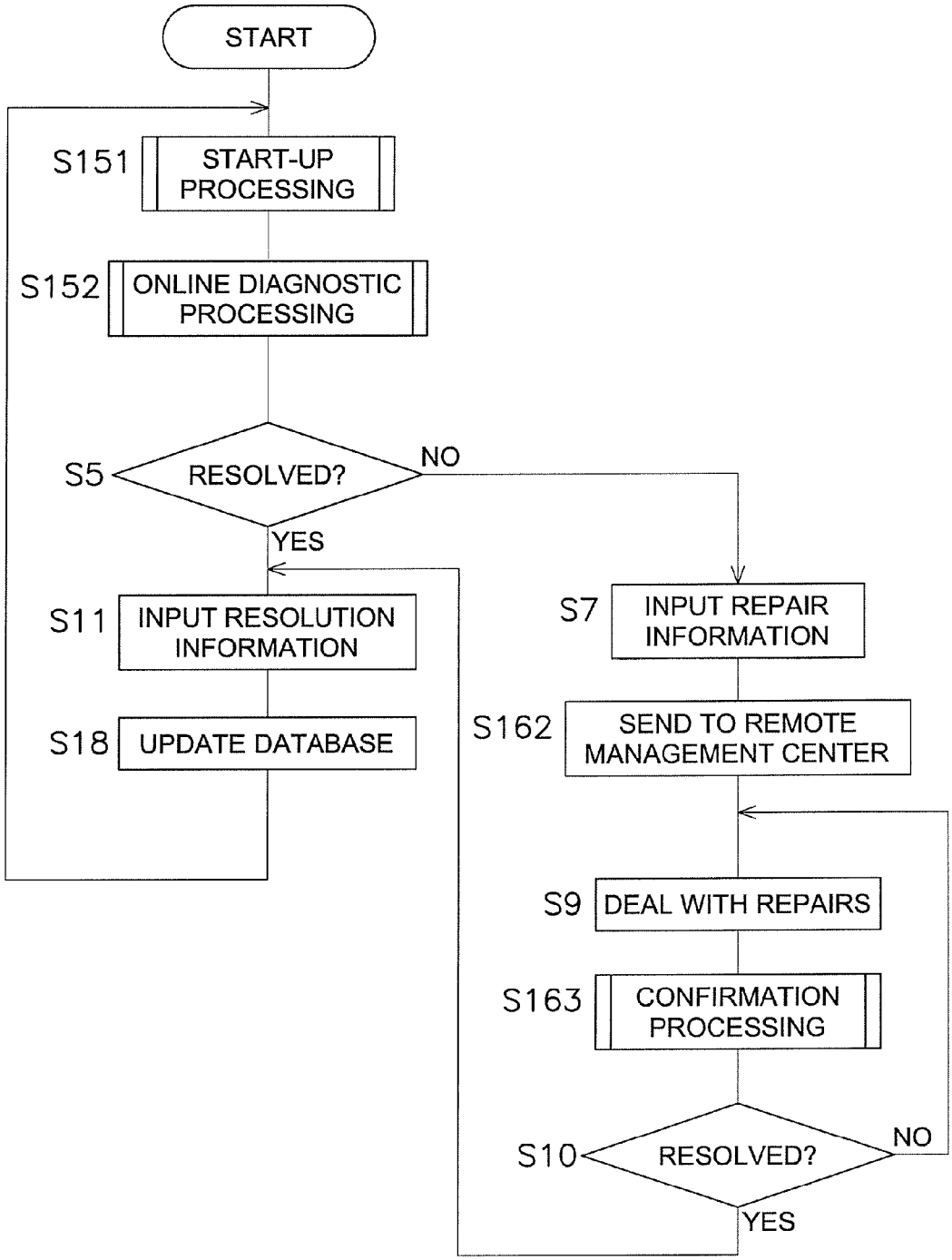
FIG. 32 is a flowchart showing a flow of processing where a specific-equipment management system manages a hot water heater.
Figure 33:
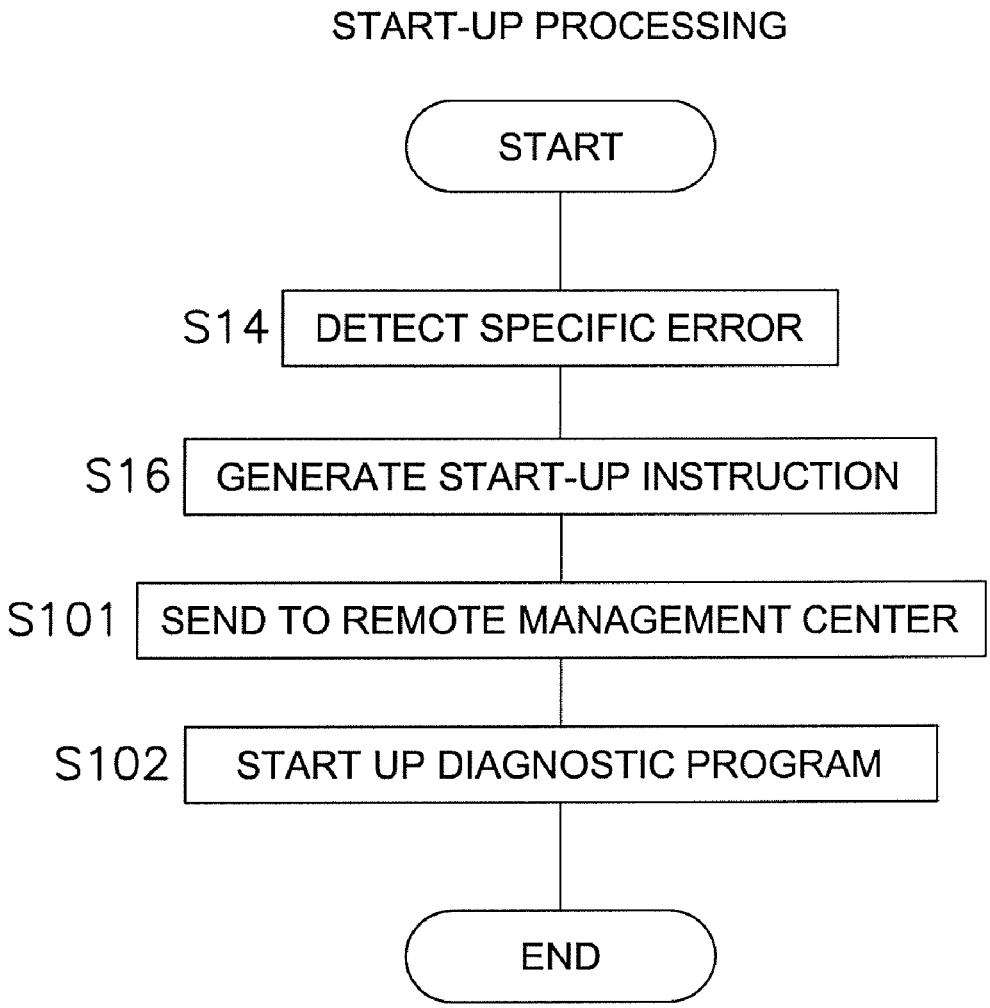
FIG. 33 is a flowchart showing a flow of start-up processing.

The details of the start-up processing S151 shown in FIG. 32 are shown in FIG. 33. The start-up processing S151 differs from the first embodiment shown in FIG. 33 with regards to the following points. In FIG. 33, processing that is the same as the start-up processing shown in FIG. 5 is given the same numerals and is not described.

In step S101 shown in FIG. 33, the start-up instruction information is sent to the remote management center 70*b*. Namely, the user transmitter 43*a* of the remote control unit 30*b* shown in FIG. 30 receives the start-up instruction information from a control unit 33*b*. The user transmitter 43*a* sends the start-up instruction information to the remote management center 70*b* shown in FIG. 31 via the network 60*a*. The remote communication unit 83*a* of the remote management center 70*b* then receives the start-up instruction information from the user transmitter 43*a* via the network 60*a*. The control unit 73*b* then receives the start-up instruction information from the remote communication unit 83*a*.

The diagnostic program 82*c* is then started up in step S102 shown in FIG. 33. Namely, the control unit 73*b* of the remote management center 70*b* shown in FIG. 31 refers to the storage unit 81*c* and starts up the diagnostic program 82*c*. The control unit 73*b* then makes the instruction generator 84*c* generate an instruction for generating a question online based on the diagnostic program 82*c*. The control unit 73*b* passes the instruction information for generating a question online and the specific-error information over to the question generator 74*c*.

Figure 34:
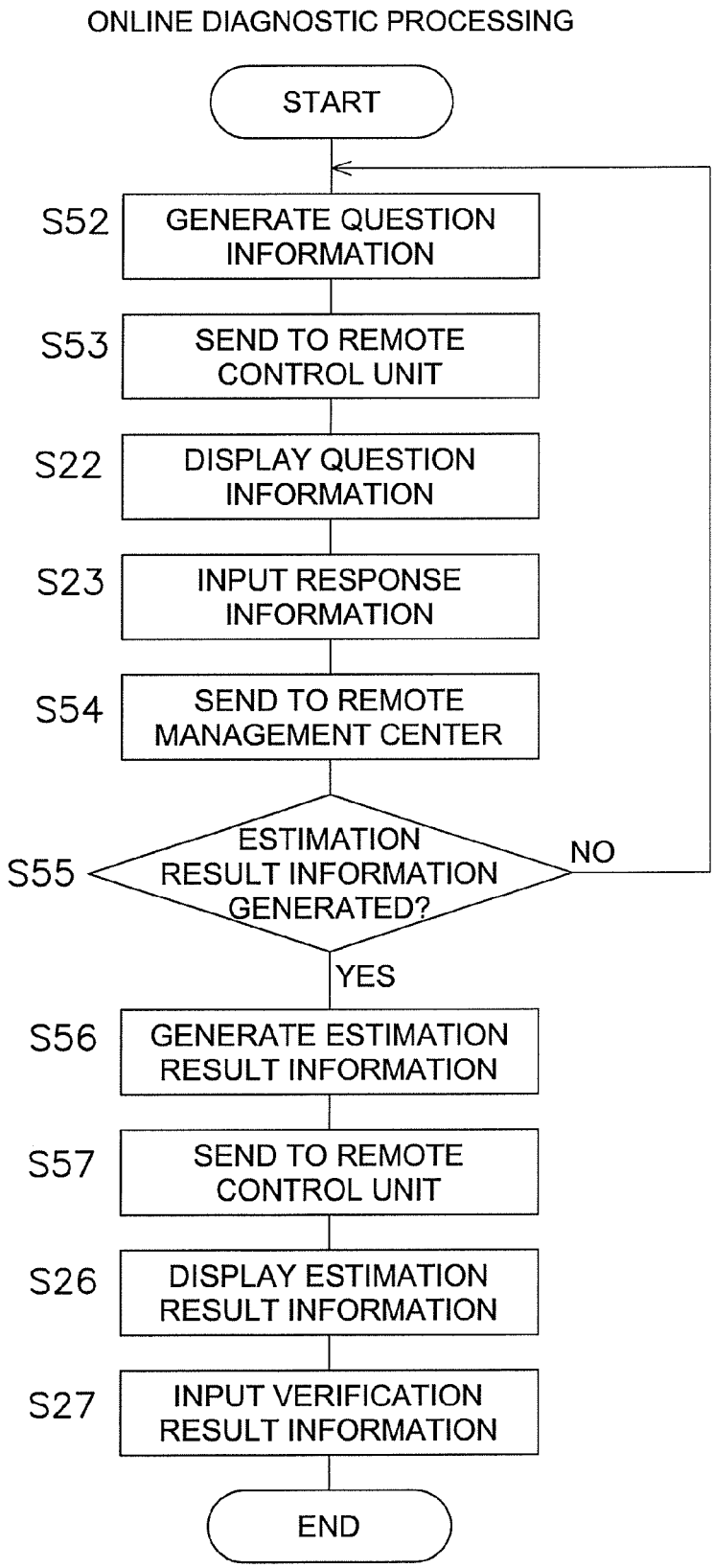
FIG. 34 is a flowchart showing a flow of online diagnostic processing.

The details of online diagnostic processing S152 shown in FIG. 32 are shown in FIG. 34. As shown in FIG. 34, the online diagnostic processing S152 differs from the online diagnostic processing 132 (refer to FIG. 25, FIG. 26) of the third embodiment in that step S51 is not present.

The start-up instruction information is therefore sent to the remote management center 70*b* via the network 60*a*. It is therefore possible to start-up the diagnostic program 82*c* based on the occurrence of a specific-error. This means that it is possible to reduce the load on the user for managing specific-errors. It is also possible for the processing performed by the determination unit 38, the question generator 36, and the estimation generator 34 to be carried out on the side of the remote management center 70*b*. This means that it is possible to reduce the processing load placed on the side of the remote control unit 30*b*.

Further, the forth embodiment has the features (1) to (5) of the first embodiment.

Modified Examples of the Fourth Embodiment (A) In step S16 shown in FIG. 33, the start-up instruction of the diagnostic program 82*c* shown in FIG. 31 can also be generated by the instruction generator 84*c*. The start-up instruction for the diagnostic program 82*c* can also be generated based on information for a specific-error. It is then possible for the diagnostic program 82*c* to be automatically started up when a specific-error occurs.

Alternatively, the step S14 shown in FIG. 33 can be omitted. In this case, the step S82 shown in FIG. 13 is executed in place of step S16. An instruction to start-up the diagnostic program 82*c* can then be inputted to the input unit 32 of the remote control unit 30*b* shown in FIG. 30 by the user of the hot water heater 10. The diagnostic program 82*c* can then be started up based on the intent of the user.

Processing of the determination unit 38, the question generator 34, and the estimation generator 35 carried out on the side of the remote control units 30, 30*a*, and 30*c* in the first, second, and third embodiments can be carried out on the side of the remote management center 70*b*. It is therefore possible to reduce the processing load occurring on the side of the remote control unit 30*b*.

INDUSTRIAL APPLICABILITY

The specific-equipment management system, the specific-equipment management program, and the specific-equipment management method of the present invention enable to understand the cause of an error even when the error is a specific-error caused by a human operation and are therefore useful as a specific-equipment management system, a specific-equipment management program, and a specific-equipment management method.

What is claimed is:

1. A specific-equipment management system managing specific-equipment requiring a human operation in a building where the specific-equipment is located or in a building adjacent to where the specific-equipment is located when used, the specific-equipment management system comprising:

a question generator configured to generate question information regarding a question estimating a specific-error cause being the cause of a specific-error regarding the specific-equipment and including human error regarding the human operation being related to actions taken by or not taken by a user in operating the specific-equipment:

a display unit displaying the question information; and an input unit receiving an input of response information being information regarding at least one of a state of the specific-equipment and a state of the human operation based on the question information displayed by the display unit, the question generator further generating next question information regarding a question about the state of the specific-equipment when generation of estimation result information is not possible based on the response information, and the display unit further displaying the next question information.

2. The specific-equipment management system according to claim 1, wherein the input unit receives an input of an instruction to start a diagnostic program that is a program configured to diagnose the specific-error.

3. The specific-equipment management system according to claim 1, further comprising:

a detector that detects the specific-error; and an instruction generator that generates an instruction to start a diagnostic program that is a program configured to diagnose the specific-error based on information for the specific-error.

4. The specific-equipment management system according to claim 1, wherein the specific-equipment is equipment utilizing a water supply.

5. The specific-equipment management system according to claim 4, wherein the specific-equipment is a water heater.

6. The specific-equipment management system according to claim 1, further comprising:

an estimation generator that generates the estimation result information that is information regarding a result estimated for the specific-error cause based on the response information, wherein the display unit further displays the estimation result information.

7. The specific-equipment management system according to claim 6, further comprising:

a determination unit that determines whether or not it is possible to generate the estimation result information based on the response information, and the estimation generator generates the estimation result information based on the response information when the determination unit determines that generation of the estimation result information is possible.

8. The specific-equipment management system according to claim 7, wherein the input unit further receives an input of verification result information that is information for a result where a cause of the specific-error is verified based on the estimation result information, and the determination unit further determines based on the verification result information whether either of resolution information that is information indicating that the specific-error is resolved or repair information that is information indicating that the specific-error requires repair is to be generated.

9. The specific-equipment management system according to claim 6, wherein the input unit further receives an input of either one of resolution information that is information indicating that the specific error is resolved or repair information indicating that the specific-error requires repair based on verification result information that is information for a result where the specific-error cause is verified based on the estimation result information.

10. The specific-equipment management system according to claim 1, wherein the input unit further receives an input of an instruction to start a confirmation program that is a program that confirms whether or not installation work or repair is completed normally after completion of the installation work or the repair.

11. The specific-equipment management system according to claim 7, further comprising:

a remote management apparatus that manages the specific-equipment via a network, wherein the remote management apparatus is connected to the question generator and the determination unit via the network;

the determination unit further determines whether or not online diagnostic processing is to be carried out when it is determined that generation of the estimation result information is not possible;

the remote management apparatus generates the next question information or the estimation result information based on the response information when the determination unit determines that online diagnostic processing is to be carried out; and the display unit receives the next question information or the estimation result information from the remote management apparatus via the network and displays it.

12. The specific-equipment management system according to claim 3, wherein the instruction generator is remote from the input unit and the display unit via a network.

13. The specific-equipment management system according to claim 2, further comprising:

a control unit that controls the question generator, the display unit, and the input unit; and a remote management apparatus that manages the specific-equipment via a network, wherein the remote management apparatus is connected to the control unit via the network, the remote management apparatus stores information for the diagnostic program, and the control unit receives information for the diagnostic program via the network from the remote management apparatus based on information for the instruction to start the diagnostic program.

14. The specific-equipment management system according to claim 8, further comprising:

a remote management apparatus that manages the specific-equipment via a network, wherein the remote management apparatus receives at least one of the estimation result information and the verification result information via the network.

15. The specific-equipment management system according to claim 8, further comprising:

a remote management apparatus that manages the specific-equipment via a network, wherein the remote management apparatus receives repair information via the network when the repair information is determined to be generated by the determination unit.

16. The specific-equipment management system according to claim 2, wherein the question generator is remote from the input unit and the display unit via a network.

17. The specific-equipment management system according to claim 3, wherein the question generator and the instruction generator are remote from the input unit and the display unit via a network.

18. The specific-equipment management system according to claim 1, further comprising:

a control unit that controls the question generator, the display unit and the input unit; and a remote management apparatus that manages the specific-equipment via a network, wherein the remote management apparatus is connected to the control unit via the network, and the remote management apparatus sends next connection information that is information regarding a next connection of the control unit and the remote management apparatus to the control unit via the network.

19. The specific-equipment management system according to claim 18, wherein the next connection information includes at least one of time information that is information regarding a time of the next connection of the control unit and the remote management apparatus via the network and transmission information that is information regarding data that are to be transmitted from the control unit to the remote management apparatus at a time of the next connection of the control unit and the remote management apparatus via the network.

20. A specific-equipment management method to manage specific-equipment requiring human operation in a building where the specific-equipment is located or in a building adjacent to where the specific-equipment is located when used, the specific-equipment management method comprising:

generating a first question, the first question being question information relating to a question estimating a specific-error cause of a specific-error of the specific-equipment and including human error regarding the human operation being related to actions taken by or not taken by a user in operating the specific-equipment;

displaying a first display on a display unit, the first display being configured to display the question information;

receiving an input being response information regarding at least one of a state of the specific-equipment and a state of the human operation based on the question information displayed in the first display;

generating second question information regarding a question about the state of the specific-equipment when generation of estimation result information is not possible based on the response information; and displaying a second display on the display unit, the second display being configured to display the second question information.

21. A specific-equipment management apparatus for managing specific-equipment requiring a human operation in a building where the specific-equipment is located or in a building adjacent to where the specific-equipment is located when used, the specific-equipment management apparatus comprising:

a question generator configured to generate first question information regarding a question about a state of the human operation in order to estimate a specific-error cause of an error regarding the specific-equipment, the human operation being related to actions taken by or not taken by a user in operating the specific-equipment;

a display unit displaying the first question information;

an input unit receiving an input of first response information regarding a response to the first question information displayed at the display unit, the first response information being information about the state of the human operation; and a determination unit that determines whether or not it is possible to generate estimation result information regarding a result estimated for the specific-error cause based on the first response information, the question generator being further configured to generate second question information regarding a question about a state of the specific-equipment when the determination unit determines that generation of the estimation result information is not possible based on the first response information, the display unit further displaying the second question information, and the input unit further receiving an input of second response information regarding a response to the second question information displayed at the display unit, the second response information being information about the state of the specific-equipment.

22. The specific-equipment management apparatus according to claim 21, wherein the specific-equipment management apparatus is connected to a remote management apparatus configured to manage the specific-equipment remotely from the specific-equipment, and the determination unit further sends information based on the input of second response information to the remote management apparatus.

* * * * *

UNITED STATES PATENT AND TRADEMARK OFFICE

CERTIFICATE OF CORRECTION

PATENT NO. : 8,166,335 B2
APPLICATION NO. : 12/158879
DATED : April 24, 2012
INVENTOR(S) : Shuhei Kawamura et al.

It is certified that error appears in the above-identified patent and that said Letters Patent is hereby corrected as shown below:

Column 35,
Line 58, "that the specific error is resolved or repair information" should read -- that the specific-error is resolved or repair information --.

Signed and Sealed this
Third Day of July, 2012

David J. Kappos

David J. Kappos
*Director of the United States Patent and Trademark Office*